US012110632B2

(12) United States Patent
Erturk et al.

(10) Patent No.: US 12,110,632 B2
(45) Date of Patent: Oct. 8, 2024

(54) AUTOMATIC IRONING APPARATUS

(71) Applicant: BSH Hausgeraete GmbH, Munich (DE)

(72) Inventors: Eren Erturk, Littleport (GB); Rohan Kamdar, Borehamwood (GB); Christos Markides, Stevenage (GB); Sergio Martinez, Worcester Park (GB); Michael Parrott, Impington (GB)

(73) Assignee: BSH Hausgeraete GmbH, Munich (DE)

( * ) Notice: Subject to any disclaimer, the term of this patent is extended or adjusted under 35 U.S.C. 154(b) by 73 days.

(21) Appl. No.: 17/910,892

(22) PCT Filed: Mar. 10, 2021

(86) PCT No.: PCT/EP2021/056029
§ 371 (c)(1),
(2) Date: Sep. 12, 2022

(87) PCT Pub. No.: WO2021/180776
PCT Pub. Date: Sep. 16, 2021

(65) Prior Publication Data

US 2023/0146409 A1 May 11, 2023

(30) Foreign Application Priority Data

Mar. 11, 2020 (GB) ..... 2003558

(51) Int. Cl.
*D06F 73/02* (2006.01)
*A47G 25/44* (2006.01)

(52) U.S. Cl.
CPC ..... *D06F 73/02* (2013.01)

(58) Field of Classification Search
CPC ..... D06F 73/02; D06F 59/00; D06F 59/02; D06F 71/18; D06F 71/20; D06F 71/26;
(Continued)

(56) References Cited

U.S. PATENT DOCUMENTS 3,002,662 A * 10/1961 Albright ..... A47G 25/621 223/95
4,199,088 A * 4/1980 Sanko ..... D06F 73/00 223/67

(Continued)

FOREIGN PATENT DOCUMENTS

CN 105297375 B 10/2017
CN 108118485 A 6/2018

(Continued)

*Primary Examiner* — Ismael Izaguirre
(74) *Attorney, Agent, or Firm* — Laurence A. Greenberg; Werner H. Stemer; Ralph E. Locher

(57) ABSTRACT

An automated ironing apparatus has a flexible steaming head for applying steam to a supported article. The flexible steaming head includes a device for shaping the flexible steaming head in at least two dimensions. A method of operating this apparatus for smoothing a garment includes a step of closing at least one opening in the garment, thereby to restrict gas flow through the at least one opening and introducing gas inside the garment thereby to smooth the garment. The step of closing at least one of the openings to be closed is effected by engaging the flexible steaming head with a surface of the garment.

21 Claims, 18 Drawing Sheets

(58) Field of Classification Search
CPC ..... D06F 71/28; D06F 71/29; D06F 71/295; D06F 71/36; A47G 25/14; A47G 25/62; A47G 25/66; A47G 25/68; A47G 25/20; A47G 25/441; A47G 25/443; A47G 25/445; A47G 25/621; A47G 25/623; A47G 25/624
See application file for complete search history.

(56) References Cited

U.S. PATENT DOCUMENTS

| | | | | |
|---|---|---|---|---|
| 6,675,997 | B1 * | 1/2004 | Gouldson | A47G 25/18 223/89 |
| 8,667,707 | B2 * | 3/2014 | Date | D06F 58/203 211/195 |
| 2005/0067442 | A1 * | 3/2005 | Redlin | D06F 73/00 223/70 |
| 2010/0282785 | A1 * | 11/2010 | Roselle | D06F 73/02 223/61 |
| 2012/0159806 | A1 | 6/2012 | Dana | |
| 2019/0257025 | A1 * | 8/2019 | Park | D06F 67/005 |

FOREIGN PATENT DOCUMENTS

| | | | | |
|---|---|---|---|---|
| EP | 0926293 | A1 | 6/1999 | |
| FR | 2704008 | A1 | 10/1994 | |
| JP | 10314500 | A * | 12/1998 | |
| WO | WO-2007049501 | A1 * | 5/2007 | A47G 25/4061 |

* cited by examiner

| Operation | Section |
|---|---|
| 1 DOORS CLOSE | |
| 2 DOORS OPEN | |
| 3 MOVE | HANGER (IN) |
| 4 DOORS CLOSE | |
| 5 MACHINE SETUP | |
| 6 STEAM | TOP BODY |
| 7 STEAM | TOP BODY |
| 8 INFLATE | TOP BODY |
| 9 INFLATE | TOP BODY |
| 10 STEAM | SLEEVE 1 |
| 11 INFLATE | SLEEVE 1 |
| 12 STEAM | SLEEVE 2 |
| 13 INFLATE | SLEEVE 2 |
| 14 TREAT | BODY |
| 15 INFLATE | BODY |
| 16 DRY | BOTTOM BODY |
| 17 DOORS OPEN | |
| 18 MOVE | HANGER (OUT) |
| 19 MACHINE RESET | |

AUTOMATIC IRONING APPARATUS

FIELD AND BACKGROUND OF THE INVENTION

This invention relates to an automated apparatus for smoothing articles. More specifically, the invention relates to an automated apparatus and method for smoothing articles that have been washed or are otherwise creased.

After being washed, articles (of clothing) and similar fabrics often dry with creases in them, which can ruin their appearance. Fortunately, these wrinkles can be removed through smoothing or pressing processes. Conventional methods used to remove wrinkles and creases include ironing and steaming.

Such conventional methods can be time consuming, and require both effort and a degree of skill on the part of the person performing the method.

Attempts to automate the removal of wrinkles and creases have been suggested, which include apparatuses in which a roller arrangement moves across a suspended article of clothing to smooth out the creases and wrinkles.

SUMMARY OF THE INVENTION

The present invention seeks to provide an improved apparatus and methods for smoothing articles (of clothing).

Aspects and embodiments of the present invention are set out in the appended claims. These and other aspects and embodiments of the invention are also described herein.

Treatment Process

According to an aspect described herein, there is provided a method of smoothing a garment, comprising: closing at least one opening in the garment thereby to restrict gas flow through the at least one opening; and introducing gas inside the garment thereby to (optionally, stretch and) smooth the garment.

By closing openings in the garment and introducing gas inside the garment, a new smoothing method may be provided, which is particularly suited for application to hanging shirts. Smoothing shirts in a hanging position may save space and improve the user experience (since necessary handling may be reduced). Further, the new smoothing method may provide smoothing of parts of garments for which the presence of the hangar makes processing by other means difficult. As will be appreciated, gas is not introduced through the fabric of the garment. Gas is introduced directly inside the garment, such that the gas contacts the (interior) fabric of the garment (rather than any intermediate structure)—this may provide for improved smoothing of a larger part of the shirt. The openings are openings through which part of the human body extends when the garment is worn. Closing preferably comprises restricting (i.e. reducing) the airflow through the openings, preferably by providing a physical barrier to airflow, more preferably such that a hoop stress is generated in the garment and/or such that the garment balloons outward; yet more preferably such that air escapes the garment through the fabric of the garment.

According to an aspect described herein, there is provided a method of smoothing a garment, comprising: introducing gas inside the garment thereby to cause inflation of the garment, thereby (optionally, stretching and) smoothing the garment.

The method preferably further comprises inflating (i.e. distending) the garment by introducing gas inside the garment. The inflation may stretch the garment, which may assist in the smoothing process.

Introducing gas inside the garment preferably comprises introducing gas via at least one opening in the garment. The at least one opening through which gas is introduced is preferably a different at least one opening to that which is/are closed. This may provide a convenient way to introduce gas.

The method preferably further comprises closing all openings in the garment other than the at least one opening used for the introduction of gas. The garment is inflated by introducing air inside the garment via the remaining unclosed opening. This may provide more reliable inflation.

The garment is preferably a garment for the upper body, and gas is preferably introduced via a neck hole of the garment. Blowers for gas are optionally provided proximate the neck hole and/or extending into the neck hole to introduce the gas. This may provide a convenient way to introduce gas, since the neck hole is located towards the top of a hanger (which is relatively accessible in an apparatus). Introducing gas via a neck hole may also allow gas to spread evenly throughout the garment.

Closing at least one opening preferably comprises applying at least one fastener to the respective at least one opening. Examples of openings which may be closed by clips include a hem of the garment and cuffs of the garment. The clip is configured such that it is suitable for substantially reducing the gas flow through the opening. For example, its width may be configured to extend over most of the width of the opening.

The method preferably further comprises tensioning the at least one fastener thereby to apply a stress to the garment, preferably wherein the stress is a longitudinal stress. The stress may stretch the garment, which may assist in the smoothing process.

Each fastener preferably comprises an elastic and/or retractable cord; more preferably extending between the fastener and a base for the fastener. The fastener may be a fastener as described herein (in particular in the below statements).

Closing at least one opening preferably comprises engaging a member with a surface of the garment. Optionally, the opening which is closed is the hem of the garment. The member may extend across the body of the shirt thereby to reduce airflow from the upper body of the garment out of the lower body.

The method preferably further comprises moving the member thereby to adjust the part of the garment into which gas is introduced. In particular, the volume of the body which is inflated by gas may be adjusted, which may thereby assist in the smoothing process.

The member is preferably a steaming head. The steaming head may be conveniently applied in other smoothing operations. Applying steam via the steaming head may reduce airflow further by effecting an improved seal. The steaming head may be a flexible and/or movable steaming head as described herein (in particular in the below statements).

The method preferably further comprises steaming the garment by moving the steaming head along the surface of the garment. This is preferably a processing step in a wider smoothing process.

The method preferably further comprises moving the steaming head while introducing gas into the garment; preferably thereby inflating the garment; more preferably over a wide area in the garment; thereby to finish the smoothing. This is preferably a processing step in a wider smoothing process.

The method preferably further comprises introducing gas inside the garment via a plurality of different flow paths;

wherein different flow paths direct gas to different parts of the garment. This may allow for more even smoothing of the garment. The different flow paths are preferably provided all via the same at least one opening. For a sleeved garment, a first flow path preferably directs gas into an upper body of the garment; a second flow path preferably directs gas into a first sleeve; and a third flow path preferably directs gas into a second sleeve.

The method preferably further comprises introducing air and steam inside the garment. Air and steam are preferably introduced at different times as part of a smoothing process. The method preferably further comprises performing the ordered steps of: introducing steam via the second and third flow paths (thereby to steam into the top part of the garment using alternate flow oaths, which is closed by the member); or alternatively via the first flow path; introducing air via the first flow path (thereby to dry the top part of the garment); and optionally, thereby to steam and dry sleeves/cuffs of a garment, introducing steam via the second flow path; introducing air via the second path; introducing steam via the third flow path; and introducing air via the third flow path. Preferably the second and third flow paths are split into separate air and steam flow paths. Steaming the garment by moving the steaming head along the surface of the garment is preferably performed as a subsequent step, which may allow a main part of the body to be processed after the sleeves/cuffs (which may thereby avoid leaving a crease in the garment by pressing the steaming head so as to close/reduce the airflow in the opening in the body). Moving the steaming head while introducing gas into the garment is preferably performed as a subsequent step, which may act to 'finish' the smoothing process and provide final smoothing. The method preferably further comprises blowing gas from underneath the garment thereby to dry the (lower parts of the) garment.

The method preferably further comprises supporting the garment on a hanger; optionally inside a processing chamber. The processing chamber is preferably sealed in use by doors. The processing chamber further comprises means for conveying hangers in and out of the chamber.

The hanger preferably comprises at least one fluid conduit for conducting gas thereby to introduce gas inside the garment. The hanger is preferably configured to engage with air blowers to conduct the gas to the inside of the garment. The hanger preferably comprises at least two elongate members which depend downwardly from the body; preferably from opposing ends of the clothes hanger, thereby to form a frame for supporting the garment. The hanger may be a hanger as described herein (in particular in the below statements). The hangar may form part of a support frame, and may be detachable from that support frame. The support frame may be a support frame as described herein.

The method preferably further comprises, for a garment having plackets, closing the plackets. The plackets may be closed using a placket closure as described herein (in particular in the below statements).

According to a further aspect described herein, there is provided an automated apparatus for smoothing an article, being adapted for use with the method of any of the preceding claims.

According to a further aspect described herein, there is provided an automated apparatus for smoothing an article, the apparatus comprising: means for closing at least at least one opening in the garment thereby to restrict gas flow through the at least one opening; and means for introducing air inside the garment thereby to (optionally, stretch and) smooth the garment.

The automated apparatus for smoothing a garment may comprise: at least one fastener for closing at least one opening in the garment thereby to restrict gas flow through the at least one opening; and may further comprise at least one gas blower for introducing gas inside the garment thereby to (optionally, stretch and) smooth the garment.

Preferably the at least one gas blower is arranged to introduce gas inside the garment to inflate the garment. The inflation may stretch the garment, which may assist in the smoothing process.

The apparatus preferably further comprises a plurality of fasteners for closing all openings in the garment other than the at least one opening used for the introduction of gas.

The at least one fastener may be tensioned thereby to apply a stress to the garment, preferably wherein the stress is a longitudinal stress. The stress may stretch the garment, which may assist in the smoothing process.

The apparatus may further comprise a member configured to adjust the part of the garment into which gas is introduced. In particular, the volume of the body which is inflated by gas may be adjusted, which may thereby assist in the smoothing process. The member is preferably a steaming head. The steaming head may be conveniently applied in other smoothing operations. Applying steam via the steaming head may reduce airflow, through the garment, further by effecting an improved seal. The steaming head may be a flexible and/or movable steaming head as described herein.

The steaming head may be configured to steam the garment by moving the along the surface of the garment. This is preferably a processing step in a wider smoothing process.

The steaming head may be configured to move whilst gas is introduced into the garment by the gas blower. This is preferably a processing step in a wider smoothing process.

The apparatus preferably further comprises a plurality of different flow paths for introducing gas inside the garment; wherein different flow paths direct gas to different parts of the garment. This may allow for more even smoothing of the garment. The different flow paths are preferably provided all via the same at least one opening. For a sleeved garment, a first flow path preferably directs gas into an upper body of the garment; a second flow path preferably directs gas into a first sleeve; and a third flow path preferably directs gas into a second sleeve.

The apparatus preferably further comprises a source of steam for introducing steam inside the garment. The apparatus preferably further comprises a (further) gas blower arranged to blow gas from underneath the garment.

The apparatus preferably further comprises a hanger for supporting the garment; optionally inside a processing chamber. Optionally the apparatus further comprises a processing chamber. The processing chamber is preferably sealed in use by doors. Optionally the apparatus further comprises doors for the processing chamber. The processing chamber further comprises means for conveying hangers in and out of the chamber.

The hanger preferably comprises at least one fluid conduit for conducting gas thereby to introduce gas inside the garment. The hanger is preferably configured to engage with air blowers to conduct the gas to the inside of the garment. The hanger preferably comprises at least two elongate members which depend downwardly from the body; preferably from opposing ends of the clothes hanger, thereby to form a frame for supporting the garment.

The automated smoothing apparatus may include a conveying means as described herein (in particular in the below statements).

The automated smoothing apparatus and the method in general provide a smoothing system having the following basic process steps: steam and inflate an upper part (a 'top body') of a garment, processing (by pressing or ironing) using the flexible steamer heads, and then inflating (by the application of air) thereby to provide a smooth finish.

Hanger

According to a further aspect described herein, there is provided a clothes hanger, comprising at least one fluid conduit for conducting fluid to the inside of a supported garment.

This may provide a convenient mechanism for introducing air inside of a garment.

The at least one fluid conduit preferably conducts fluid from outside of a supported garment; more preferably from proximate a hook of the clothes hanger. The at least one fluid conduit preferably conducts air and/or steam for smoothing a supported garment.

At least one fluid conduit preferably extends through the clothes hanger. The clothes hanger preferably comprises a plurality of fluid conduits; more preferably wherein the fluid conduits are distinct and unconnected.

A first fluid conduit is preferably arranged to direct fluid centrally in relation to the clothes hanger; more preferably such that fluid is conducted via a neck hole of a supported garment. The first fluid conduit is preferably formed by: a surface of the clothes hanger; and a member which acts as a guide for fluid flow; more preferably wherein the member is arranged generally parallel to the surface.

A second fluid conduit and a third fluid conduit are preferably arranged to direct fluid to respective extremities of the clothes hanger. The second fluid conduit and the third fluid conduit are preferably arranged to direct fluid down respective sleeves of a supported garment. The second fluid conduit and the third fluid conduit preferably extend through arms of the coat hanger.

A fourth fluid conduit and a fifth fluid conduit are preferably arranged to direct fluid via external tubing which extends out of the hanger. The fourth fluid conduit and the fifth fluid conduit are preferably arranged to direct fluid to cuffs and/or sleeves of a supported garment.

The clothes hanger preferably comprises a body having arms forming a generally triangular shape; and a hook extending from the centre of the body. The arms are preferably adjustable in width; more preferably via a rack and pinion mechanism. The hook preferably has a generally square or rectangular shape. Alternatively, the hook may be rounded. The clothes hanger preferably further comprises at least two elongate members which depend downwardly from the body; preferably from opposing ends of the clothes hanger, thereby to form a frame for supporting the garment.

The clothes hanger preferably further comprises at least one fastener (or clip) adapted for attachment to a supported garment, and more preferably wherein the fastener is attached to the elongate members by an elastic and/or retractable cord thereby to tension the supported garment. The at least one fastener preferably attaches in use to at least one opening of the garment; preferably a hem or at least one cuff. The at least one fastener is preferably configured to reduce air flow through the opening. The at least one fastener may be at least one fastener as described herein.

The hanger may be adapted for use with a smoothing method and/or an automated smoothing apparatus as described herein.

Placket Closure

According to a further aspect described herein, there is provided a placket closure for closing the plackets of a garment, comprising a rib configured to extend along the length of the opening defining the plackets.

This may provide for improved support in a smoothing operation, while avoiding artefacts caused by closing a placket conventionally. Additionally, the time taken to close the placket (as compared to using conventional placket closing means) may be reduced.

The closure is preferably a temporary closure configured for use with a conventional garment having a placket and an existing placket closure mechanism, e.g. buttons. The closure is for use in smoothing of a garment.

The closure preferably comprises a plurality of formations for receiving and retaining the plackets, the formations being mounted on the rib. Each formation preferably receives and retains one placket.

According to a further aspect described herein, there is provided a placket closure for closing the plackets of a garment, comprising a first formation for receiving and retaining a first placket; and a second formation for receiving and retaining a second placket.

By receiving the plackets separately, easier insertion may be provided.

The closure preferably further comprises a rib on which the first and second formations are mounted; preferably wherein the rib is configured to extend along the length of the placket Each formation preferably receives and retains a placket by gripping. Each formation is preferably biased to provide grip. The placket is preferably gripped between the formation and rib. The rib preferably extends along the interior of the placket, and the formations preferably protrude on the exterior of the placket. The closure is preferably arranged such that outward movement of the rib causes a tighter grip of the placket. The first and second formation are preferably arranged in a pair of formations at the same height along the rib.

The formation preferably includes a curved portion, wherein in use a side of the placket is gripped between the curved portion and the rib, such that an outer part of the curved portion presents a surface which guides the side of the placket into engagement between the curved portion and the rib. At least a part, preferably an inner part, of the curved portion is preferably textured thereby to increase grip on the side of the placket. A surface of the rib preferably comprises a layer of high friction material. The rib is preferably flexible.

According to a further aspect described herein, there is provided a placket closure for closing the plackets of a garment, comprising a retaining formation and a rib; wherein in use a placket is gripped therebetween.

The placket closure may be adapted for use with a hangar, support frame, and/or automating smoothing apparatus as described herein. In particular, the placket closure may be configured to attach to the hangar, support frame, and/or automating smoothing apparatus for use.

Combined Trouser/Shirt Hanger

According to a further aspect described herein, there is provided a support frame for an automated apparatus for smoothing a garment, comprising a detachable and re-attachable clothes hanger.

According to a further aspect described herein, there is provided a support frame for an automated apparatus for smoothing a garment, comprising: at least two elongate members; a base connecting the at least two elongate members; and at least one fastener adapted for attachment to a supported article.

This may provide for improved stability, and provides the option to support the frame at its bottom (which may allow use of a detachable clothes hanger).

The support frame preferably further comprises a hanger for removably attaching to the at least two elongate members. The hanger may be a hanger as described herein.

The at least two elongate members preferably extend from the base. The at least two elongate members are preferably configured to be movable within the base thereby to allow adjustment of the distance between the at least two elongate members. The at least two elongate members are preferably configured to be movable within the base via a (rack and pinion) mechanism configured to maintain the at least two elongate members symmetrical about a centre line of the base. The profile of the detachable hanger may be extendable, such that, when the detachable hanger is attached to the support frame, changing the distance between the elongate members changes the profile of the detachable hanger.

Each of the at least two elongate members preferably comprise, at the end of the member that is distal to the base, a projecting portion which extends generally perpendicular to the reminder of the member.

The at least one fastener is preferably attached to the at least two elongate members and/or base by an elasticated and/or retractable cord. Two fasteners are preferably provided proximate the base. Two fasteners are preferably provided proximate the end of the at least two elongate members that are distal to the base. The fasteners are preferably removable and/or re-positionable.

Clip

According to another aspect described herein, there is provided a fastener; comprising a clip for use in closing opening of a garment; means for attaching to a frame member; and an elastic and/or retractable cord extending therebetween.

The fastener is preferably re-positionable about a support frame, and is configured to tension garments while closing openings of the garment. The fastener may be fastener as described elsewhere herein.

Flexible Steaming Head

According to another aspect described herein there is provided a flexible steaming head for applying steam to a supported article in an automated ironing machine (i.e. an automated smoothing apparatus, optionally the apparatus as described herein), the flexible steaming head being configurable (optionally, from a flat shape for ironing part of garments such as shirts) into a triangular shape for smoothing parts of garments such as trouser legs. The flexible steamer head may comprise means for shaping said flexible steaming head in at least two dimensions; preferably wherein one of said dimensions allows configuring of the flexible steaming head into a triangular shape (and vice versa).

According to another aspect described herein there is provided a flexible steaming head for applying steam to a supported article in an automated ironing machine, the flexible steaming head comprising: at least one steaming head; and means for shaping said flexible steaming head in at least two dimensions such that, in use, the flexible steaming head engages with a surface of the supported article thereby applying a force to said supported article. This flexible steaming head may provide an improved apparatus for applying steam to a garment and in particular garments with differently shaped parts such as trousers.

The profile of the flexible steaming head is preferably adjustable to conform to the width of a supported article. The flexible steaming head is also preferably adjustable to change the depth-profile of the flexible steaming head. Adjustment of the depth profile of the flexible steaming head advantageously allows the flexible steaming to treat garments of different shapes and in particular to maintain an applied force when treating differently shaped parts of a garment. The depth-profile may be adjusted to configure the flexible steaming head into a triangular shape.

The flexible steaming head preferably comprises a left, a right and a central rigid steaming head that are adjustable to change the profile and/or depth-profile of the flexible steaming head. The depth-profile is preferably adjusted by pivoting the left and/or right steaming head.

The flexible steaming head preferably further comprises means for positioning the rigid steaming heads so as to extend the profile and/or the depth-profile of the flexible steaming head. The means for positioning the rigid steaming heads to extend the depth-profile may comprise one or more pistons connected to the rigid steaming heads at a non-pivoting end and/or a geared motor attached at a pivoting end of the rigid steaming heads.

The flexible steaming head further comprises means for detecting the tension in the supported article, preferably a force sensor arranged to detect the tension in the supported garment. The flexible steaming head further preferably wherein the profile and/or depth profile of the flexible steaming head is determined by a measured tension parameter of the supported article.

Conveying Means for an Automated Ironing Apparatus

According to another aspect described herein, there is provided an automated apparatus for smoothing an article, the apparatus comprising: a treatment chamber; means for conveying a support frame into the treatment chamber (i.e. an entry rail); and means for conveying the support frame out of the treatment chamber (i.e. an exit rail) by supporting the frame from underneath. The support frame may comprise a hanger, preferably wherein aid hanger is detachable and re-attachable to the rest of the frame and/or wherein the frame is supported by the means for conveying a support frame into the treatment chamber by the hanger. The apparatus may also comprise means for supporting the support frame in the treatment chamber.

According to another aspect described herein, there is provided a conveying means for a garment supported by a support system through an automated ironing apparatus, the conveying means comprising: an entry rail for accepting a support system loaded with a garment and for conveying the support system into a processing chamber of the automated ironing apparatus; a central rail for securing the support system during a treatment process, accepting a support system from the entry rail and for conveying the support system to an exit rail; and an exit rail for accepting a support system loaded with a treated garment from the central rail and conveying the support system from the processing chamber of the automated ironing apparatus to the exterior of the automated ironing apparatus.

Preferably the conveying means has a storage section in the interior of an automated ironing apparatus into which an empty frame may be moved by the central and/or exit rail, and/or from which a stored empty frame may be retrieved by the central and/or exit rail.

The conveying means further comprises a presentation rail connected to the central and/or exit rail which may be configured to receive an empty frame of a support system stored within an automatic ironing and optionally convey the empty frame from the interior of the automatic ironing apparatus to the exterior of the automatic ironing apparatus for collection by a user.

The invention extends to methods, system and apparatus substantially as herein described and/or as illustrated with reference to the accompanying figures.

The invention also provides a computer program or a computer program product for carrying out any of the methods described herein, and/or for embodying any of the apparatus features described herein, and a computer readable medium having stored thereon a program for carrying out any of the methods described herein and/or for embodying any of the apparatus features described herein.

The invention also provides a signal embodying a computer program or a computer program product for carrying out any of the methods described herein, and/or for embodying any of the apparatus features described herein, a method of transmitting such a signal, and a computer product having an operating system which supports a computer program for carrying out the methods described herein and/or for embodying any of the apparatus features described herein.

Any feature in one aspect of the invention may be applied to other aspects of the invention, in any appropriate combination. In particular, method aspects may be applied to apparatus aspects, and vice versa. As used herein, means plus function features may be expressed alternatively in terms of their corresponding structure, such as a suitably programmed processor and associated memory.

Furthermore, features implemented in hardware may generally be implemented in software, and vice versa. Any reference to software and hardware features herein should be construed accordingly.

As used herein, the term 'article' preferably connotes an item which is smoothed/which is to be smoothed, preferably a fabric item, more preferably an item of clothing. As used herein, the term 'garment' preferably connotes an item of clothing. As will be appreciated, not all articles to be smoothed are garments (e.g. sheets).

As used herein, the term 'smoothing' preferably connotes the removal of wrinkles, and preferably should be understood to be synonymous with the terms 'ironing'.

As used herein, the term 'clothes hanger' (or simply 'hanger') preferably connotes a device for supporting garments by hanging; more preferably a device having a triangular shape to approximate human shoulders.

As used herein, the term 'placket' preferably connotes the fabric of either side of an opening in the upper part of the garment; more preferably wherein the opening extends all the way through the garment so as to divide the garment into two halves.

It should also be appreciated that particular combinations of the various features described and defined in any aspects of the invention can be implemented and/or supplied and/or used independently.

BRIEF DESCRIPTION OF THE FIGURES

Some practical implementations will now be described, by way of example only, with reference to the accompanying drawings in which.

DETAILED DESCRIPTION OF THE INVENTION

Figure 1:
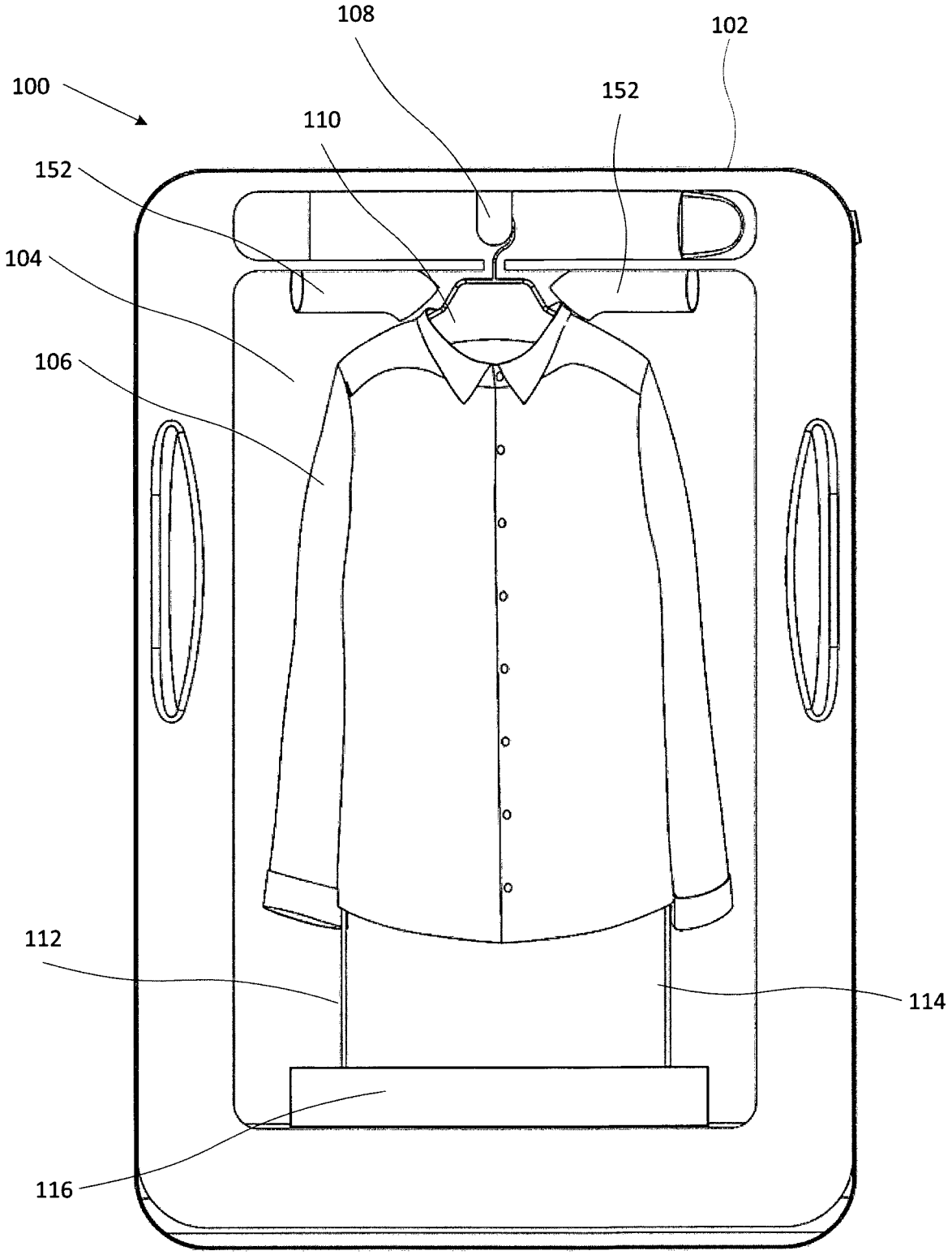
FIG. 1 shows an automatic ironing apparatus for treating articles.

An example of an automated apparatus 100 for smoothing an article 106 (of clothing) is shown in FIG. 1.

For convenience, the article 106 used herein to describe the apparatus 100 is a shirt, though the apparatus 100 can of course be used to smooth other articles and similar fabrics.

The apparatus 100 includes a housing 102 defining a processing chamber 104, in which a shirt 106 (i.e. an 'article') is supported by a hanger 110.

A support rail 108 is positioned at the top of the housing extending from the outside of the housing through the inside of the housing and out from an opposite of the housing. The support rail extends through the top of the processing/treatment chamber.

The hanger 110 has a hook portion that in turn is used to support the hanger 110 from the support rail 108. The support rail has a means of conveying supported hangers across the length of the support rail, such that the hanger and associated supported article/garment is positioned inside the processing chamber 104.

The hanger 110 also includes a left 112 and right 114 leg portion which extends downward from the hanger 110. As will be described later on, these left and right leg portions extend from the extremities of the hanger (i.e. the outer part of the 'shoulders' of the hanger). During treatment the leg portions of the hanger 110 may be secured within the processing/treatment chamber by flaps 116. The flaps 116 extend from the base of the treatment chamber to grasp the leg portions of the hanger. Alternatively, as will be described later on, the leg portions may be connected by a base.

Air blowers 152 are positioned at the top of the processing/treatment chamber, so as to blow, preferably heated, air towards the hanger and the supported article.

The apparatus also includes at least one vertical rail attached to the inside of the housing. In this example, two vertical rails are positioned on opposite sides of the processing chamber.

A steaming assembly (not shown), for applying steam and pressure to the supported article is connected to and suspended between the vertical rails.

Actuators positioned on the steaming assembly allow movement of the steaming assembly toward and away from the suspended article. The steaming assembly is discussed in more detail below.

Motors on the vertical rails allow the steaming assembly to be movable vertically along the vertical rails in the processing chamber.

Although not shown, doors are provided on at least one side of the housing 102 so as to allow the treatment chamber 104 to be opened to allow loading of articles into the treatment chamber and closed, such that when the doors are closed the treatment chamber is enclosed by the housing 102 and the closed doors.

The doors may be arranged to open horizontally or vertically, and are preferably arranged as roller doors, which roll up when open to save space.

As mentioned above, the housing 102 is provided with at least one door (not shown) to allow article 106 to be placed in the treatment chamber 104 and the housing 102 is then closed for treatment, and then opened afterwards to allow the smoothed article 106 to be removed.

The door may help to keep the heat and steam contained within the apparatus 100 and inhibits any potential contaminant entering the treatment chamber 104 during treatment.

The housing 102 may have doors on both sides of the housing 102 to allow articles to be introduced via one door and removed via another door, thereby acting as entry and exit doors.

This arrangement may be beneficial should a conveying arrangement be provided that allows multiple articles to be prepared for treatment, and then treated sequentially by being moved into the processing chamber 104, smoothed and then removed afterwards, without user input such that the process is entirely automated.

Each article should of course be treated individually within the processing chamber 104.

The apparatus 100 also includes a source of steam connected to a plurality of steam outlets and a means for providing steam to the hanger 110 and steaming assembly.

Furthermore, the apparatus includes a processor for controlling the components of the apparatus, for example the smoothing assembly, air blowers, steam outlets, the vertical track motors, the support rail, may all be connected to and controlled by a processor.

The processor is connected to and receives input from a user interface. The user interface may be located on the apparatus 100 or may be located on a user device.

The processor is preprogramed with a number of different treatment routines which the user selects by operating the user interface.

When the processor receives instruction from the user via the user interface, the processor executes a selected treatment routine by controlling and providing instruction to the components of the apparatus 100.

The various components and treatment routines of the apparatus will now be described in detail.

Hanger

Figure 2B:
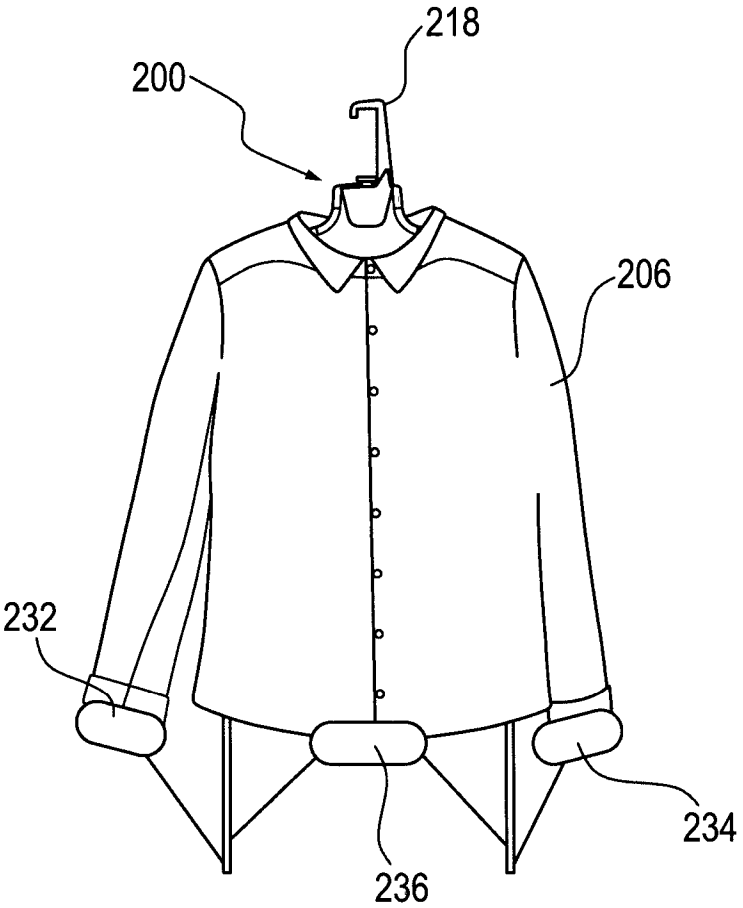
FIG. 2B shows the hanger of FIG. 2A in use with a garment supported.
Figure 2A:
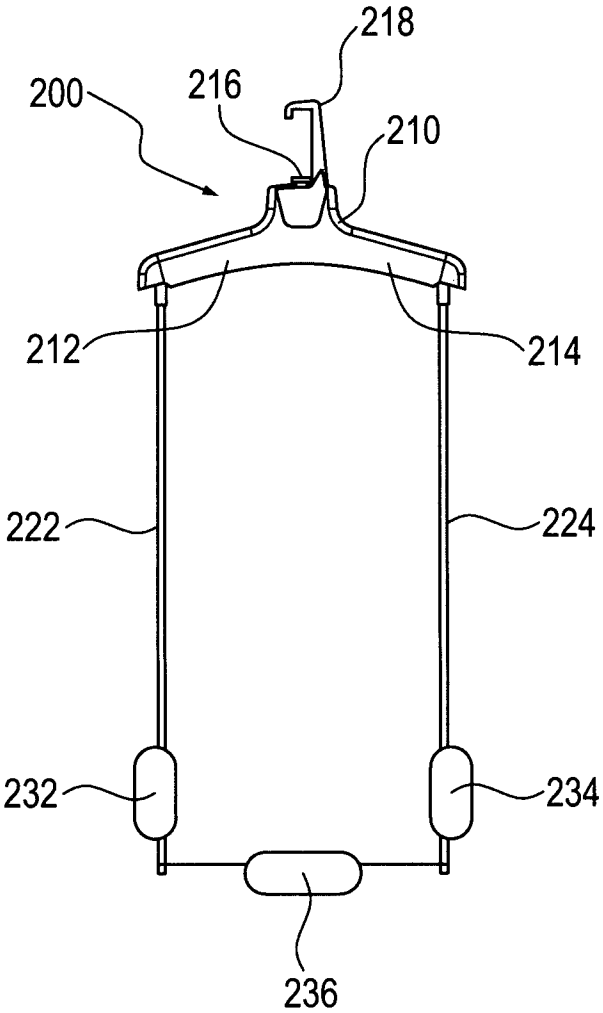
FIG. 2A shows a hanger for supporting a garment to be treated.

An example hanger 200 that may be used with apparatus 100 is shown in FIG. 2A.

FIG. 2B shows the same hanger 200 supporting an article 206, which in this case is a shirt. The hanger 200 will now be described in detail and with reference to the supported article 206.

The hanger 200 has a centre portion 210, which extends upwardly (as is conventional). Two arm portions 212 and 214 are connected to the centre portion. The two arm portions extend in opposite directions from the centre portion. For ease of reference the two arm portions will be referred to as the left 212 and right 214 arm portions. The left and right arm portions are angled downward from the horizontal, thereby to from a shape which approximates human shoulders (providing for mounting of a garment for the upper body, such as a shirt). The angle at which the arm portions are angled is identical for the left and the right the arm portions. The profile of the arm portions and central portion 210 together define a width of the hanger 200. The hanger 210 has a substantially triangular shape formed by the angle of the two arm portion 212, 214 with the horizontal.

The substantially triangular shape allows an article 206 to be supported by the hanger, in particular a shirt or an article of substantially the same shape as a shirt.

A hook portion 218 connects to and extends from the centre portion 210 of the hanger. The hook portion 218 extends from the hanger in an upward direction and forms a hook shape above the centre portion 210 of the hanger. The hook shape may be 'square' (i.e. it does not include rounded corners) thereby to prevent the hanger from swinging when attached to a suitably shaped support rail 108 or in an alternative the hook may be round. Anti-rotation structural features may be added to the hook to restrict movement of the hanger (in particular for the case where a round hanger is used) when it is attached to the support rail 108. The hook portion 218 may further comprise an indexing means for manipulating the position of the hanger 200 on the support rail 108, which may cooperate with indexing means on the support rail 108.

A right leg portion 224 is an elongate member that extends in a downwards direction from the right arm portion 214. The right leg portion 224 is connected to the right arm portion 214 at a position near the extremis of the right arm 214 from the centre portion 210.

A left leg portion 222 is an elongate member that extends in a downwards direction from the left arm portion 212. The left leg portion 222 is connected to the left arm portion 212 at a position near the extremis of the left arm 212 from the centre portion 210.

During treatment of a supported article/garment 206 the left and right leg portions are secured in place in the treatment chamber of the automatic ironing apparatus by flaps 106 that extend from the base of the automatic ironing apparatus 100.

The hanger includes at least one fastener to tension and close openings in the article 206; in this example the fasteners of the hanger are left and right cuff clips 232 and 234 and hem clip 236.

The right cuff clip 234 is attached, via an elasticated cord, to the bottom of the right leg portion 214 of the hanger 200. The right cuff clip 234 is attachable to the cuff of a right sleeve of an article 206 supported by the hanger 200 to seal or partially seal the sleeve and to apply a downward force to the sleeve of the supported article, by virtue of the elastic cord. The downward force creates a tension along the length of the sleeve.

A left cuff clip 232 is attached, via an elasticated cord to the bottom of the left leg portion 212. The left cuff clip 232 is attachable to the cuff of a left sleeve of an article 206 supported by the hanger to seal or partially seal the left sleeve and to apply a downward force to the sleeve of a supported article, by virtue of the elastic cord. The downward force applies a tension along the length of the sleeve.

The hem clip 236 is attached to the left 212 and right 214 leg portions, via an elasticated cord. The hem clip 236 is positioned between the base of the right 224 and left leg portions 222. The hem clip 236 is attachable to the bottom of a shirt 206 supported by the hanger 200. When attached to the bottom of a shirt 206 supported by the hanger 200 the hem clip 236 brings together the front and back of the shirt 206 to seal or partially seal the bottom of the shirt. Furthermore, when the hem clip 236 is attached to a supported shirt 206 a downward tension is applied to the supported shirt 206 by virtue of the elastic cords attaching the hem clip 236 to the right and left leg portions 222,224.

As will be appreciated, the use of the elasticated cords may allow the various clips to be positioned differently depending on the size and shape of the supported article. The positioning of the clips is generally performed by a user as or directly after the article is mounted on the hanger.

As will be appreciated, the use of clips partially seals all of the openings in the article through which part of the user's body extends through in use (i.e. the cuffs and the hem). The effect of the partial seal may be to reduce the airflow through the openings. The use of the clips also tensions the article.

The hanger comprises several venting pathways (i.e. fluid conduits) for directing air and/or steam to parts or areas of a supported article. The structural details of these venting pathways will now be discussed. The venting pathways of the hanger are shown in detail in FIGS. 3A, 3B and 3C.

For ease of reference the sides of the hanger will be called the front and back sides.

Figure 3A:
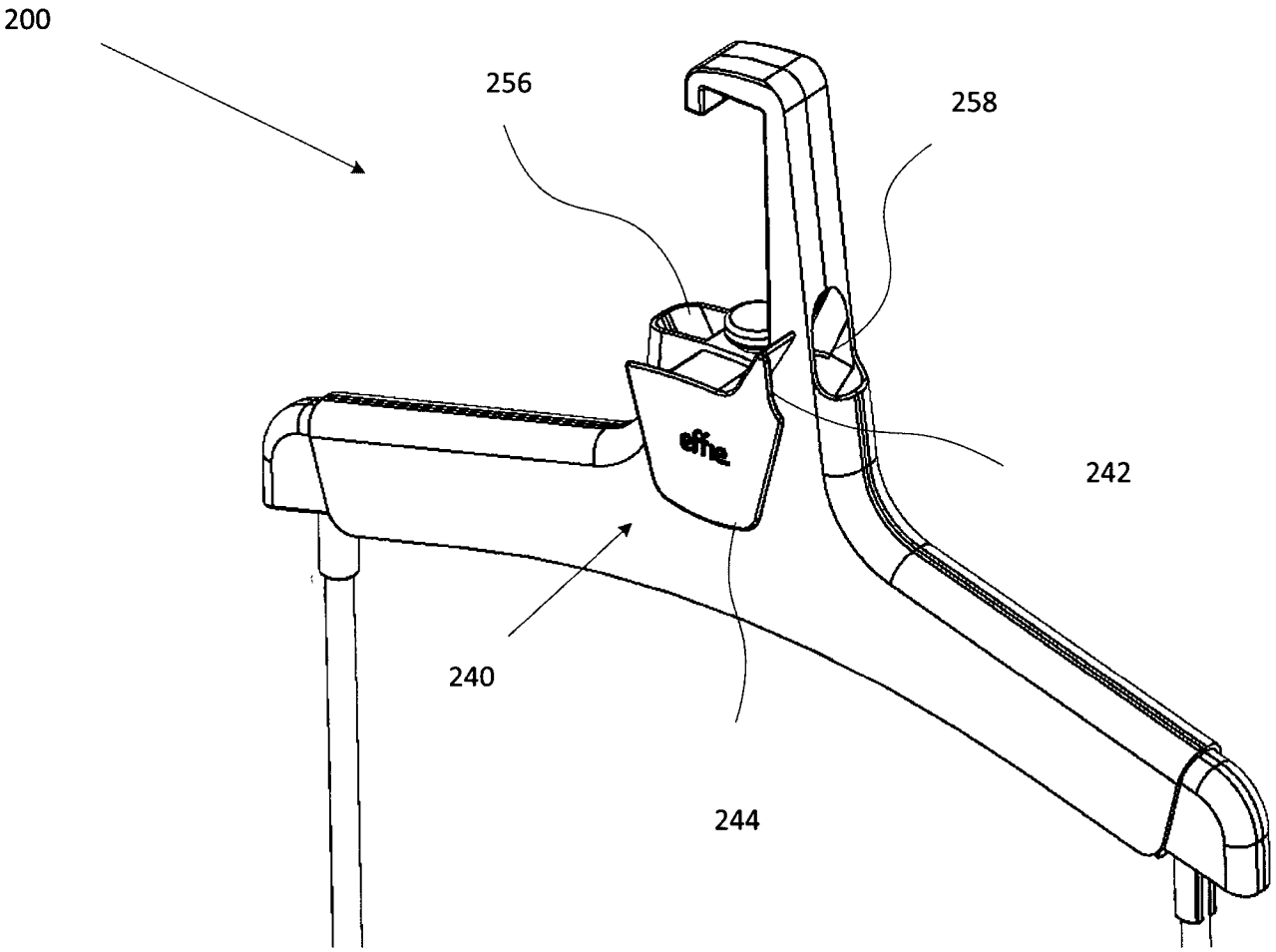
FIG. 3A shows a perspective view of an air guide on the front of the hanger of FIG. 2A.

FIG. 3A shows an air guide 240 which is mounted on the front side of the hanger, on the central portion 210 of the hanger. The air guide 240 forms a fluid conduit, more specifically a gas conduit, on the hanger. The air guide 240 takes substantially the whole of the central portion on the hanger, and is formed to have a flat 'shield' facing outwardly from the central portion. The air guide 240 is a flat member which extends from the central portion. The flat member is positioned at a distance from the front side of the hanger and the gap between the hanger and the flat member forms an air inlet 242 leading to a channel through which the air travels. A connecting feature joins the flat member to the front side of the hanger, the connecting feature has the shape of an upside-down triangle (i.e. point at the bottom), so that the two slanting faces of the connecting feature guide air flow downwards out of an outlet 244 and into the shirt.

The front air guide 240 may serve to direct air directly down the first of the inside of the supported garment.

Figure 3B:
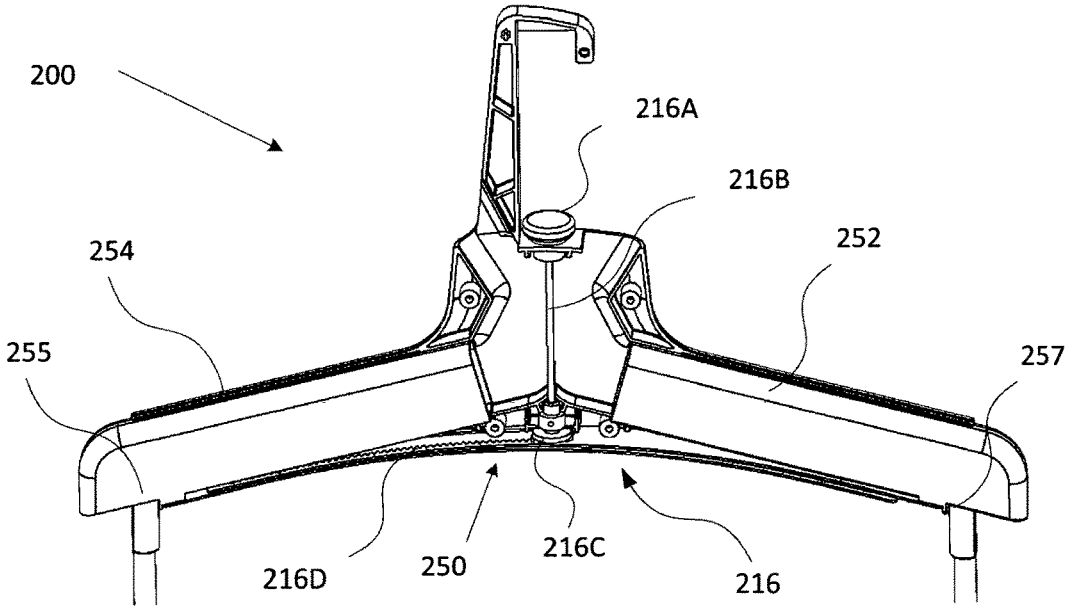
FIG. 3B shows a cross section view an interior air conduit of the hanger of FIG. 2A.

FIG. 3B is a partial cut-away view of the hanger showing an internal air conduit 250, forming a further venting pathway. The internal air conduit 250 comprises a right section 254 and a left section 252 which extend through the arm portions 212, 214 of the hanger. The arm portions 212, 214 are accordingly hollow.

The central portion 210 (not shown in FIG. 3B) is similarly hollow to receive air thereinto through first and second inlets 256, 258 provided at the upper corners of the central portion 210 (visible in FIG. 3A). The central portion of the hanger may be made up from two pieces which are mirror images of each other. The front and back sides together form the full shape of the inlets 256 and 258, as well as providing connection points for right and left arm portions to connect to.

The right section 254 has a right outlet 255 for expelling air received by the internal air conduit 250. The right outlet 255 is positioned at the extremis of the right arm portion 214 of the hanger. Similarly, the left section 252 has a left outlet 257 for expelling air received by the internal air conduit 250. The left outlet 257 is positioned at the extremis of the left arm portion 212 of the hanger 200. The outlets 255 and 257 of the right and left sections of the internal air conduit 250 are directed downward away from the hanger 200.

In use, the internal air conduit 250 may serve to direct air down the right and left sleeves of a supported garment. As will be appreciated, the inlets to the air guide 240 and the internal air conduit 250 are located at different locations along the width of the hanger, but both proximate the top of the hanger. This may provide for improved processing, in that appropriately located air blowers may be provided at different points along the guide rail 108 such that the venting pathways may be used sequentially.

The hanger 220 further comprises a steam distribution system that provides further venting pathways (i.e. fluid conduits).

Figure 3C:
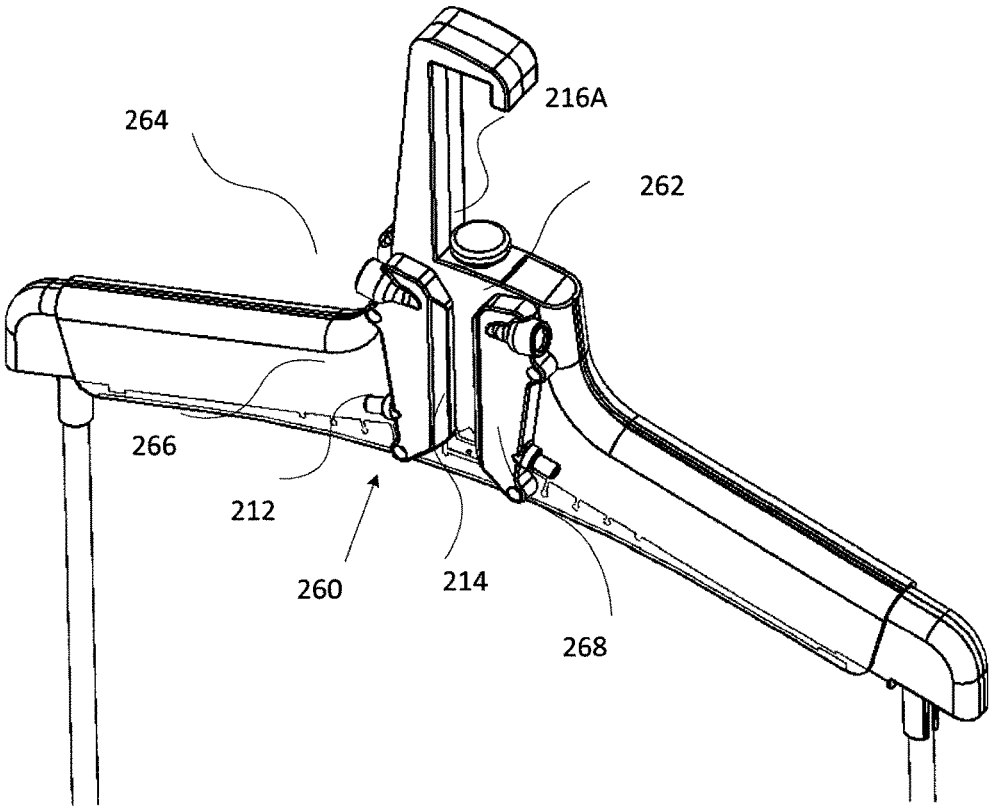
FIG. 3C shows a rear perspective view of a steam distribution system of the hanger of FIG. 2A.

FIG. 3C shows the rear of the hanger, showing the steam distribution system 260 of the hanger. A left 262 and right 264 steam inlet, for receiving steam, are positioned on the rear side centre portion 210 of the hanger 200 (i.e. on the other side to the air guide 240). The inlets 262, 264 are provided on respective left and right arm portions 212, 214, which are mounted back-to-back on the central portion 210.

The right steam 264 inlet is in fluid connection with a right steam outlet 266 positioned on the central portion 210 of the hanger 200. The steam outlet 266 is in fluid connection with a length of tubing (not shown) extending along the rear of the right arm portion 214 of the hanger.

Figure 3E:
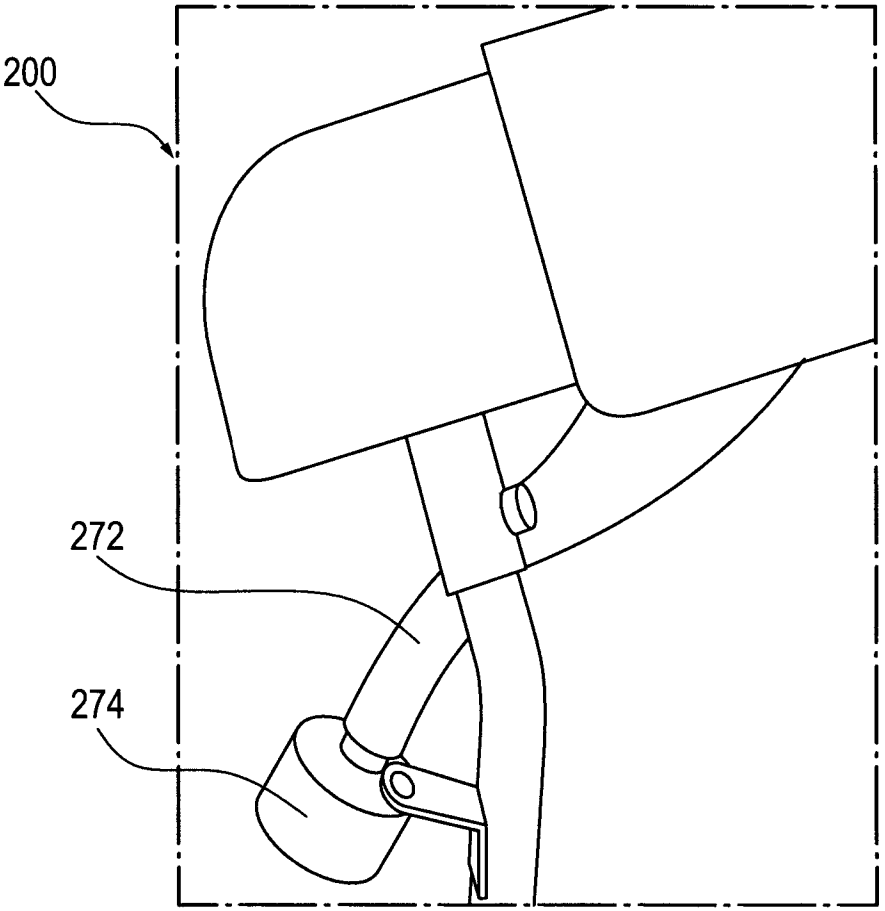
FIG. 3E shows a close-up view of a corner of the hanger of FIG. 3A.

The left steam inlet 262 is in fluid connection with a steam outlet 268 positioned on the central portion 210 of the hanger. The left steam outlet 268 is in fluid communication with a length of tubing 272 (shown in FIG. 3E) extending along the rear of the left arm portion 212 of the hanger.

The right length of tubing has a steam outlet (not shown), for expelling steam from the right tubing.

The steam outlet of the right tubing is positioned near the extremis of the right arm portion 214 and directed in the downward direction. The right tubing and the steam outlet of the right tubing extend part way along the right leg portion of the hanger such that the steam outlet of the right tubing is positioned partway down the right leg portion, for example approximately 70 mm from the right arm of the hanger. The steam outlet is positioned so as to expel steam down the sleeve of a mounted garment.

The left length of tubing 272 has a steam outlet 274 (shown in FIG. 3E), for expelling steam from the left tubing, positioned near the extremis of the left arm portion 214 and directed in the downward direction. The left tubing and the steam outlet of the left tubing extend part way along the left leg portion of the hanger such that the steam outlet of the left tubing is positioned partway down the left leg portion, for example approximately 70 mm from the left arm of the hanger. The left steam outlet is positioned so as to expel steam down the sleeve of a mounted garment.

The tubing may be rigid and/or attached to the hanger such that it is held in place.

Steam received at the right steam inlet 264 is expelled at the right steam outlet 266 into the right tubing and moves along the tubing of the right arm portion 214, away from the centre portion 210 and to the extremis of the right arm portion 214 where it is expelled from the steam outlet (not shown) of the right tubing.

Similarly, steam received at the left steam inlet 262 is expelled at the left steam outlet 268 into the left tubing and moves along the left tubing along the left arm portion 212, away from the centre portion 210 and to the extremis of the left arm portion 212 where it is expelled from the steam outlet (not shown) of the left tubing.

The hanger 200 therefore not only supports an article 206 in the apparatus 100 but also directs, via venting pathways, steam and air into the suspended article 206.

Furthermore, the hanger 200 also provides a hook 218, which acts as a means for attaching the hanger 200 and therefore a supported article 206 to the support rail 108 of the apparatus 100 such that the hanger 200 and supported article 106 may be conveyed and/or indexed by the support rail 108 to positions along the support rail 108 such as treatment positions in the treatment chamber of the apparatus.

The hanger 200 will now be described in use in apparatus 100 during a treatment process.

The operation described here focusses on the involvement of the hanger 200 in the treatment process. The processes described here with reference to the hanger may be used simultaneously with, before or after treatment processes described later with reference to other parts of the apparatus.

In use, an article 206 is loaded onto the hanger 200 as shown in FIG. 2B. In this example the article is a shirt.

A shirt 206 is loaded onto the hanger 200 such that the centre portion 210 of the hanger 200 protrudes from the neck hole of the shirt and the left and right arm portions 212 and 214 of the hanger 200 extend along the inside of the left and right shoulder portions of the shirt 206.

The shirt 206 is loaded onto the hanger 200 such that the front of the hanger 200 is adjacent the inside front of the shirt and the back of the hanger is adjacent the inside back of the shirt.

The outlet 244 of the air guide 210 of the hanger 200 is thereby positioned to direct air received at the air inlet 242 of the front air guide 240 down the neck hole of the shirt and into shirt 206.

The right air outlet 255 of the internal air conduit 250 is positioned inside the shirt 200 to direct air received at the right air inlet 256 along the right section 254 which is internal to the right arm portion of the hanger and down the inside of the right arm portion 214 of the hanger and into the right sleeve of the shirt.

The left air outlet 257 of the internal air conduit air guide 250 is positioned inside the shirt 206 to direct air received at the left air inlet 258 along the left section 252, which is internal to the left arm portion of the hanger, and down the inside of the left arm portion 212 of the hanger and into the left sleeve of the shirt 206.

Similarly, the steam outlets of the left and right tubing are positioned in the shirt to expel steam received from the left and right steam outlets 268 and 266 into the left and right sleeves of the shirt 206.

Once loaded onto the hanger 200 the front of the shirt is secured shut (i.e. the plackets of the shirt are closed). For example, by doing up the buttons of the shirt.

When the hanger 200 is secured by the hook portion 218 to the support rail 108, the shirt 206 is supported by the left and right arm portions 212 and 214 of the hanger. The left and right leg portions, 222 and 224, extend down the inside sides of the shirt 206.

The user attaches the right cuff clip 234 to the cuff of the right sleeve of the supported shirt 206. The right cuff clip 234 is attached to the right cuff of the shirt 206 such as to seal or partially seal the end of the right sleeve of the shirt. Furthermore, the attached right cuff clip 234 pulls on the right sleeve in a downwards direction. This pulling force is generated by the stretching of the elasticated cord attaching the right cuff clip 234 to the right leg portion 224 of the hanger 200. The downward force applied to the right sleeve by the right cuff clip 234 pulls the right sleeve taut creating tension in the right sleeve.

In a similar manner, the user attaches the left cuff clip 232 to the cuff of the left sleeve of the supported shirt 206. The left cuff clip 232 is attached by the user to the left cuff of the shirt 206 such as to seal or partially seal the end of the left sleeve of the shirt. Furthermore, the attached left cuff clip 232 pulls on the left sleeve in a downwards direction. This pulling force is generated by the stretching of the elasticated cord attaching the left cuff clip 232 to the left leg portion 222 of the hanger 200. The downward force applied to the left sleeve by the left cuff clip 232 pulls the left sleeve taut creating tension in the left sleeve.

The last clip, the hem clip 236, is attached by the user to the bottom hem of the supported shirt 206. The hem clip 236 is attached by the user to the hem of the shirt 206, bringing the front and the back material of the shirt 206 together, such as to seal or partially seal the bottom of the shirt 206. Furthermore, the attached hem clip 236 pulls on the bottom hem of the shirt 206 in a downwards direction. This pulling force is generated by the stretching of the elasticated cords attaching the hem clip 206 to the right and left leg portions, 224 and 222, of the hanger 200. The downward force applied to the bottom hem of the shirt by the hem clip 236 pulls the body of the shirt taut creating tension in the material of the body of the shirt 206.

The hanger and the supported article are loaded onto the support rail 108 of the apparatus 100. The hanger is secured onto the support rail 108 using the hook portion 218 which mechanically interfaces with the support rail 108 to secure the hanger to the support rail 108.

During operation the hanger 200 and the supported article 206 are conveyed, through a set of open entry doors, along the support rail 108 into a treatment position inside the treatment chamber of the apparatus 100. Once the article is in the treatment chamber the entry doors close such that the treatment chamber of the apparatus 100 is enclosed.

There may be several treatment positions inside the treatment chamber which utilise the different venting pathways of the hanger 200.

During treatment the support rail 108 will index or convey the hanger 200 to these different treatment positions for treatment.

For example, a first treatment position may be defined by alignment of the air inlet 242 of the air guide 240 with the air path of the air blowers 152 positioned in the treatment chamber. Once the hanger 200 and supported article 206 are in this position the air blowers 152 active a specific treatment cycle, turning on and blowing air. The air blown by the air blowers 152 during the treatment cycle is received by the air inlet 242 of the first air guide 240 and directed by the air guide 240 through the air outlet 244 of the front air guide 240 and into the neck hole of the supported shirt 200.

The hem clip 236 that seals the bottom of the shirt restricts the air directed into the body of the shirt by the front air guide 240 from exiting the shirt 206 at the bottom, causing the body of the shirt 206 to inflate. The air directed in this manner therefore inflates and optionally dries the shirt 206 in order to aid in the smoothing treatment of the shirt 206.

As mentioned above such operation of the hanger 200 and air blowers 152 may be used simultaneously with, before or after a treatment of the shirt using the steaming apparatus and/or steam outlets of the apparatus.

During treatment, the hanger 200 is moved, by the support rail 108, to a second treatment position. In the second treatment position the left and right air inlets, 258 and 256, of the internal air conduit 250 align with the air path of the air blowers 152 of the apparatus 100. Once the hanger 200 and supported article 206 are in this position the air blowers 152 active a specific treatment cycle, turning on and blowing air.

Different air blowers 152 may be activated at different times to prevent air streams to the left and right air inlets, 258 and 256, from interfering with each other. The air blown by the air blowers 152 during the treatment cycle enters the left air inlet 258 and is directed down the left arm portion 212 of the hanger 200 and through the left air outlet 257 positioned above the left sleeve of the article 206. The left cuff clip 232 partially seals the left sleeve and restricts the air directed into left sleeve by the rear air guide 250 from exiting the sleeve via the cuff, causing the left sleeve to inflate. The air blown by the air blowers 152 during the treatment cycle and received by the right air inlet 256 is directed down the right arm portion 214 of the hanger 200 and through the right air outlet 255 positioned above the right sleeve of the shirt 206. The right cuff clip 234 that partially seals the right sleeve and restricts the flow of air directed into right sleeve by the rear air guide 250 from exiting the right sleeve via the cuff, causing the right sleeve to inflate. In this way the sleeves of the shirt 206 may be inflated and/or dried by the air from the air blowers.

Inflation of the sleeves and body of the shirt applies a radial force to the material of the sleeves and body, applying pressure from the inside of the sleeve and body pressing out, and generating hoop stress in the fabric of the sleeve and body. This causes the material of the sleeve and body to become taut and thus aiding in smoothing process of the shirt.

In particular, the radial expansion of the sleeve and body and the hoop stress generated in the sleeve and body by the trapped air aids in the removal of creases running along the length of the sleeve. At least some air escapes the garment through the pores in the fabric of the sleeves. The closure of the cuffs and hem forces more air than would otherwise would be the case to escape through the shirt material itself, thus aiding in smoothing the shirt. As will be appreciated, by introducing air inside a garment having airflow through its openings restricted, an improved smoothing process may be provided.

Furthermore, the tension created in the sleeve by the downwards force exerted by the right and left cuff clips, 234 and 232, aids in the removal of creases that follow a path around the perimeter of the sleeve. The force of the air down the sleeve and the pressure caused by the restricted opening may also contribute to this downward force.

Additionally, as will be described later on, a steaming head or steamer heads of the automatic ironing apparatus may engage with the shirt during the treatment process. The steaming heads push into the shirt from the back, at a vertical position roughly in line with the sleeve openings, thereby creating a partial seal of the sleeve opening that restricts the movement of air up and out of the sleeves undergoing treatment.

Figure 3D:
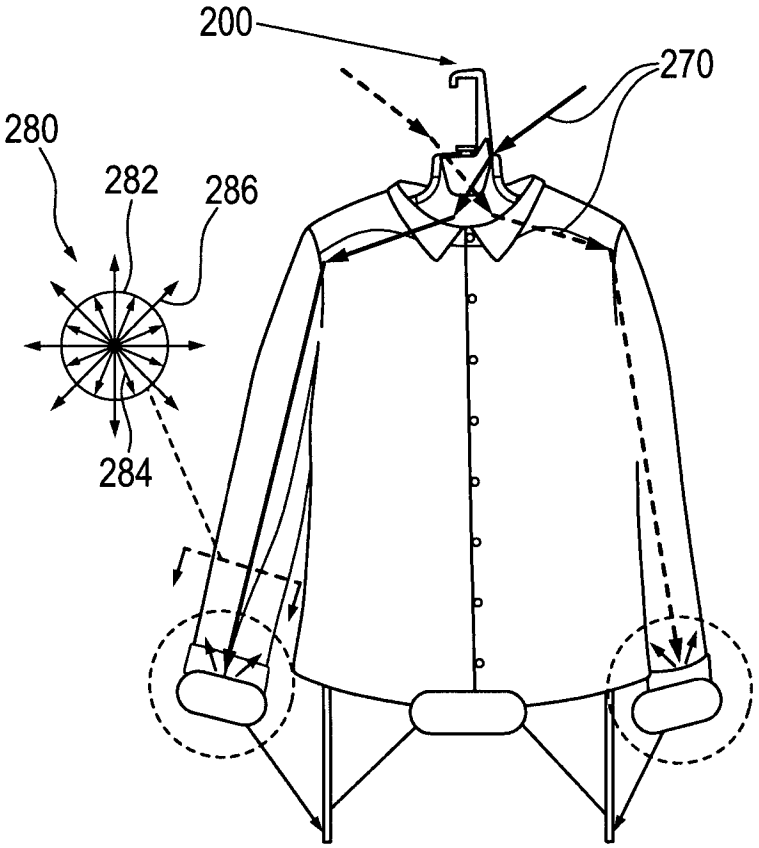
FIG. 3D shows air flow pathways through the hanger of FIG. 2A and a supported article, the inset of FIG. 3D shows a cross-section of part of the sleeve of the article.

FIG. 3D shows the apparatus of FIG. 2B and described above in such a treatment position. The directional arrows 270 indicating the path that the air from the air blowers of the apparatus 100 takes through the internal air conduit 250 of the hanger 200.

In the example air flows shown in FIG. 3D, for treatment of the left and right sleeves, the air from the air blowers of the apparatus 100 enters the internal air conduit 250 through the left and right air inlets, 258 and 256, of the hanger. The air travels down the inside of the hanger, through the right and left sections 258 and 256, and is expelled through the right and left air outlets, 255 and 257, into the right and left sleeves of the shirt.

The inset 280 of FIG. 3D shows a cross-section of a part of the sleeve with boundary 282. The dashed line across the sleeve of the shirt in FIG. 3D indicating the point at which the cross-section is taken.

The inset 280 shows forces depicted by force arrows 284 extending outwardly from the centre of the sleeve cross-section to the boundary 282. The forces are created by the build-up of air in the sleeve and exert a radial pressure on the material of the sleeve. Inset 280 also shows the during treatment air can escape through the pores of the sleeves of the shirt as shown by the air flow arrows 284 extending from the centre of the sleeve beyond the boundary 282 of the sleeve.

FIG. 3D has been described with reference to the internal air conduit 250 of the hanger 200. It will be appreciated that the steam treatment of the sleeves by the steam distribution system 260 described below will have similar flow pathways. Furthermore, the steaming of the sleeves will create similar forces on the sleeve to those shown in the inset of FIG. 3D.

A third treatment position of the hanger 200 aligns or connects the right and/or left steam inlets, 264 and 262, of the centre portion 210 with a steam outlet or steam outlets of the apparatus 100. During treatment the left and right steam inlets, 262 and 264, receive steam from the steam outlets of the apparatus 100. Once the hanger 200 and supported article 206 are this third treatment position the steam outlets of the apparatus 100 active a specific treatment cycle, turning on and off a supply of steam to the right and left steam inlets, 264 and 262, of the hanger. The treatment cycle may provide steam to the right and left steam inlets simultaneously or at different times during the treatment cycle. The duration of time that steam is provided to the right and left steam inlets may vary or it may be the same.

The steam provided by the steam outlets of the apparatus and received by the right steam inlet 264 flows down the right tubing of the steam distribution system and is expelled into the right sleeve of the supported shirt 200.

The right cuff clip 234 partially seals the right sleeve and restricts the steam expelled from the steam outlet of the right tubing into the right sleeve from exiting the right sleeve via the cuff, causing the right sleeve to inflate and be treated by the steam (as previously described for the air).

The steam escapes through the pores in the fabric of the sleeve of the shirt. The steam provided by the steam outlets of the apparatus and received by the left steam inlet 262 flows down the left tubing of the steam distribution system 260 and is expelled into the left sleeve of the supported shirt.

The left cuff clip partially seals the left sleeve and restricts the steam expelled from the steam outlet of the left tubing into the left sleeve from exiting the left sleeve via the cuff, causing the left sleeve to inflate and be treated by the steam. The steam escapes through the pores in the fabric of the sleeve of the shirt.

The supported shirt 206 may be moved to the treatment positions and treatment of the shirt 206 be performed in any order, for example steam may be applied to the right sleeve of the shirt, the hanger 200 may then move such that hot air may then be applied to the right sleeve thereby drying the right sleeve, after which the hanger 200 may then move to a treatment position such that steam may be applied to the left sleeve followed by the movement of the hanger to a treatment position in which hot air may be applied to the left sleeve.

Other treatment positions may use the venting pathways in combination—for example a single position may align the steam outlets of the apparatus 100 with the steam inlets of the central portion 210 of the hanger 200 and in the same position the front air guide may be aligned with the air blowers of the apparatus, or for example a single position may be provided where all venting pathways are aligned with the apparatus and are able to be utilised.

There may also be treatment positions where the venting pathways of the hanger are not utilised, and the shirt or parts of the shirt are treated directly by the air blowers 152 and/or steam outlets of the apparatus 100. For example, the hanger may be positioned in the apparatus such that the steam outlets and/or the air blowers of the apparatus direct steam and air directly into the neck hole of the shirt and not via the front air guide 240 of the hanger 200.

On completion of the treatment of the shirt 206, which may involve several treatment positions and treatment cycles, the doors on the opposite side of the apparatus 100 to which the hanger 200 entered open, and the hanger 200 is conveyed by and along the support rail 108 to the outside of the apparatus 100 ready for removal from the support rail 108 by a user. Both the entry and exit doors of the apparatus 100 close leaving the treatment chamber empty and ready to repeat the above describe process for the next hanger 200 and associated supported article on the support rail 108. The user removes the hanger from the support rail of the apparatus and recovers the now treated shirt from the hanger by unclipping the clips and removing it from the hanger.

Optionally, the hanger comprises a rack and pinion mechanism 216 located in the centre portion 210 of the hanger and being connected to both the left 212 and right 214 arm portions.

The rack and pinion mechanism 216 is operable to change the profile of the left 212 and/or right 214 arm portions of the hanger 200 and therefore the rack and pinion mechanism is operable to change the width of the hanger 200 such that it may be adjusted so that it supports articles of different sizes.

Specifically, in use the width of the hanger 200 can be adjusted using the rack and pinion mechanism 218 such that the left and right outlets 255, 257 of the internal fluid conduit 250 are positioned over the left and right sleeves of a supported shirt 206. This may allow the hanger to be adapted for differently sized garments.

The rack and pinion mechanism 216 comprises a dial 216A located on the top of the central portion 210 to allow the user to adjust the width of the hanger. The dial 216A is attached to a shaft 216B which extends through the central portion 210 to a pinion 216B provided proximate the bottom surface of the interior of the central portion 210. The pinion 210 engages with a rack provided on the interior of the arm 212, 214 (which are movable relative to the central portion 210) to allow adjustment of the width of the hanger.

The rack and pinion mechanism is also used to adjust the distance between the left and right leg portions of the hanger. As such, in use, the distance between the left and right leg portions may be adjusted such that the left and right leg portions are in close proximity of the inside surfaces of a supported garment, for example the side seams of a shirt, so that when during treatment tension is applied to the garment the fabric of the garment becomes taut across the left and right leg portions of the hanger—and that the tension applied need only be low to make the shirt become taut.

Trouser Clips

Figure 4C:
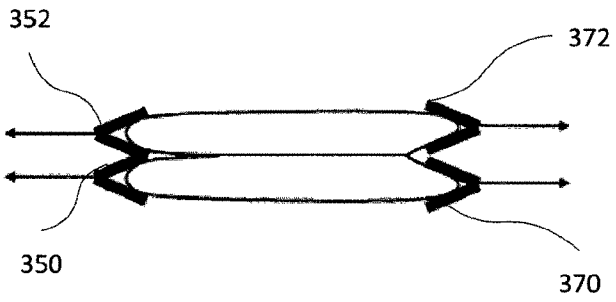
FIG. 4C shows a top-down view of the clipping system for suspending smart trousers for treatment.
Figure 4B:
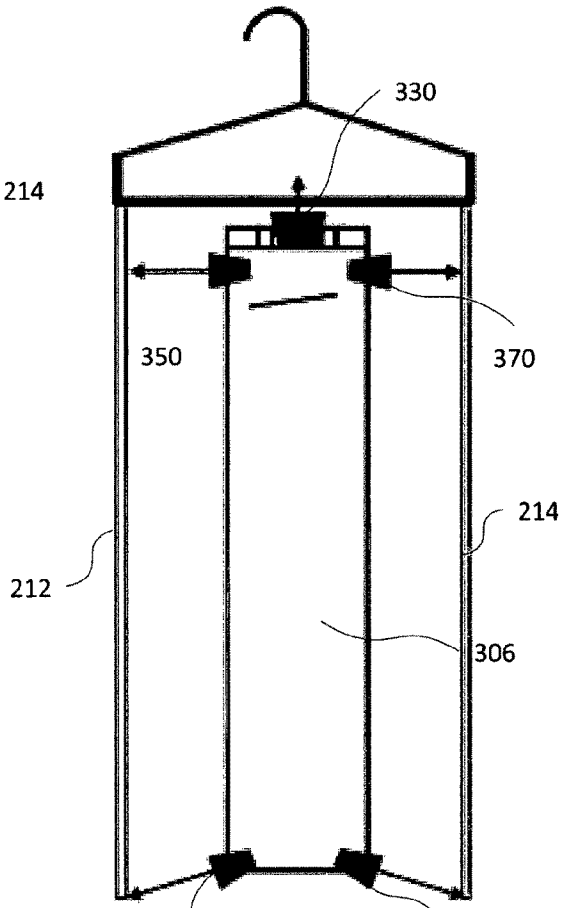
FIG. 4B shows a clipping system for suspending smart trousers for treatment.
Figure 4A:
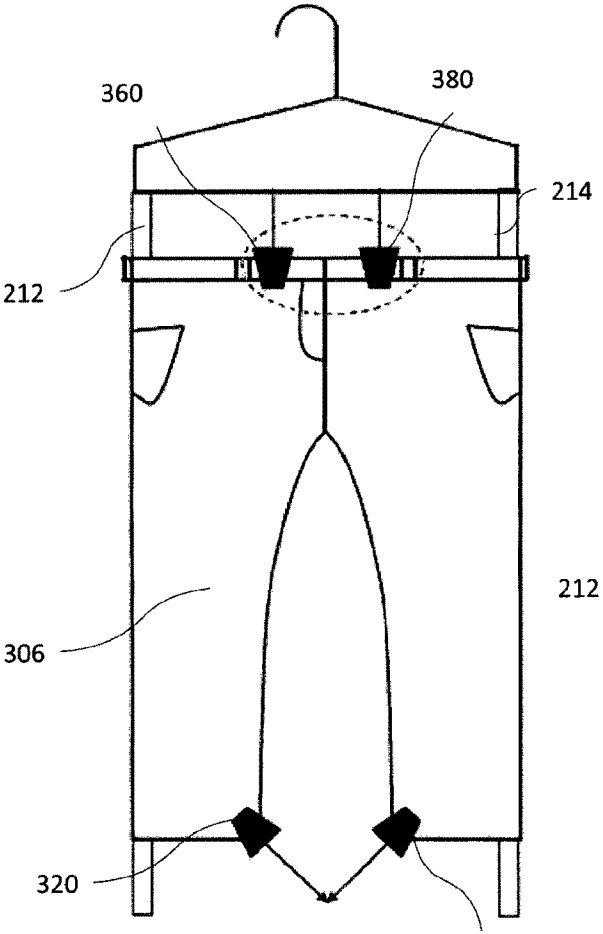
FIG. 4A shows a clipping system for suspending trousers for treatment.

An additional or alternative clipping system to that described above and shown in FIG. 2 is shown in FIG. 4. The clipping system of FIG. 4A is used to secure articles 306 for treatment in apparatus, in particular trousers or other articles of substantially the same shape as trousers.

The clipping system may be used in the hanger described above, with the hanger system described later in this application and in general with any system for supporting an article for treatment by an automatic ironing apparatus 100.

FIG. 4A shows a pair of trousers 306 supported by hanger 200. Inserted into each leg of the trousers is a leg section of the hanger 200. The leg sections 212 and 214 enter the trousers through the waist hole of the trousers and exit out of the bottoms of the right and leg trouser leg. The leg portions of the hanger 200 are spaced, through adjustment of the rack and pinion mechanism 216 so as to pull the trousers 306 taut.

The clipping system comprises two hem clips; a right 320 and left 340 hem clip for clipping respective left and right hems. The right hem clip is attached to the base of the left leg portion via an elasticated cord and the left hem clip is attached to the base of the right leg portion via an elasticated cord. That is, the clips cross-over each other diagonally so as to tension the trousers appropriately. In addition, the clipping system has at least one waist clip, in this example the clipping system has two waist clips 360 and 380 fixed to and extending down from the hanger, for example from the right, central or left portions of the hanger. The waist clips may comprise elasticated cords, or instead may be rigid clips (which may be capable of pivoting).

In use, a pair of trousers 306 may be suspended in the hanger by the clipping system. In this case the trousers are suspended such that front and back of the trousers extends across the hanger 200 between the leg portions 212 and 214 of the hanger. The left leg portion 212 of the hanger is positioned inside the left leg of the trousers 306 and the right leg portion 214 of the hanger is positioned inside the right leg of the trousers.

The two waist clips 360 and 380 are attached to the waist of the trousers 306 securing the front and back of the trousers together. The waist clips, 360 and 380, allow horizontal movement of the trousers sideways in the plane of the leg portions and movement of the material of the trousers into and out of this plane. However, the waist clips restrict movement of the trousers 306 in the vertical direction.

The two hem clips 320 and 340 are each attached to the bottom hem of the inner seams of a trouser leg. The hem clips 320 and 340 pull by virtue of the elasticated cords the bottom hem of the respective trouser leg downwards and towards the centre of the article 306.

When attached to the supported trousers 306 the two hem clips 320 and 340 permit movement of the trousers in the sideways direction and in the vertical direction. However, the hem clips 320 and 340 restrict movement of the trousers 306 into and out of the plane defined by the leg portions of the hanger.

In such a way a pair of trousers 306 may be suspended by the clipping system in a position ready for treatment by an ironing apparatus and in particular the automatic ironing apparatus described in this application.

An alternative or additional clipping system is shown in FIG. 4B. The clipping system of FIG. 4B is used to secure articles for treatment in the apparatus such as particular trousers in which it is desirable to iron a crease into each of the trouser legs, for example formal trousers with ironed creases running down the front and rear of the trouser legs.

The clipping system may be used in hanger 200 described above, with the hanger systems described later in this application and in general with any system for supporting an article for treatment by an automatic ironing apparatus.

The clipping system of FIG. 4B comprises two hem clips 320 and 340 attached to the base of the left 212 and right 214 leg portions of the hanger 200 respectively. The clipping system also has at least one waist clip attached to the hanger 200 via elasticated cords and extending down from the hanger 200. In this example one waist clip 330 is used. In addition, the clipping system has at least two side clips 330 and 350, one of which is attached to one of the leg portions of the hanger and the other side clip is attached to the other leg portion of the hanger. The side clips each are attached to the respective leg portions via elasticated cords.

In use, a pair of trousers 306 may be suspended in the hanger by the clipping system. Before suspension by the clipping system the trousers for treatment are folded in half onto themselves such that the right and left trouser legs overlap with one another—i.e. there are folds down the front and back of each trouser leg corresponding to the location of the desired creases. The trousers 306 are suspended in the hanger in this folded position by the clipping system. The trousers are suspended between and substantially in the plane of the left and right leg portions 212 and 214 of the hanger 200. The waist clip 330 is attached to the waist of the folded trousers securing the folded sides of the trousers together. The side clips 330 and 370 are attached to the sides of the trousers, where the side clips hold the overlapping folded sides of the trousers together and further aid in the suspension of the trousers for treatment.

An additional two side clips, 352 and 372, may also be used as shown in FIG. 4C. One of the additional side clips 352 is attached to one of the leg portions (the left leg portion) of the hanger and the other additional side clip 372 is attached to the other leg portion (the right leg portion) of the hanger. The side clips, 350 and 370, and additional side clips, 352 and 372, are attached to the leg portions at a similar vertical position to the vertical position of the waist of the suspended trousers 306. In use, the four side clips are attached to the sides of the folder trousers at the waist region of the trousers.

The side clips are clipped to the trousers and each side clip holds together an individual fold of the trousers at the waist region. This is illustrated in top down view of the attached side clips shown in FIG. 4C. In this case, due to the manner in which the trousers are folded there are four folds which are held together by the clips at the waist.

FIG. 4C shows a top view of the suspended trousers with the four side clips attached. The hem clips 320 and 340 are clipped to the ankle cuffs of the folded trousers—that is, the bottom right and bottom left of the folded suspended trousers. Each of the hem clips hold together the bottom of the right and left trouser legs. The hem clips pull, via the respective elastic cords attaching them to the leg portions of the hanger, on the folded trousers in a downward and outward direction toward the bottom of the right and left leg portions, 212 and 214, of the hanger 200.

In such a way a pair of folded trousers 306 may be suspended by the clipping system in a position ready for treatment by an ironing apparatus and, in particular the automatic ironing apparatus described in this application.

The method of suspension may advantageously allow the ironing apparatus, whilst treating the trousers, to iron aesthetically desirable creases into the front and back of the suspended trousers' legs.

Steaming Head

A steaming head may be used to iron the support article, where the steaming head engages with the article from behind (i.e. from out of the page in FIG. 1).

Figure 5A:
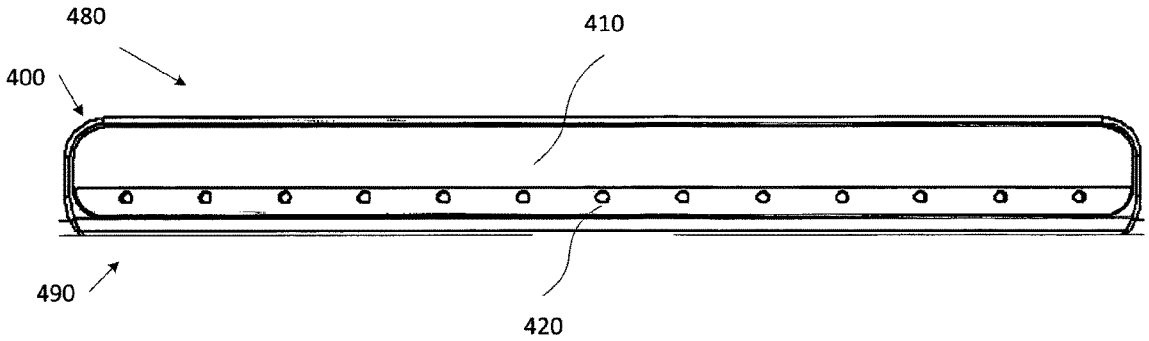
FIG. 5A shows a front view of a rigid steaming head for treating a garment.
Figure 5B:
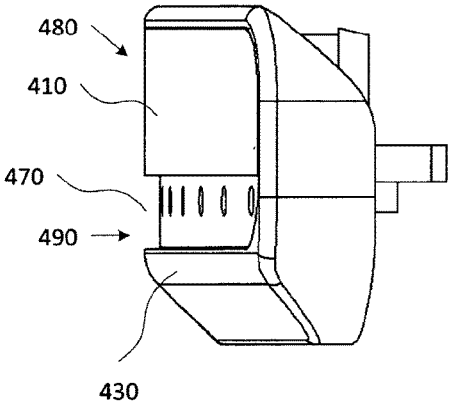
FIG. 5B shows a side view of the rigid steaming head shown in FIG. 5A.
Figure 5C:
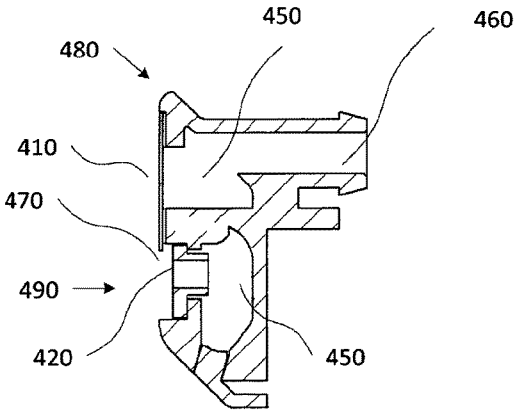
FIG. 5C shows a cross-sectional side view of the rigid steaming head shown in FIG. 5A.
Figure 5D:
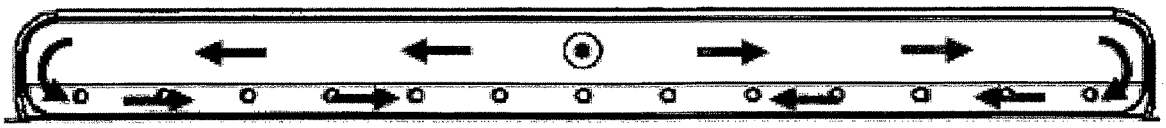
FIG. 5D shows the circulation of steam through the rigid steaming head shown in FIG. 5A.

FIG. 5A shows a front view of a rigid steaming head 400 that may be used in the apparatus 100 to smooth an article 106, FIG. 5B shows a side view of the rigid steaming head 400 and FIG. 5C shows a cross-sectional side view of the rigid steaming head 400.

At least one of the rigid steaming heads 400 may be arranged to form a flexible steaming head. The rigid steaming head 400 comprises an interior cavity 450, a steaming section 490 which releases fluid, for example steam or water vapour, from the interior cavity 450; and a pressing section 480 which is heated by fluid contained in the interior cavity 450 and may be arranged to press or smooth an article.

The steaming section 490 and pressing section 480 are configured to apply steam to the material of an article so as to relax the fibres of the material and press the material into an un-wrinkled shape.

The rigid steaming head 400 of FIG. 5A is substantially rectangular or elongated oblong in shape. The rigid steaming head 400 is curved wherein the degree of curvature of the steamer head 400 is selected to optimise the smoothing of an article.

The steaming section 490 of the rigid steaming head is in fluid and thermal contact with the interior cavity 450 of the steaming head 400. The pressing section 480 is in thermal contact with the interior cavity 450 and may also be in fluid contact with the interior cavity 450. An array of fluid outlets 420 is provided in the steaming section 490, where the array of fluid outlets 420 extends across the width of the front side of the steaming section 490.

The front side is the side of the rigid steaming head 400 that is arranged within the apparatus 100 to face the article 106 to be smoothed. The rear side of the rigid steaming head 400 is the side of the steaming head that is arranged in the apparatus 100 to face away from the article 106 to be smoothed.

Similarly, a forward and rearward direction may be defined wherein movement towards the article 106 to be smoothed/treated is the forward direction and movement away from the article 106 to be smoothed/treated is the rearward direction.

The fluid outlets 420 of the rigid steaming head 400 provide fluid communication between the interior cavity 450 and the exterior of the rigid steamer head 400 and in particular the exterior region in close proximity to the front face of the steaming section 490 of the rigid steaming head 400.

The pressing section 480 shown in FIGS. 5A to 5D comprises a pressing plate 410 extending across the front face of the pressing section 480. The pressing plate 410 is in thermal and fluid contact with the interior cavity 450 of the rigid steaming head 400. The pressing plate 410 is made from a thermally conductive and rigid material for example a metal such as stainless steel. An additional consideration for selecting the material for the pressing plate may also be the degree of oxidisation or corrosion that the material may experience in a humid environment.

In the example shown in FIGS. 5A to 5D the fluid outlets 420 of the steaming section are set back, in the rearward direction, from the front face of the pressing plate 410. The steaming section may in other examples be substantially in line with the front face of the pressing plate, that is to say the fluid outlets may not be set back in the rearward direction from the front face of the pressing plate.

The offsetting of the fluid outlets and the front face of the pressing plate 410 in the example shown in FIGS. 5A to 5D creates an exterior cavity 470 in front of the fluid outlets 420 which is partially enclosed by the pressing section 480 and the steaming section 490. The steaming section 490 may also further comprise a lip 430 which is offset from the fluid outlets 420 in the front direction and arranged to partially enclose the exterior cavity 470.

Steam released from the interior cavity 450 through the fluid outlets 420 of the steaming section collects in the exterior cavity 470 to produce a volume of substantially uniform steam across the width of and in front of the steaming section 490 of the rigid steaming head 400.

The interior cavity 450 of the steaming head 400 extends substantially across the length and width of the steamer head extending through both the steaming section 490 and pressing sections 480. The interior cavity 450 transports fluid, for example steam, to both the pressing section 480 and the steaming section 490 of the rigid steamer head 400. The interior cavity 450 is arranged to form a substantially circular path within the steamer head 400 so as to allow circulation of steam through the pressing section 480 and into the steaming section 490 of the rigid steaming head 400.

The fluid outlets 420 of the steaming section 490 allow fluid communication between the interior cavity 450 and the exterior of the steamer head and in particular exterior cavity 470. The pressing plate 410 of the pressing section partially encloses part of the interior cavity 450.

An aperture or fixture 460 is provided in the interior cavity 450 of the steaming head to allow fluid, which may be pressurised, to be introduced into the interior cavity 450.

Figures 13A, 13B, 13C, 13D:
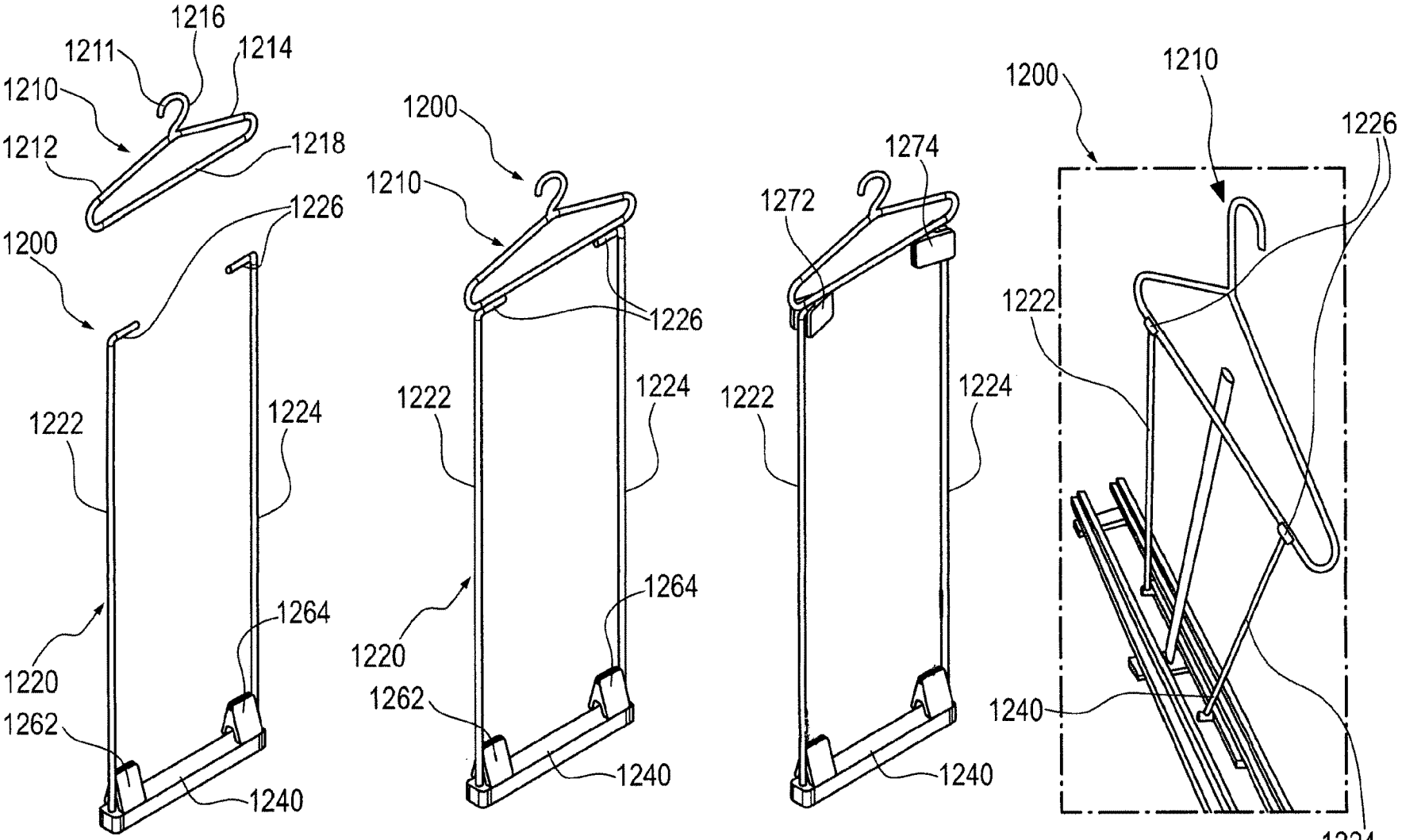
FIG. 13A shows a support system for supporting articles, with a detached detachable hanger and a frame, for use with an automatic ironing apparatus.
FIG. 13B shows the support system of FIG. 13A with the detachable hanger attached to the frame.
FIG. 13C shows the support system of FIG. 13A with the detachable hanger attached to the frame and with a set of removable clips attached to the frame.
FIG. 13D shows a photograph of a support system similar to that of FIG. 13A with the detachable hanger attached to the frame.

The aperture 460 for providing steam to the interior cavity 450 of the steamer head 400 is provided in the centre of the rear face of the pressing section. Steam or other fluid, introduced into the interior cavity 450 thereby flows through the pressing section 480 to the extremities of the steaming head and at the extremities, due to the circular nature of the interior cavity 450, the steam flows through into the steaming section 490 and back toward the centre of the rigid steaming head 400, as shown in FIG. 13D wherein the arrows show the flow of fluid through the interior cavity 450.

As the steam travels through the steaming section 490 it is expelled through the fluid outlets 420 into the exterior cavity 470. Other arrangements of the interior cavity 450 which transport fluid to the pressing section 480 and steaming section 490 are possible; for example the sections may be independently supplied with steam and there the interior cavity may comprise one or more interior cavities.

Figure 6A:
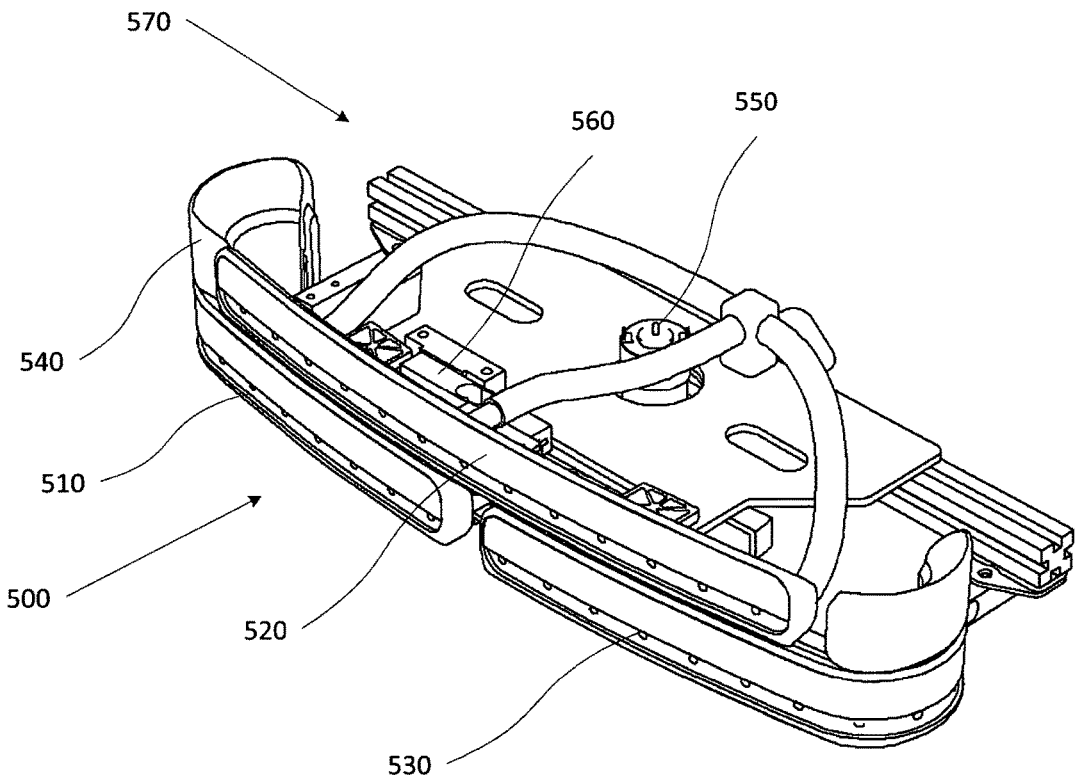
FIG. 6A shows a perspective view of a steaming assembly in a retracted configuration.

At least one of the rigid steaming heads 400 described above may be provided on a steaming assembly 570 so as to form a flexible steaming head 500 as shown in FIG. 6A.

When describing the steaming assembly 570 it is useful to do so in terms of three orthogonal axis x (longitudinal), y (lateral) and z (vertical) and circles C1 and C2 residing in the x,y plane and offset from one another in the vertical z direction. Wherein in use when the steaming assembly 570 is mounted in the apparatus 100 the x-axis depicts movement towards or away from the article, the y-axis describes the direction of movement across the article and the z-axis direction describes movement in the vertical direction. The curvature of circles C1 and C2 matches that of the rigid steaming heads 510, 520 and 530, for example if the rigid steaming head were moved along the circumference of C1 or C2 the profile of the steaming head would trace out the circle C1 or C2.

Figure 6B:
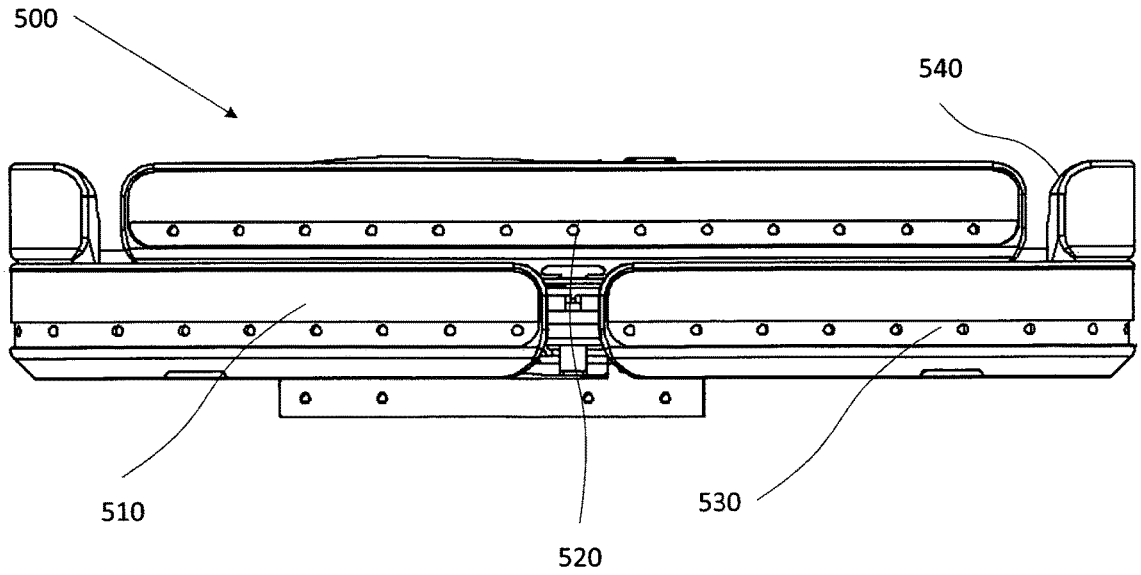
FIG. 6B shows a front on view of the steaming assembly of FIG. 6A.

The structure of the steaming assembly 570 shown in FIG. 6 will now be described in detail.

The steaming assembly 570 shown in FIG. 6 comprises a flexible steaming head 500 that comprises three rigid steamer heads 510, 520, and 530 as described above and shown in FIG. 6, a motor 550 and a force sensor 560.

The flexible steaming head 500 comprises a central steaming head 520, a right steaming head 530 and a left steaming head 510 for applying steam to and smoothing an article.

The left and right steaming heads 510, 530 are provided on the circumference of the circle C1 with the curvature of the rigid steaming heads aligned with that of the C1. The central steaming head 520 is vertically offset along the z-axis from the left and right steaming heads and is provided on the circumference of the circle C2 with the curvature of the rigid steaming head aligned with that of the C2.

The rigid steaming heads of the flexible steaming head 500 may be moved independently of one another, and relative to one another by the motor 550 of the steaming assembly 570.

The rigid steaming heads may be moved along the circumference of C1 or C2. The curvature of C1 and C2 may be sufficiently small that movement of the rigid steamer heads along C1 and C2 is substantially like movement of the steaming heads along the y-axis i.e. in the direction parallel to the article to be smoothed. Movement of the rigid steaming heads along the y-axis direction is also envisaged.

Figure 7A:
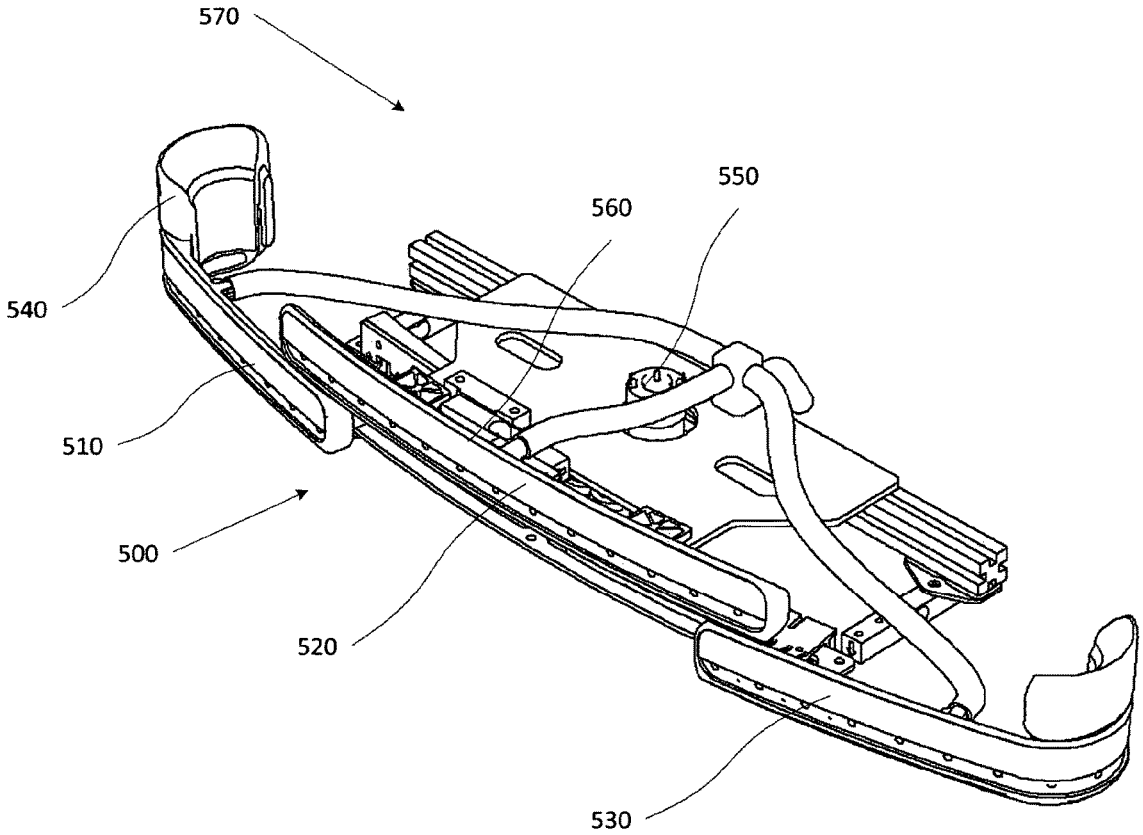
FIG. 7A shows a perspective view of the steaming assembly of FIG. 6A in an extended configuration.
Figure 7B:
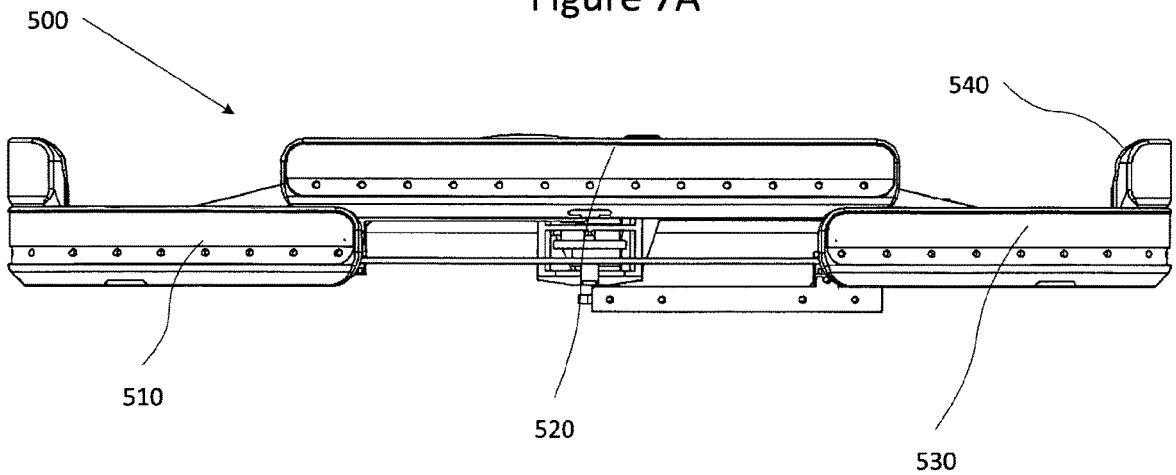
FIG. 7B shows a front on view of the steaming assembly of FIG. 6A in an extended configuration.

Typically, the rigid steaming heads 510, 520 and 530 are moved from a retracted configuration to an extended configuration or vice versa. FIG. 6 shows the steaming assembly 570 in which the rigid steaming heads are in the retracted configuration and FIG. 7 shows the steaming assembly 570 with the rigid steaming heads in the extended configuration.

Movement of the rigid steaming heads between these configurations is controlled by a motor 550 positioned on the steaming assembly 570.

Movement of the rigid steamer heads between the retracted and extended configurations may be performed in a continuous or stepped manner and the steaming heads may be stopped or chosen to be positioned at any intermediate position between these two configurations.

For the configuration of rigid steaming heads shown in FIG. 6 and FIG. 7 the right 530 and left 510 rigid steaming heads are driven by the motor 550, the central steaming head 520 is not driven by the motor 550.

In the retracted configuration shown in FIG. 6, the left 510 and right 530 rigid steaming heads are positioned in close proximity to one another and the central steamer head 520 is offset from the left and right steamer heads along the vertical z-axis.

In the retracted configuration there is substantial overlap in the y-axis between the left 510 and right 530 steaming heads and the central steamer head 520.

In the extended configuration the left 510 and right 530 steaming heads are positioned at a distance, substantially along the y-axis, away from one another.

The left 510 and right 530 steaming heads are moved away from one another along the circumference of the circle C1. The position of the central steaming head 520 of the steaming assembly 570 in the extended configuration remains unchanged from the retracted configuration.

Whilst the central steaming head 520 remains vertically offset from the left and right steaming heads, 510 and 530, the degree of overlap of the left and right steaming heads, 510 and 530, with the central steaming head 520 in the y-axis is substantially reduced and the profile of the flexible steaming head 500 is increased in the y-axis direction.

A plurality of force sensors 560 are provided on the steaming assembly 570, the force sensors 560 measure the force applied to the front face of the steaming head(s) and may comprise a computing device either provided on the steaming assembly or provided externally to it.

In use, the force is applied to the front face of the rigid steaming head(s) by an article, the force exerted on the steaming head(s) is dependent on the tension of the article.

The force measured by the plurality of force sensors 560 is used in determining the position of the rigid steaming head(s) and\or the position of the steaming assembly 500.

In particular, the force measurement may be used to determine a desirable position of the rigid steaming heads in the x-axis and y-axis directions and the position of the steaming assembly 500 in the x-axis direction.

The rigid steaming heads 510 and 530 may comprise a shoulder section 540 that extends the profile of the rigid steamer head 510 and 530 in the vertical z direction. The height of the shoulder section 540 is chosen so as to ensure that tension exerted by the rigid steaming heads of the flexible steaming head 300 on an article is achieved across the full height, the profile in the z-direction, of the flexible steaming head in all positions of the steamer heads 510 and 530, but in particular in when the steaming head are in the extended configuration shown in FIG. 7.

The end of the steamer head 400 and the shoulder section 540 may be further curved at a curvature that differs from the rest of the steaming head 400, this curvature may be selected so as to ensure tension is achieved across the article. This can be seen in FIGS. 6 and 7 wherein the end of the left steamer head 510 and the end of the right steaming head 530 are curved.

The operation of the flexible steaming head and steaming assembly 570 will now be described in more detail.

The steaming assembly 570 may be mounted into a smoothing unit.

The smoothing unit comprises the steaming assembly 570 and a horizontal actuator, the steaming assembly being mounted on the horizontal actuator and configured such that the horizontal actuator enables translation of the steaming assembly along the x-axis.

In particular, the horizontal actuator facilitates movement of the steaming assembly towards or away from an article to be smoothed i.e. in the forward and rearward direction along the x-axis.

The smoothing unit is mounted on a vertical track 118 within the apparatus 100 and configured such that the smoothing unit may be driven to different vertical positions in the apparatus and along the vertical track 118.

In this example however, the smoothing unit is mounted on the vertical track 118 such that the front faces of the steaming heads 510, 520 and 530 are arranged to lie in the y,z plane which in use is parallel to the article 106 to be smoothed, thereby maximising the area of the front face of the rigid steaming heads 500 that may be used to smooth and steam the article.

The fluid inlets 560 of the rigid steaming heads, 510, 520 and 530 are connected to a fluid reservoir of the apparatus capable of providing fluid to the steaming heads at a variable flow rate, variable pressure and variable temperature.

A computerised control unit and/or processor housed in the apparatus 100 controls the movement of the smoothing unit and the various parts of the smoothing unit.

For example, the control unit controls the vertical movement of the smoothing unit along the track, the translation in the x-direction by the horizontal actuator of the steaming assembly, and the movement of the steamer heads 510,520, 530 along C1 and C2 or along the y-axis direction.

In addition, the computerised control unit receives and processes information from the plurality of force sensors 560 and also controls the flow, temperature and pressure of the fluid from the fluid reservoir to the steamer heads 510,520,530.

The force information received and processed by the control unit is used to determine the desired position of the smoothing unit and/or steaming heads, and/or the control of the flow, temperature and pressure of the fluid provided from the fluid reservoir to the steaming heads.

The control unit can also use preprogramed routines to dictate the movement of the smoothing unit and the steaming heads as well as the control of the flow, temperature and/or pressure of the fluid provided to the steaming heads.

For example, different articles of clothing may have different preferred routines particularly in terms of temperature and pressure of the fluid but also pressure applied to the article by the steaming heads.

A combination of preprogramed routines and active control is also possible. The control unit/processor may receive instruction from a user via a user interface. The computerised control unit may of course be used in conjunction with other flexible steaming heads.

Motion of the Sides of the Steamer Head

Figures 8A, 8B, 8C:
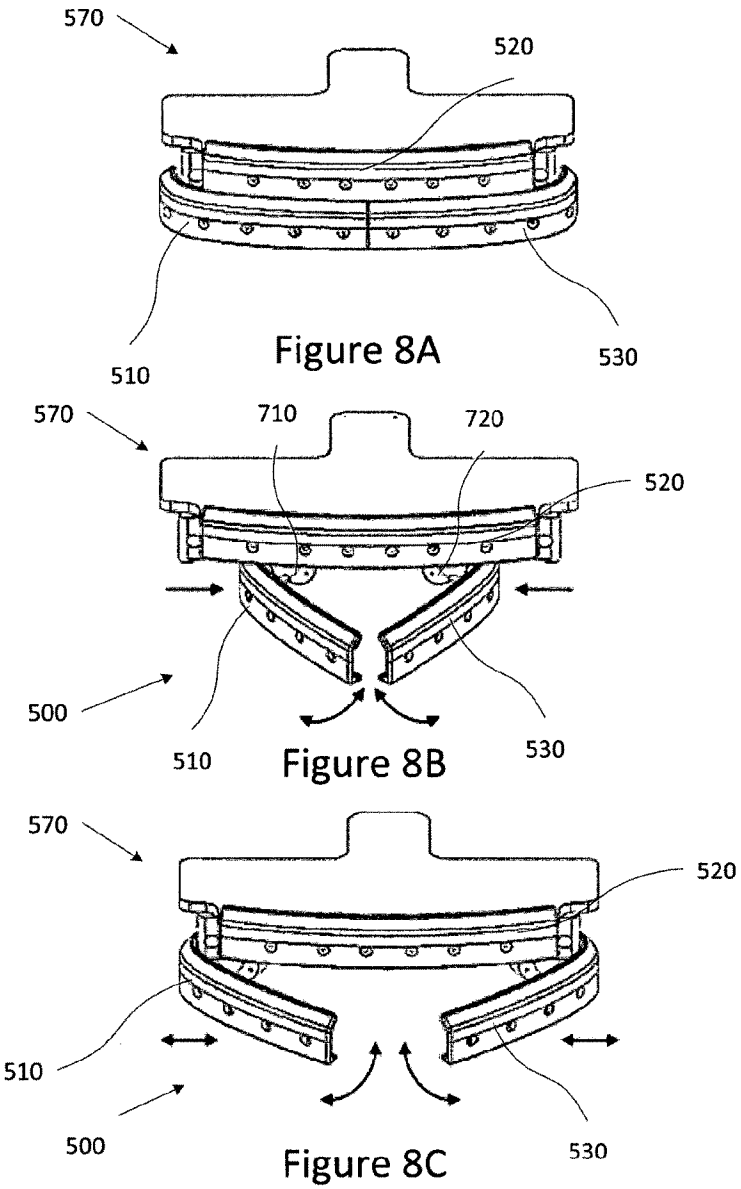
FIG. 8A shows a front view of a steaming assembly.
FIG. 8B shows the steaming assembly of FIG. 8A with left and right rigid steaming heads extended outwardly and translated inwardly.
FIG. 8C shows the steaming assembly of FIG. 8A with left and right rigid steaming heads extended and translated outwardly.

In the example steaming head shown in FIGS. 8A-C the left and right rigid steaming heads of the steaming assembly have an additional direction of movement when compared to the example described above and shown in FIGS. 6A-B and 7A-B. The additional range of movement available to the rigid steaming heads is shown in FIGS. 8A-C.

The left and right rigid steaming heads, 510 and 530, of the steaming assembly 570 are, in addition to being translatable along C1 and/or along the y-axis direction, pivotable outward from the centre of the steaming assembly—thereby changing the depth-profile of the flexible steaming head.

A central plane of the steaming assembly 570 may be defined as the xz plane bisecting the midpoint between the left 510 and right 530 rigid steaming heads when the flexible steaming head 500 is in the retracted configuration described above.

In more detail the left and right steaming heads, 510 and 530, are attached to a movement rail or a scissor mechanism of the steaming assembly 570 via rotatable connections with pivot points 710 and 720.

An angle of rotation is the angle that the front face of the rigid steamer head makes with the yz plane, i.e. when the rigid steamer head lies in the yz plane in the retracted configuration the angle of rotation is zero.

The rotatable connection connecting the left rigid steaming head 510 to the frame is positioned toward the end of the left side head in a direction away from the centre plane of the steaming assembly 570 along the y-axis, thereby allowing the non-pivot end of the left rigid steamer head to be open outward toward a supported article, increasing the angle of rotation of the left rigid steamer head. The left steamer head is rotatable out of the yz plane toward the xz plane or vice versa. A piston positioned on the steaming assembly 570 is connected to the left steaming head to control movement of the non-pivot end of the left steaming head 510 about the pivot point 710 from the yz plane toward the xz plane and vice versa. Alternatively, a geared motor positioned at the pivot point of the left rigid steaming head may be used to control movement of the steamer head about the pivot.

Similarly, the pivot point of the right steaming head to the steaming assembly is positioned toward the end of the right steaming head away from the centre of the steaming assembly thereby providing rotational movement of the non-pivot end of the right side head, the non-pivot end being the end closest to the centre plane along the y-axis direction, to open outward from the centre of the steaming assembly toward a supported article. The right steaming head 530 is rotatable out of the yz plane toward the xz plane.

A piston positioned on the steaming assembly 570 is connected to the right rigid steaming head 530 to control movement of the non-pivot end of the right steaming head about the point of rotation from the yz plane toward the xz plane and vice versa. Alternatively, a geared motor positioned at the pivot point of the right rigid steaming head may be used to control movement of the steamer head about the pivot point. The profile of the left and right rigid steaming heads and the y-axis define an angle of rotation.

Movement of the left and right steaming heads from the yz plane toward the xz plane and vice versa advantageously allows supported articles of different shapes to be treated by the flexible steamer head. In particular, such movement is advantageous for the treatment of trousers or similarly shaped articles—a treatment position wherein the left and right heads are rotated such that they are angled between the yz and xz planes is effective for the treatment of the crotch area of trousers.

The pivot point of the left and right steaming heads may be translatable along a movement rail of the steaming assembly extending in the y-axis direction of the steaming assembly, such that when a non-pivot end of the left and right rigid steaming heads is actuated from the yz plane toward the xz plane the pivot point translates along the movement rail toward the central plane of the steaming assembly.

This movement of the left and right steaming heads may be alternatively or additionally be achieved through the use of a scissor mechanism to which the left and right steaming heads are attached and the steaming assembly may actuate/control. When a non-pivot end of the left or right steaming heads, 510 and 530, is actuated toward the yz plane, the pivot points 710 and 730, and therefore the pivoted end of the side heads translate along the movement rail along the y-axis direction away from the central plane of the steaming assembly 570.

The translation of the pivot points, 710 and 730, along the movement rail allows the left and right rigid steaming heads, 510 and 530, to access areas of supported articles that may be otherwise inaccessible. For example, translation of the pivot points can be used to form the left and right steaming heads into a triangular shape suitable for the treatment of a crotch area of trousers and capable of generating the required tension in the crotch region for treatment.

Translation of the right and left steaming heads 510 and 530, independent of the actuation of the non-pivot end toward or away from the xz plane, along the y-axis direction may be achieved by the movement of the pivot points of the left and right steaming heads along the movement rail. The left and right steaming heads 510 and 530 are attached to the movement rail via the pivot points 710 and 730 and the movement rail are attached to the steaming assembly 570.

It will be appreciated that the steaming assembly 570 of FIG. 8 retains the functionality of steaming assembly 570 of FIGS. 4,5 and 6 described above in detail.

In addition, the steaming assembly 570 of FIG. 8 may be used in apparatus in a similar manner to the steaming assembly 570 of FIG. 5, 6 or 7.

For example, the steaming assembly 570 may be mounted onto the smoothing unit and into apparatus 100 in a similar manner to that described above.

Trouser Treatment by Steaming Head

The operation of the steaming assembly 570 shown in FIGS. 8A-C and described above in the apparatus will now be described in detail.

In the example treatment shown in FIGS. 9A-D and described below the supported article 806 for treatment is a pair of trousers, the treatment method below may also be applicable to other types of article and in particular those articles with a similar shape to trousers.

A pair of trousers 806 are secured inside apparatus 100. The trousers are secured inside the apparatus by a hanger (not shown) such that they are held in tension with the front or back of the trousers facing and substantially parallel to the flexible steaming heads of the smoothing unit. The trousers may be secured by the previously described clipping scheme.

The trousers may be loaded onto the hanger in a manner similar to that described elsewhere in this application.

In this example, the trousers are clipped to the hanger by the waist. Two trousers clips attach to the bottom of the inner seam of the left and the right trouser leg pulling the trousers downward and towards the centre of the hanger. Two leg portions of the hanger run down the inside of the trousers In such a manner the pair of trousers may be pulled taut and secured within the apparatus ready for treatment by the smoothing apparatus and the flexible steaming heads. A hanger having similar features as these and suitable for use with trousers and shirts is described in detail elsewhere in this application.

During treatment the leg portions of the hanger are secured by flaps extending from the base of the treatment chamber of the automatic ironing apparatus.

A user starts the smoothing operation of the apparatus. The doors of the apparatus 100 close, enclosing the trousers within the treatment chamber.

The smoothing unit is driven to a vertical start position along the vertical track 118.

The smoothing unit is mounted on the vertical track such that the front faces of the rigid steaming heads face the article 106 to be smoothed.

For the purposes of this example, treatment of the trousers is broken down into four different treatment regions: the waist 810 (FIG. 9A), the crotch 820 (FIG. 9B), the upper leg 830 (FIG. 9C) and the lower leg 840 (FIG. 9D) regions of the supported trousers. The shape of the flexible steaming head 500 is modified such that it is different for each of the treatment regions. That is, for each different treatment region of the trousers the right and left rigid steaming heads, 510 and 530, of the flexible steaming head 500 are moved to different positions. At each different treatment position the flaps 116 of the apparatus 100 may be deployed to secure the leg portions of the hanger for treatment or the support system supporting the article is secured in place through another mechanism.

As mentioned above, the steaming assembly 570 begins the treatment process at the waist region 810 of the trousers 806 in the retracted configuration. In this example, the vertical start position of the smoothing unit aligns the flexible steaming head 500 with a waist region 810 of the supported trousers 806.

At the start of the smoothing process the rigid steaming heads 510, 520, 530 of the flexible steaming head 500 are in the retracted configuration. The left 510 and right 530 rigid steaming heads are positioned in close proximity to one another and the central steaming head 520 is offset from the left and right steaming heads along the vertical z-axis.

The profile of the left, right and central steaming head, 510,530 and 520, all lying in the same yz plane such that there is substantial overlap in the y-axis between the left 510 and right 530 steaming heads and the central steamer head 520. Once in the desired vertical position the horizontal actuator moves the steaming assembly 570 toward the trousers 806 to be smoothed along the x-axis.

As a result of the movement of the steaming assembly 570 toward the trousers 806 the front faces of the pressing plates of the rigid steaming heads, 510, 520 and 530, of the flexible steaming head 500 contact the waist region 810 or a portion of the waist region of the trousers 806.

Contact of the rigid steaming heads, 510,520 and 530, with the waist region of the trousers causes a force which is dependent on the tension of the waist section of the trousers, to be exerted on the front faces of the rigid steaming heads and a force measurement to be registered on the force sensors 560 of the rigid steaming heads. The force measurement is representative of the tension applied to the trousers by the rigid steaming heads 510, 520, 530.

The force measurement of the force sensors 560 being one of the factors used to determine the position of the steaming assembly—the force measurement having particular importance to the position of the steaming assembly along the x-axis.

Different positions of the steaming assembly 570 apply different magnitudes of force to the article 806. Both the vertical and the longitudinal positions of the steaming assembly 570 may be varied so as to achieve a desired tension across the trousers. The desired tension may be dependent on a number of factors for example the material of the article, the size of the article or a user selected parameter.

Once the steaming assembly 570 is in a desired position along the x-axis the smoothing unit moves along the vertical track and progresses the steaming assembly in a downward direction across the waist region of the trousers.

During treatment, as the steaming assembly 570 is progressed vertically across the trousers 806, steam is introduced into the interior cavities 550 of the rigid steaming heads from the apparatus 100 and circulates through the smoothing section 580 into the steaming section 590 of the rigid steaming heads where it is expelled through the array of fluid outlets 520 and into the exterior cavity 570 of the rigid steaming heads at least partially enclosed by the pressing plate 510 of the pressing section 580 and the steaming section 590.

Steam expelled through the fluid outlets 520 of the rigid steaming heads collects in the exterior cavity 570 of each of the rigid steaming heads, 510, 520 and 530, and produces a thin cushion of uniform steam across the width of trousers 806.

As steam flows through the pressing section 580 the pressing plates 510 of the rigid steaming heads are heated through direct contact with the steam causing, through thermal conduction, the outer surface of the pressing plate 510 that is in contact with trousers 806 to be heated and become hot. The temperature that the pressing plate 510 is heated to would typically be in a range of 80° C. to 100° C. However, it will be appreciated that the pressing plate 510 may also operate outside of this temperate range. In an example, a heating element may be incorporated into the rigid steaming heads to increase the range of temperatures.

In such a manner, the flexible steaming head 500 applies steam to the material of the trousers 806 to relax the fibres and the flexible steaming head presses the material of the trousers into an un-wrinkled shape with the hot pressing plates of the rigid steaming heads.

As the smoothing unit progresses across the article 806 the shape of the steaming assembly 570, in particular the flexible steaming head 500 is changed to achieve a better treatment of the article, for example the shape and/or profile of the steaming assembly 570 may be changed so that the arrangement of the flexible steaming heads 500 conforms with the shape of the article 806 or changes of shape of the supported article 806.

In the present example, where the supported article 806 is a pair of trousers, as the steaming assembly 570 progresses across the article in the vertical direction the shape of the part of the trousers that the steaming assembly is in contact with will change.

The smoothing assembly progresses the steaming assembly down the waist region 810 of the trousers. The flexible steaming head 500 applies pressure, creating tension in the supported article, steams and applies heat to the waist region of the trousers.

When the steaming assembly 570 is progressed by the smoothing assembly onto the crotch region 820 of the trousers 806 the shape of the flexible steaming head 500 is changed to accommodate the change in the shape in the article 806 so as to enable the required tension to be achieved and/or maintained.

Figure 9A:
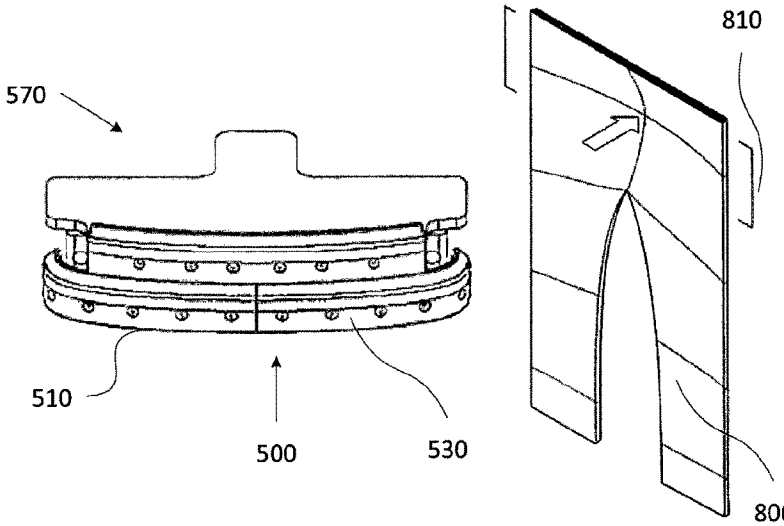
FIG. 9A shows the steaming assembly of FIG. 8A in a configuration for the treatment of a waist region of a pair of trousers.
Figure 9B:
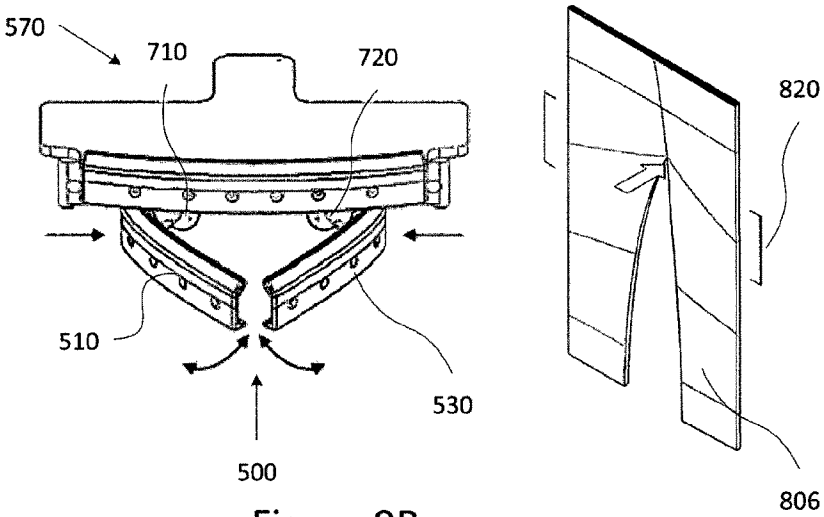
FIG. 9B shows the steaming assembly of FIG. 8A in a configuration for the treatment of a crotch region of a pair of trousers.

When the flexible steaming head 500 is coincident with the crotch region the shape of the flexible steaming head is changed into a generally triangular shape as shown in FIG. 9B. The piston attached to the left steaming head 510 extends rotating the non-fixed end of the left steaming head 510 from the yz plane toward the xz plane. The non-fixed end of the left steaming head rotating about the pivot point 710 toward the trousers 806. The extension of the piston attached to the left steaming head 510 causes the pivot point 710 and the fixed end of the left steaming head 510 to translate in y-axis direction along the movement rail toward the central plane of the steaming assembly 570. The piston attached to the right rigid steaming head 530 is also extended, rotating the non-fixed end of the right rigid steaming head 530, from the yz plane toward the xz plane. Alternatively, where geared motors are used at the pivot points, the geared motors may be utilised to rotate the left and/or right rigid steamer heads respectively in the manner described above.

The extension of the of the piston attached to the right steaming head causes the pivot point 720 and the fixed end of the right steaming head to translate in the y-axis direction along the movement rail toward the central plane of the steaming assembly 570. The left and right steaming heads 510 and 530 thereby protrude from the steaming assembly towards the trousers 806 and forming a substantially triangular shape.

The front faces of the left and right rigid steaming heads, 510 and 530, face outwardly from the triangle toward the crotch region 820 of the trousers 806. The shape formed by the left and right rigid steaming heads, 510 and 530, allows the left and right rigid steaming heads to be positioned into the crotch region 820 of the trousers by the smoothing apparatus to generate the required/desired tension.

The translation of the pivot points, 710 and 730, of the left and right rigid steaming heads and angle of rotation of the left and right steaming heads enables different triangular shapes to be achieved.

Force measurements from the force sensors of the flexible steaming assembly 500 may be used to determine: the position along the x-axis of the flexible steaming head 500; the position of the fixed end of the left and right rigid steaming heads; and the angle of rotation of the left and right rigid steaming heads, so as to achieve a desired tension in the supported trousers 806.

The flexible steaming head 500 is progressed vertically across the crotch region 820 of the supported trousers 806 with the left and right rigid steaming heads, 510 and 530, in the substantially triangular shapes described above.

As the flexible steaming head, 500, is progressed in this manner the flexible steaming head 500 treats the trousers 806, applying steam, heat and tension via the left, right and central rigid steaming heads, 510, 530 and 520, to the trousers 806.

After the treatment of the crotch region 820 described above the flexible steaming head 500 is progressed in the vertical direction downwards, onto the upper leg region 830 of the supported trousers 806. The shape of the upper leg region 830 of the supported trousers is different to that of the crotch region 820 of the supported trousers.

Figure 9C:
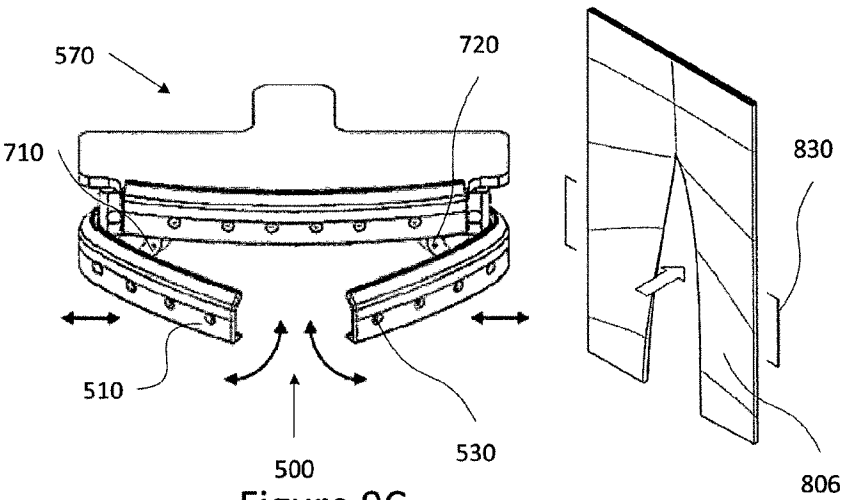
FIG. 9C shows the steaming assembly of FIG. 8A in a configuration for the treatment of an upper leg region of a pair of trousers.

Due to the change in shape of the supported trousers 806 the tension applied by the flexible steaming head 500 to the supported trousers changes. To maintain the desired tension in the supported trousers 806 the shape of the flexible steaming head 500 is altered into a wider triangular shape as shown in FIG. 9C, such that the left and right heads 510, 530 treat respective left and right legs.

In this example, the pivot point 720 of the right rigid steaming head 530 is translated along the y-axis away from the central plane of the flexible steaming head. The angle of rotation of the right steaming head is maintained. Similarly, the pivot point 710 of the left rigid steaming head 510 is translated along the y-axis away from the central plane of the flexible steaming head. The angle of rotation of the left steaming head is maintained.

In such a manner the left and right steaming heads, 510 and 530, are moved away from each other along the y-axis to form a different triangular shape—increasing the width of the triangle that they form with each other and with the central steaming head, thereby allowing the flexible steaming head to maintain the desired tension in the supported trousers.

As with the treatment of the crotch region 820, force measurements from the force sensors of the flexible steaming assembly determine: the position along the x-axis of the flexible steaming head; the position of the fixed end of the left and right rigid steaming heads; and the angle of rotation of the left and right rigid steaming heads, so as to achieve, during treatment of the upper leg region, a desired tension in the supported trousers.

The flexible steaming head 500 is progressed vertically in a downwards direction across the upper leg region 830 of the supported trousers 806 with the left and right rigid steaming heads 510 and 530 in the substantially triangular shapes described above. Adjustments to the shape and positioning of the flexible steaming head may be made during treatment to ensure that the desired tension in the article is maintained.

As the flexible steaming head 500 is progressed in this manner the flexible steaming head 500 treats the trousers 806, applying steam, heat and tension via the left, right and central rigid steaming heads 510, 520 and 530.

Figure 9D:
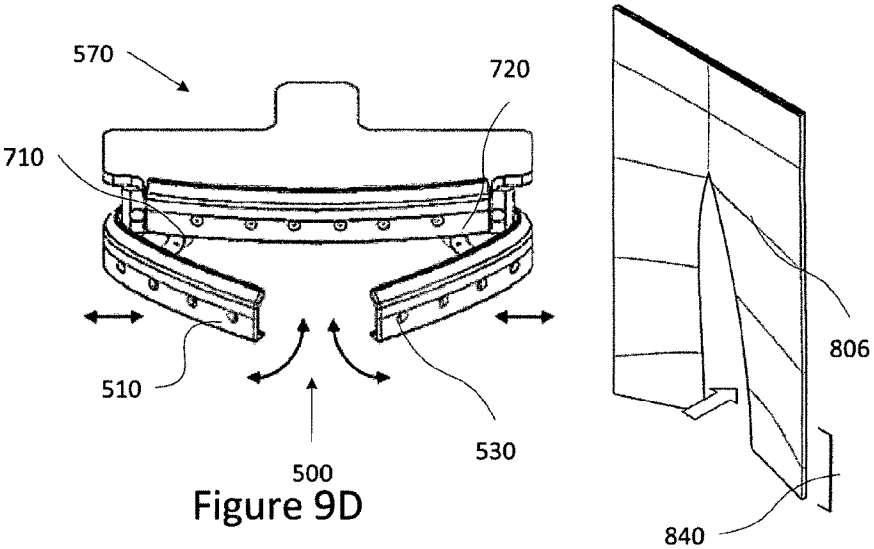
FIG. 9D shows the steaming assembly of FIG. 8A in a configuration for the treatment of a lower leg region of a pair of trousers.

After the treatment of the upper leg region 830 of the supported trousers described above the flexible steaming head 500 is progressed in the vertical direction onto the lower leg region of the supported trousers. The shape of the lower leg region 810 of the supported trousers 806 is different to that of the upper leg region 830 of the supported trousers. Due to the change in shape of the supported trousers the tension applied by the flexible steaming head to the supported trousers changes as shown in FIG. 9D.

To maintain the tension applied to the supported trousers the force measurements made by the force sensors of the flexible steaming assembly are used to determine the position along the x-axis of the flexible steaming head; the position of the fixed end of the left and right rigid steaming heads; and the angle of rotation of the left and right rigid steaming heads. The flexible steaming assembly and/or flexible steaming head is moved to the positions determined by the force measurement to maintain and/or achieve the desired tension.

In the present example, the flexible steaming assembly 500 remains a shape similar to that used in the treatment of the upper leg region of the supported trousers.

In a similar manner, based on force measurements from the force sensors the pivot points of the left and right rigid steamer heads are moved, during treatment, along the y-axis to maintain tension in the supported trousers. In addition, the angle of rotation of the right and left steaming heads is also adjusted based on force measurements from the force sensors to ensure that the desired tension is achieved in the lower leg region of the trousers. Since the legs of trousers are clipped at the bottom of the trouser leg to the hanger as the flexible steaming head progresses towards the bottom of the lower leg region the tension of the article increases due to the force exerted by the clips.

To compensate for the increased tension and so as to maintain the desired tension in the lower leg region 840 the flexible steaming head 500 changes shape as it progresses over the lower leg region.

In particular, when the flexible steaming head approaches the bottom of the of the lower leg region the angle of rotation of the left and the right rigid steamer heads is reduced by rotating the left and right rigid steaming heads toward the yz plane through retraction of the attached pistons. The left and right rigid steaming heads, 510 and 530, do not therefore extend as far into the supported trousers and apply less force to the lower leg region 840 thereby reducing the tension applied to the trousers.

As the flexible steaming head 500 is progressed in this manner the flexible steaming head 500 treats the trousers 806, applying steam, heat and tension via the left, right and central rigid steaming heads.

After the treatment of the lower leg region 840 of the supported trousers the flexible steaming head 500 is returned to the retracted configuration and actuated away from the support article.

In this example the flexible steaming head 500 performs a second treatment pass of the supported article 806.

To begin the second treatment pass, the flexible steaming assembly 500 is moved in the upwards direction along the vertical track to a point where the flexible steaming head 500 is aligned with the waist region 810 of the supported trousers 806.

Once in the vertical position the flexible steaming head 500 is actuated toward the supported trousers 806 along the x-axis and brought into contact with the waist region 810 of the trousers.

The flexible steaming head 500 being in the retracted configuration and the position of the flexible steaming head 500 along the x-axis is based upon force measurements from the force sensors of the flexible steaming head and selected to ensure that the article is at the desired tension.

Once in contact with the waist region 810 of the trousers the flexible steaming head 500 is changed from the retracted configuration to be in the extended configuration.

The left 510 and right 530 steaming heads are moved across the article from a central position to an extended position. The positions of the left 510 and right 530 steaming heads may be based on the position of the left and right vertical poles, such that the width of the extended positions are determined by sensors (e.g. force sensors).

As the left 510 and right 530 steaming heads move across the article 806 from the retracted configuration to the extended configuration the steaming heads 510, 520, 530 create tension across the full width of article.

Once in the extended position the steaming assembly is progressed vertically downwards across the supported trousers.

The angle of rotation of the right and left rigid steaming heads is set at zero such that, during the second treatment pass, the right and left rigid steaming heads remain parallel to the yz plane, as the crotch 810 and inner leg 820 of the supported trousers were treated during the first treatment pass and do not require further treatment during the second treatment pass. Alternatively, the angle of rotation of the left and right steaming heads may be varied during the second treatment pass.

As the flexible steaming head 500 is progressed vertically across the supported trousers the flexible steaming head 500 treats the trousers applying steam, heat and tension via the left, right and central rigid steaming heads 510, 530 and 520.

The second treatment pass is completed when the flexible steaming head 500 has treated the entire article i.e. when it reaches the bottom of the trouser legs.

On completion of the second treatment pass the steaming assembly is moved away from the supported article along the x-axis by the horizontal actuator and moved to a stowed position in the apparatus.

The apparatus exit doors open and the treated supported article is conveyed, by the support rail, to the exterior of the apparatus for collection by the user.

The method of treating trousers described above may be used with any automatic ironing apparatus and hanger/support system and is not limited to just those automatic ironing apparatus and hanger/support systems described in this application.

Treatment Process—Combined Hanger and Apparatus

Figure 10:
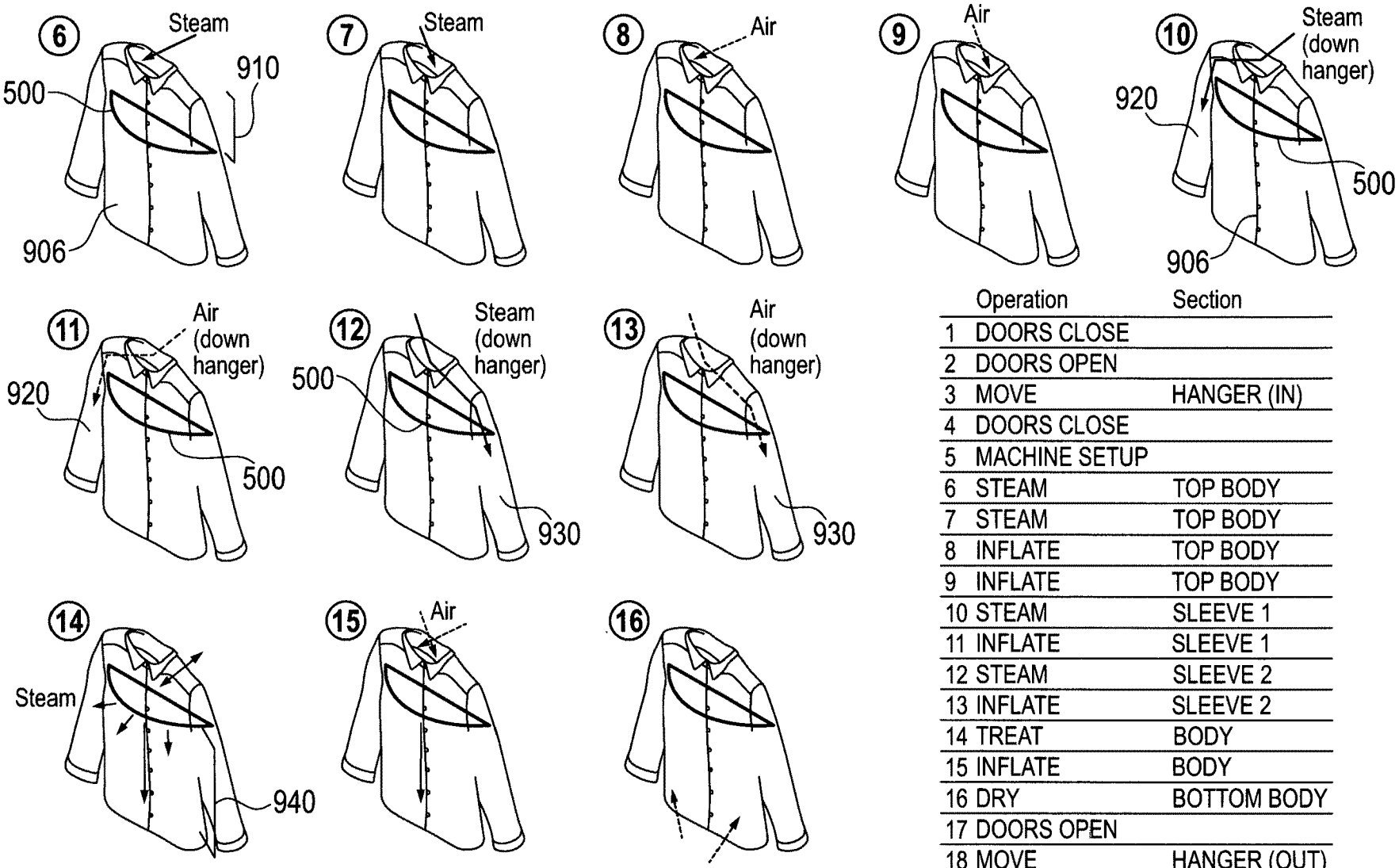
FIG. 10 shows a treatment method of a shirt using an automatic ironing apparatus.

FIG. 10 shows a method of treating an article 906, in this case a shirt, using the apparatus 100 (including steaming head 570) and hanger 200 previously described. FIG. 10 shows the sequence in which steam and air are applied to different parts of the shirt 906 during the treatment process.

The shirt 906 is treated according to different regions that require different treatments to be applied. To apply different treatments to the shirt 906 the shirt 906 is moved during treatment to different treatment positions within the treatment chamber of the apparatus 100.

In each treatment position the leg portions 222 and 224 of the hanger 110 may be secured within the treatment chamber by flaps 116. The flaps 116 extend from the base of the treatment chamber to grasp the leg portions 222 and 224 of the hanger 200.

The regions that the shirt 906 is broken up into are: the top body of the shirt, the left sleeve, the right sleeve, the body of the shirt and the bottom body of the shirt.

The method depicted in FIG. 10 will now be described in detail with particular reference to the steaming assembly 570, smoothing unit and hanger 200 described above.

An article for treatment, in the present example a shirt 906, is loaded onto hanger 200 and secured onto the support rail 108 in the manner described above.

A user activates a treatment cycle using a user interface. The entry doors of the apparatus 100 open and the hanger 200 and supported shirt 903 are conveyed into the apparatus 100 by the support rail 108.

The entry doors of the apparatus 100 close thereby enclosing the hanger 200 and the supported article 906 in the treatment chamber of the apparatus.

Treatment begins, in this example, with the top body 910 of the shirt 906. This treatment is depicted in diagrams 6-9 of FIG. 10, where the diagrams show the application of steam and air to the shirt 906.

The hanger 200 and supported shirt 906 are moved, by the support rail 108, to a first treatment position in which the front air guide 240 of the hanger 200 is aligned with the output paths of the steam outlets of the apparatus 100. The steam outlets of the apparatus being located in the treatment chamber.

The smoothing assembly is moved to a vertical position at which the flexible steaming head 500 is aligned with a bottom of the top body portion 910 of the shirt 906. In this example, this position is just below the armpits of the shirt in the vertical direction. This position is used so as to keep steam and air pressure relatively high, so as to treat the region of the shirt above the flexible steaming head effectively. The flexible steaming head 500 is in the retracted configuration.

Once in the desired vertical position the horizontal actuator moves the steaming assembly 500 toward the article 906 to be smoothed along the x-axis. As a result of the movement the steaming assembly toward the article 906 the front faces of the pressing plates of the rigid steaming heads of the flexible steaming head 500 contact the shirt 906.

Contact of the rigid steaming heads, 510, 520 and 530, with the shirt 906 causes a force to be exerted on the front faces of the rigid steaming heads, 510, 520 and 530, and a force measurement to be registered on the force sensors 560 of the rigid steaming heads. The force measurement is representative of the tension applied to the article 906 by the rigid steaming heads 510, 520, 530. The position of the steaming assembly 570 is determined by the force measurement of the force sensors 560. Different positions of the steaming assembly 500 apply different magnitudes of force to the article 906.

As will be appreciated, the position of the steaming assembly 500 may be varied so as to achieve a desired tension across the shirt 906. The desired tension may be dependent on a number of factors for example the material of the article, the size of the article or a user selected parameter.

Once in a desired position along the x-axis the rigid steaming heads 510, 520, 530 of the flexible steaming head 500 are moved from the retracted configuration to the extended configuration shown in FIG. 7.

The curvature of the individual rigid steaming heads and the movement of the rigid steaming heads along the circumference of the circle C1 advantageously allows the flexible steaming head 500 to bow the centre of the article 906 and thereby creating and maintaining tension across the full width of the article.

During treatment, as the article 906 bows under the pressure of the rigid steaming heads 510, 520, 530 pushing against it, the material of the article is stretched out and/or pulled tighter.

The shoulder sections 540 of the left 510 and right 530 steaming heads help maintain the tension across the article 906 over the full height of the steamer heads 510,520,530.

The force exerted on the shirt by the flexible steaming head 500 creates a partial seal across the bottom of the top body of the shirt 906 that prevents or hinders steam and/or air from passing from the top body 906 section of the shirt to the body section 940 of the shirt.

Whilst the flexible steaming head 500 applies tension to the bottom of the top body 910 of the shirt, steam is expelled from the steam outlets of the apparatus 100. The hanger 200 and supported article 906 are in the first treatment position and the steam is expelled from the steam outlet of the apparatus in such a manner so that it is directed down the neck hole of the shirt 906 by the front air guide 240 of the hanger 200 toward the left side of the inside of the shirt 906. The steam from the steam outlets enters the top body of the shirt and its escape from the bottom of the shirt is mitigated by the partial seal created by the flexible steaming head.

The restricted movement of the steam within the shirt 906 causes a build up of steam in the top body 910 of the shirt 906. The build-up of steam causes the top body 910 of the shirt 906 to inflate and the steam to exert an outward pressure on the inside material of the top body 910 of the shirt, creating a tension in the top body 910 of the shirt 906. As previously described, this inflation assists in the removal of creases by way of the tension and heat, and may be further assisted by the escape of the steam through pores in the fabric.

After a period of time the steam from the steam outlets is stopped and steam is then expelled from the steam outlets of the apparatus in such a manner that it is directed down the neck hole of the shirt via the front air guide 240 of the hanger toward the right side of the inside of the top body of the shirt. This causes similar inflation of the top body of the shirt.

The positioning of the flexible steaming head 500 may be adjusted as appropriate to maintain or re-establish the partial seal that the flexible steaming head provides.

Alternatively, steam may be introduced into the top body 910 of the shirt 906 via the steam outlets of the left and right tubing of the hanger 200. For example, the first treatment position(s) would align and connect steam outlets of the automatic ironing apparatus with steam inlets of the hanger 200. Steam would then be introduced from the automatic ironing apparatus via the steam outlets of the left and right tubing into the left and right sleeves of the shirt 906. The expulsion of steam from the steam outlets of the left and right tubing causes the sleeves of the shirt to fill with steam and as a result of the seal, just below the armpits of the shirt, provided by the flexible steaming head 500 the steam from the sleeves spills out from the sleeves into the top body of the shirt. In such a way the top body of the shirt may be filled with steam.

The steam to the right and left steam outlets may be alternated so as to get an even fill of steam in the top body of the shirt.

In the second treatment position, shown in diagrams 8 and 9 of FIG. 10A, a right air blower of the apparatus 100 is aligned with the supported article such that air from the air blowers enters the front air guide 240 of the shirt. The previously described process of inflation then repeats, with air used instead of steam. The air acts to dry the shirt, and also assists in smoothing in its own right. As will be appreciated, the air blowers in the apparatus are already angled downwards (as well as left or right respectively to some extent)—the use of the front air guide keeps the air flow going down the shirt.

The right air blower than stops, and the left air blower of the apparatus 100 then activates and begins expelling hot air. The hot air expelled by the left air blower enters the supported shirt 906 through the neck hole via the front air guide 240 of the hanger and is directed toward the right hand side of the inside of the shirt 906. This can be seen in diagram 9 of FIG. 10. The process of inflation repeats once again. Alternating air flow in this way may evenly process each side of the shirt.

The left 920 and right 930 sleeves of the shirt 906 are then treated. The treatment of the left sleeve is shown in diagrams 10 and 11 of FIG. 10 and the treatment of the right sleeve is shown in diagrams 12 and 13 of FIG. 10.

To treat the sleeves of the shirt, the hanger 200 and the supported shirt 906 are moved to a third treatment position that aligns or connects the right steam inlet 264 on the centre portion 210 of the hanger with a steam outlet or steam outlets of the apparatus 100. After the hanger 200 is moved to the third treatment position, a treatment cycle is activated—the connected steam outlet of the apparatus turning on and off a supply of steam to the right steam inlet 264 of the hanger 200.

The steam provided by the steam outlet and received by the right steam inlet 264 is expelled by right steam outlet 266 into the right tubing of the steam distribution system 260 on the rear of the hanger 200. The steam is expelled at the steam outlet of the right tubing positioned near the extremis of the right arm portion 254 of the hanger 200.

The steam outlet of the right tubing expels steam received at the right steam inlet 264 into the right sleeve 930 of the supported shirt 906.

The right cuff clip of the hanger 200 partially seals the right sleeve 930 and restricts the steam expelled from the right sleeve outlet into the right sleeve 930 from exiting the right sleeve via the cuff, causing the right sleeve 930 to inflate and be treated by the steam. The steam escapes through the pores in the fabric of the sleeve of the shirt 906.

After a duration of time the steam from the steam outlet of the apparatus 100 is stopped—the steam treatment of the right sleeve being complete.

The hanger 200 and the supported article 906 are then conveyed by the support rail 108 to a fourth treatment position in the apparatus 100. The fourth treatment position aligns the right air inlet 256 of the internal air conduit 250 of the hanger 200 with an air blower or air blowers inside the treatment chamber of the apparatus 100. After the hanger 200 is moved to the fourth treatment position, a treatment cycle is activated—the aligned air blower of the apparatus turning on and off a supply of hot air to the right air inlet 256 of the internal air conduit guide of the hanger 200. The previously described process of inflation of the sleeve then repeats, with air used instead of steam. The trapped hot air in the inflated sleeve dries the left sleeve of the shirt which is wet or damp from the preceding treatment of sleeve with steam. The air also assists in smoothing in its own right.

An identical treatment is then applied to the left sleeve 920 of the shirt, with steam and then heat being applied in respective fifth and sixth treatment positions.

The treatment of the top body of shirt 910 in this manner advantageously may allow treatment of an area of the shirt that the flexible steaming head may, due to hanger 200, have restricted access to and which the steaming head may not due to this restricted access be able to treat effectively.

The order of treatment of the parts of the shirt may also provide several advantages. Treating the top body first and then the sleeves prevents inflation of the top body from introducing creases in the already-treated sleeves which would not be the case if the order were reversed.

Furthermore, if the sleeves were treated after the body of the shirt 940, this may introduce creasing across the bottom of the top body where the flexible steaming head is used, in the treatment of the sleeves, to seal the body of the shirt from the top body 910 of the shirt. This order ensures that creases are not introduced into already-treated areas at a later stage of the process.

After the steam and hot air treatment of the right 930 and left sleeves 920 of the shirt the body 940 of the shirt 906 is then treated further. The treatment of the body of the shirt 940 is shown in diagrams 14 to 16 of FIG. 10.

To treat the body 940 of the shirt 906, the hanger 200 and the supported shirt 906 are moved to a seventh treatment position inside the treatment chamber by the support rail 108 of the apparatus 100, in which air blowers of the apparatus are aligned with the front air guide 240 of the hanger 200.

The smoothing unit is moved along the vertical track of the apparatus in the downward direction thereby progressing the flexible steaming head 500 across the shirt applying steam to the body of the shirt 940 via the steaming section 490 and smoothing the steamed parts of the body 940 of the shirt using the pressing plate 410 of the pressing section 480 of the rigid steaming heads.

As the flexible steaming head 500 is progressed over the body of the shirt in the vertical direction so too is the seal it creates in the supported shirt 906.

The rate at which the smoothing unit moves along the vertical track and therefore the rate at which the flexible steaming head 500 progresses across the article may be selected prior to operation and may depend on a user input or setting selected by the user prior to operation and/or may be optimised so as to achieve the best smoothing effect as the effectiveness of the smoothing may be dependent on the rate of vertical movement.

The rate may also be varied during operation by the processor of the apparatus.

To account for variations in tension that may occur during treatment, as the smoothing unit is moved vertically during the smoothing process, the measured data from the force sensors is used to determine if the measured tension parameter of the article 906 is within a desired range. If the tension falls outside of this range the horizontal actuator may move the steaming assembly and/or the rigid steaming heads to a different position, altering the tension in the shirt 906, until the determined tension falls within the desirable range. Other means of determining a measured tension parameter are also possible.

As the smoothing unit progresses across the article in the vertical direction, the positions of the left 510 and right 530 steaming heads may be adjusted by the motors 550 based on measurements of force from the force sensors thereby adjusting the profile of the flexible steaming head 500 so as to maintain tension across the article.

In addition, as the smoothing unit progresses vertically across the article the flexible steaming head 500 may also be moved toward or away from the article by the horizontal actuator in order to maintain a desired tension in the body of the shirt 940.

Once the steaming head 500 has treated substantially the whole of the body of the shirt, a further reprocessing step is performed in which the steaming head is moved towards the top of the body, and then progressed down. Whilst the flexible steaming head 500 is progressed vertically across the body of the shirt 940 the air blowers of the apparatus are activated and hot air from the air blowers is directed into the shirt via the front air guide 240 of the hanger 200.

The air from the air blowers enters the body of the shirt 940 and is prevented by the seal created by the flexible steaming head 500, which is vertically progressing across the body of the shirt, from exiting the bottom of the shirt. The restricted movement of the air within the shirt 906 causes a build-up of air in the body of the shirt 940, causing inflation as previously described. The use of hot air to inflate the shirt (including the lower parts of the body of the shirt, unlike in the previously described processing) acts to dry the shirt.

Flow rate from the air blowers may be increased to compensate for the increase in volume.

The air blowers blowing air into the front air guide 240 may be placed on an activation sequence such that hot air blown by one of the air blowers does not interfere with the path of the hot air blown by another of the air blowers. For example, the air blowers may alternate in providing hot air directed to the left side of the shirt with hot air directed to the right side of the shirt.

Once the flexible steaming head 500 has progressed vertically across the body of the shirt and is at the bottom of the shirt the flexible steaming head 500 is moved away from the shirt along the x-axis, disengaging from the shirt 906. The flexible steaming head then returns to the retracted configuration.

The smoothing unit is then returned to a storage position within the apparatus 100.

The shirt 906 is then moved to a final treatment position aligning the bottom of the shirt with hot air from further air blowers of the apparatus 100 located underneath the shirt.

The air blowers activate, and hot air is applied to the bottom region of the shirt ensuring that this section (which cannot be accessed via the air blowers which bow air via the hanger) is dried before the end of the treatment.

After the drying of the bottom region of the shirt the treatment is complete, and the exit doors of the apparatus 100 open and the hanger 200 and the supported shirt 906 are conveyed to the outside of the apparatus 100 by and along the support rail 108. The hanger and treated shirt are positioned outside the treatment chamber ready for collection by the user. The hanger 200 and supported article 906 may remain in this collection position whilst the apparatus treats further articles.

The machine then resets ready for the treatment of a next article. It will be appreciated that the method of treatment described here is one example of a treatment process and the steps and procedures described may be used in any order and/or performed simultaneously to treat an article.

As will be appreciated the treatment positions may vary somewhat in practice, in particular to simplify and/or combine processing steps. For example, air can be delivered via the front air guide while steam is delivered via the sleeve outlets.

Placket Closure for Sealing Shirt

In the examples described above, a shirt was secured to the hanger by doing up the buttons of the shirt.

Whilst this is an effective method of securing the shirt to the hanger it can lead to undesirable artefacts arising as a result of the treatment process. Specifically, when secured the buttons of the shirt generate local areas of tension that when treated by the flexible steaming head may leave damp and wrinkled spots on the shirt.

As such an alternative solution for securing the plackets of a shirt together for treatment in the apparatus is desirable.

Figure 11A:
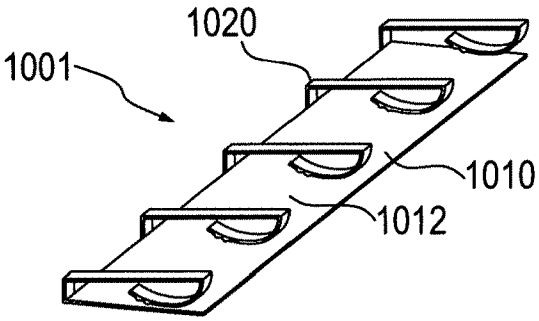
FIG. 11A shows a placket closure device.

One such solution is shown in FIG. 11A which shows a part of a placket closure device 1001. Two of the assemblies 1001 shown in FIG. 11A may be arranged to form a placket closure device 1000 for securing both plackets of a shirt 906. These two assemblies could be manufactured separately and fixed together or could be a manufactured as a single piece depending on manufacturing demands. The assembly shown in FIG. 11A is designed to hold one side of the placket only.

The part of the placket closure device 1010 comprises a flexible backboard (or 'rib') 1010.

Arranged along a face of the flexible backboard 1010 are a plurality of formations referred to as closure clips 1020.

The flexible backboard 1010 is made from a flexible material and, in this example, is substantially cuboid in shape having a length, width and height and a centre line extending along the length of the cuboid at the midpoint of the width of the cuboid.

A layer of high friction material 1014 is optionally affixed to the surface of a top face 1012 of the flexible backboard.

Figure 11B:
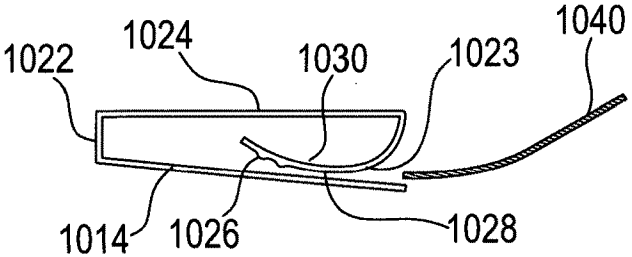
FIG. 11B shows a cross section of the placket closure device of FIG. 11A.

A closure clip 1020 attached to the flexible back board is shown in isolation in FIG. 11B. The closure clip has a looped shape including an attachment section 1022 and an overhang section 1024 (which are arranged generally at right angles to each other), and a curved portion referred to as an underhang section 1030 located between the overhand section 1024 and the back board 1010.

The attachment section 1022 attaches to the top face 1012 of the flexible back board 1010, and is arranged vertically at right angles to the back board 1010. The top face 1012 of the flexible back board is covered by a layer of high friction material 1014.

Attached to the attachment section 1022 of the closure clip 1020 is the overhang section 1024.

The underhang section 1030 of the closure clip 1020 attaches to the end of the overhang section furthest from the attachment section 102. The underhang section 1030 under hangs and is supported by the overhang section 1024. The underhang section 1030 is curved and has an unattached end 1032.

The underhang section is, when viewed from the side, located between the overhang section and the baseboard, and touches the baseboard at the mid-point of the curved shape that it defines.

The underhang section 1030 has spring properties such that it may be deflected toward the overhang section 1024 by an applied force and return to an initial position when the force is no longer applied. The closure clip 1020 is accordingly capable of gripping fabric between the back board 1010 and the underhang section 1030 (or rather, the point of the underhand section that touches the back board).

The closure clips 1020 are attached via the attachment section 1022 to the flexible backboard 1010 along an edge of the top face 1012. Two assemblies 1001 may be attached together to form a placket closure device, the assemblies 1001 are attached together such that the closure clips 1020 of the assemblies are arranged in pairs along a centre line of the attached flexible back boards 1010. Each pair of closure clips 1020 are positioned on the back boards at substantially the same position along the length of the centre line. The closure clips 1020 are orientated such that the overhang sections 1024 of the closure clips 1020 extend outwardly from the centre of the flexible back board 1010 towards opposite long edges of the face of the cuboid.

This arrangement of closure clips 1020 on the flexible backboards 1010 creates two linear arrays of closure clips (a left set and a right set) mirrored across the centre line of the flexible back boards 1010. This arrangement may be well suited for receiving two fabric sheets (i.e. the shirt plackets) at different sides.

The overhang sections 1024 of the closure clips are spaced from the surface of the backboard by the attachment sections 1022.

The overhang sections 1024 of the closure clips 1020 therefore extend over and across the surface of the flexible back board 1010.

As mentioned, a section of the outer surface of the underhang section 1030 contacts or is in close proximity to the surface flexible back board 1010, specifically the high friction layer 1014. The closest point between the outer surface of the underhang section 1030 and the surface of the flexible back board 1010 defines an entry point 1028 of the closure clip 1020. The entry point is partially enclosed by the underhang section 1030 of the closure clip 1020 and the high friction surface 1014 of the flexible back board 1010.

Furthermore, an outer surface of the underhang section 1030 has a griping section 1023 and a smooth section 1026. The smooth section 1034 is positioned on the outer surface of the underhang section 1030 between the entry point 1028 and the attachment point of the underhang section 1030 with the overhang section 1024. The gripping section 1023 is positioned on the outer surface of the underhang section 1030 between the entry point 1028 and the end of the underhang section.

Figure 11C:
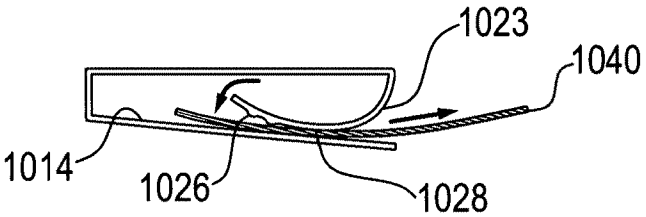
FIG. 11C shows a cross section of the placket closure device of FIG. 11A in use.
Figure 11D:
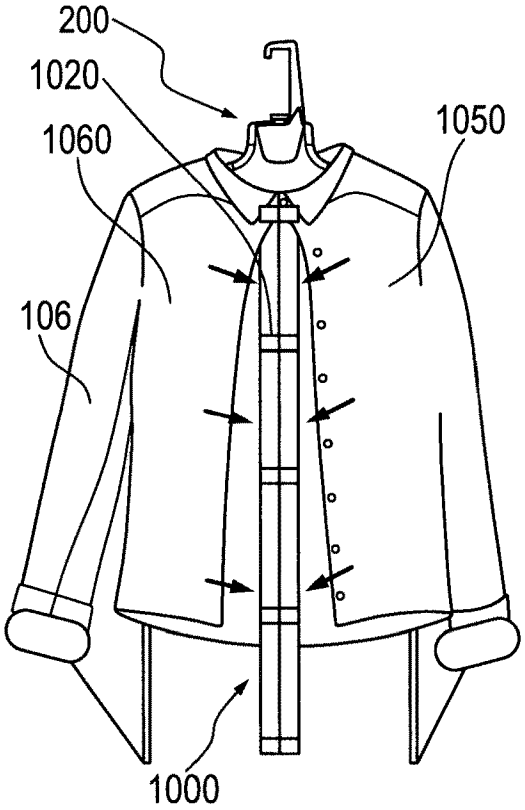
FIG. 11D shows the placket closure device of FIG. 11A in use in a hanger or support system for an automatic ironing apparatus.
Figure 11E:
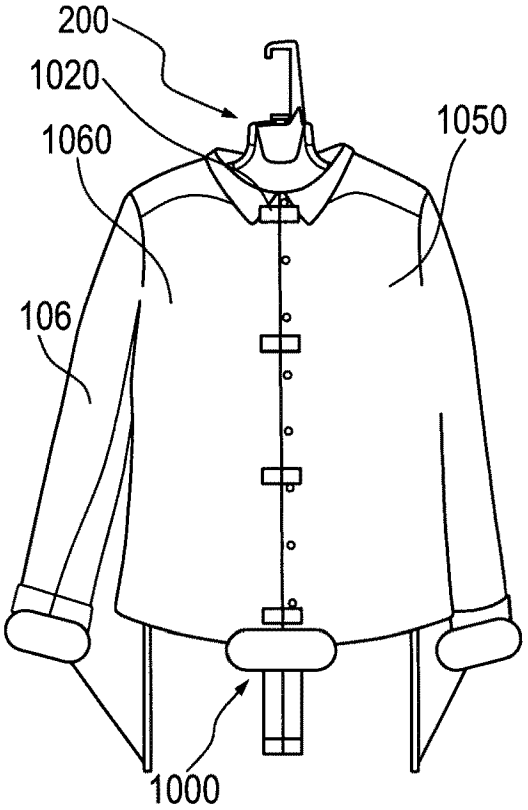
FIG. 11E shows the placket closure device in use, securing the plackets of a garment supported by a hanger or support system for an automatic ironing apparatus.

FIGS. 11D and 11E show the placket closure device 1000, comprising two of the assemblies shown in FIG. 11A, in use with hanger 200 and a supported shirt 106.

The flexible back board 1010 presents to the user a set of closure clips 1020 with entry points 1028 to one side of the flexible back board 1010 and a set of closure clips 1020 with entry points 1028 on an opposite side of the flexible back board 1010.

To secure the plackets of the supported shirt 106 together the user inserts a placket 1040 of the shirt into the entry points 1028 of the closure clips 1020 located on the flexible back board 1010. An example of a placket inserted into a closure clip is shown in FIG. 11B and FIG. 11C.

When the placket 1040 of the shirt is inserted into the entry point 1020 of a closure clip 1020 the material of the placket is guided to the entry point 1028 by the smooth section 1020 of the underhang portion 1030.

The placket of the shirt passes through the entry point 1028 of the closure clip 1020 the underhang section 1030 is deflected toward the overhang section 1024 and away from the top face 1012 of the flexible back board 1010.

The inherent spring properties of the underhang section 1030 create a downward force on the section of the inserted placket 1040.

Furthermore, the material that has passed through the entry point 1028 is retained by the gripping section 1020 of the closure clip 1020. The gripping section 1026 of the underhang section 1030 presents an area of high friction that prevents movement and hinders the placket of the shirt 1040 from moving back through the entry point 1028.

Another consequence of the shape of the clip, and in particular the underhang section 1030 is that if the inserted placket of the shirt experiences a force as pulling it out from the clip 1020, the grip surface 1032 grips onto the material, causing the underhang section 1030 to flex and move towards the high friction surface of the backboard. The flexing of the underhang section 1030 therefore causes the grip section 1032 to be forced harder into the inserted placket making it more difficult for the placket to be removed from the clip 1020.

The front sides of a shirt may thus be held together by the placket closure device 1000 by inserting the plackets of the shirt 106 into the arrays of closure clips 1020 provided on the flexible back board 1010.

For example, a user inserts the right front side placket 1050 of the shirt into the entry points 1028 of the array of the right set of clips of the placket closure device 1000. The material of the shirt inserted into the entry points 1028 of the right set of clips is gripped and retained in place by the gripping sections 1026 of the underhang sections 1030 of the closure clips 1020, the spring force exerted by the underhang 1030 on the material in the entry point 1028 and the grip of the layer of high friction material on the surface of the top face 1012 of the flexible back board 1010.

With the right side of the front of the shirt secured by the right set of clips the user then secures the left side 1060 of the shirt 106 in a similar manner.

As will be appreciated, the flexible back board 1010 of the device is positioned and secured inside the shirt, enclosed by the now secured left and right plackets of the shirt. The back board 1010 assists in tensioning the shirt during the smoothing process, as will be described.

Figure 12C:
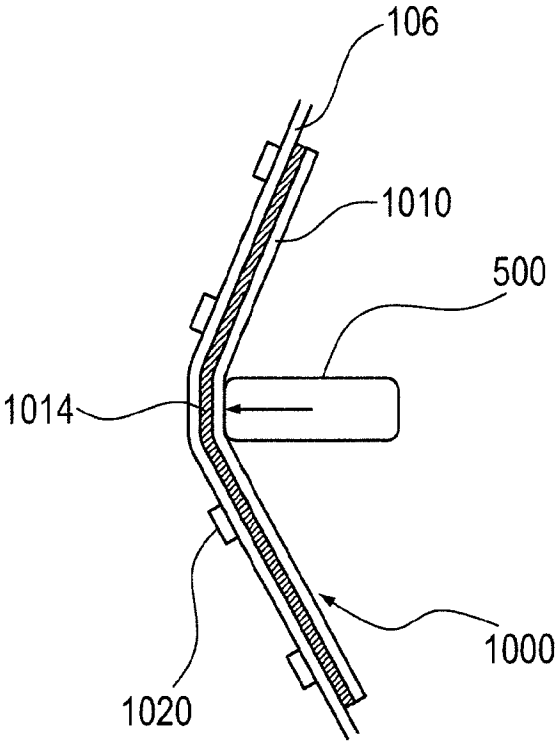
FIG. 12C shows a side view of the placket closure device of FIG. 11A in use with a garment receiving treatment from a flexible steaming head.
Figure 12B:
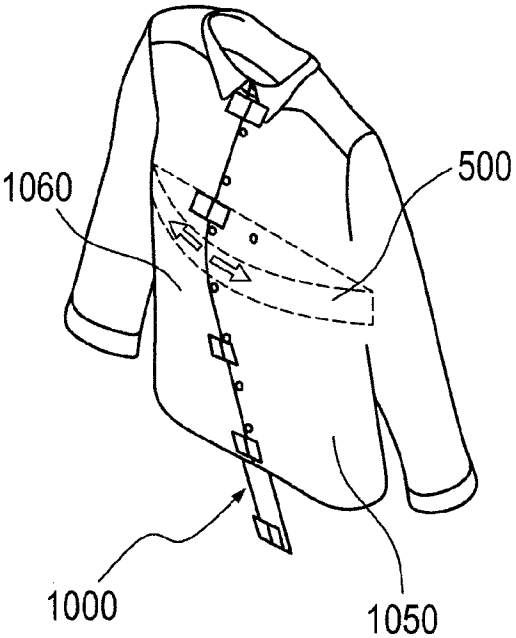
FIG. 12B shows the placket closure device of FIG. 11A in use with a garment receiving treatment from a flexible steaming head.
Figure 12A:
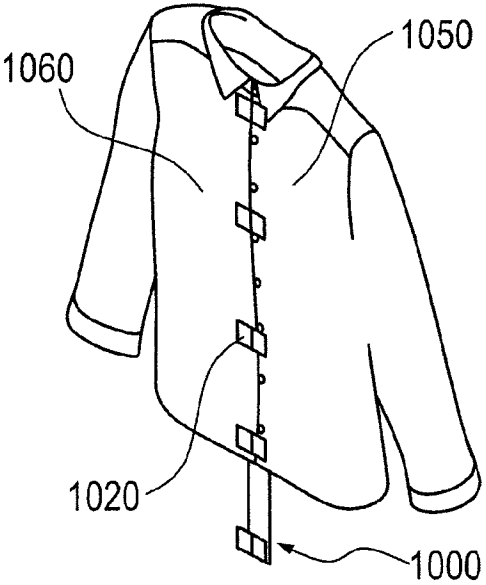
FIG. 12A shows the placket closure device of FIG. 11A in use with a garment.

FIG. 12A-C shows an example of such a use, the placket closure device 1000 is used to secure the right and left plackets of a shirt supported by hanger 200 for treatment inside the an automatic ironing machine for example apparatus 100.

The placket closure device may be fixed to a frame of a support system for supporting an article in an automatic ironing apparatus such that it is pivotable at the bottom of the frame and detachable at the top of the frame. Thus, a garment without buttons and not requiring a placket closure device can be pulled over the hanger, the top can be detached and the placket closure device moved out of the way, the garment can then be pulled over, and then the placket closure can be reattached at the top. The placket closure device positioned on the outside of the garment to avoid getting in the way of the treatment.

Alternatively, the placket closure device may be fixed at the bottom and detachable at the top of the frame, and then foldable down into a base section of the frame or the placket closure may be completely detachable from the support system and stored either on or external to the automatic machine.

FIG. 12A shows the shirt 106 supported by a hanger 200 (not shown) in a manner similar to that described above however the plackets of the shirt are not secured together using the buttons of the shirt. Instead, the placket closure device 1000 secures together the left and ride plackets of the front of the shirt, where the placket closure device 1000 pulls the left and right sides of the shirt taut across the hanger 200. The methods for treatment and apparatus discussed in relation to other examples can be used to treat the supported shirt.

Notably, the use of the placket closure device 1000 aids in aspects of these treatments, in particular the application of tension across the shirt 106 by the flexible steaming head 500.

FIGS. 12B and 12C shows an example in which the flexible steamer head 500 is applying tension, steam and heat to a shirt 106 supported by hanger 200 (not shown) with the placket closure device 1000 securing the front of shirt together in the manner described above.

During treatment, the flexible steamer head 500 is brought into contact with the back of the supported shirt 106 and applies pressure to the shirt. In this example, the flexible steaming head also applies pressure to the flexible back board 1010 enclosed within the supported shirt 106.

In some of the treatment methods described above the force applied to the supported shirt 106 by the flexible steamer head 500 causes the shirt 106 to bow outwardly in the forward direction. The pressure applied by the flexible steamer head 500 causes the flexible backboard 1010 to flex, forming a concave shape, similar to that shown in FIG. 12C, around the point of contact of the steamer head 500 with the shirt 106. The flexing of the flexible back board 1010 results in the pressure applied by the flexible steamer head 500 being spread out across the shirt 106.

The bowing of the shirt 106 and the associated forces apply directionally opposite forces to the plackets of the shirt which act to force the plackets apart—moving the plackets outwardly from the centre of the shirt 106. The placket closure device 1000 prevents the plackets from moving in such a way. The force exerted on the plackets of the shirt by the closure clips 1020 and the flexible back board 1010 is increased when the flexible back board 1010 is flexed by the flexible steamer head 500. The pressure exerted by the flexible steamer head onto the flexible backboard forces, as the flexible backboard flexes, the high friction surface of the flexible backboard toward the placket of the shirt gripped by the closure clip preventing the material from exiting the closure and ensuring that, when the flexible steamer head applies pressure to the supported shirt, the placket closure device retains the plackets of the supported shirt.

Therefore, when the flexible back board 12C is flexed, as shown in FIG. 12C, by the flexible steamer head 500, the closure clips 1020 arrayed across the flexible back board 1010 grip the plackets of the shirt inserted into the entry points of the closure clips, preventing the plackets from moving apart.

In such a way the placket closure device 1000 may secure the shirt for treatment whilst spreading the force applied by the flexible steamer head 500 to the shirt, thereby preventing the undesirable artefacts arising from the localisation of force application by the flexible steamer head 500 that may occur with other methods, for example when the buttons are used to secure the shirt.

Combined Trouser-Shirt Hanger—Detachable Hanger

An alternative to the hanger 200 and movement system of the automatic ironing apparatus 100 will now be described in the form of a support system for use in an automatic ironing apparatus.

Both commercially and from the perspective of a user experience it is advantageous for a support system used in an automatic ironing machine to utilise a hanger similar to the hangers that are in common use.

It is also advantageous for the support system, which supports the article to be treated, to have an interchangeable or multifunctional clipping system that allows articles of different shapes to be suspended in the support system.

For example, it is advantageous to have a support system that allows shirts, trousers and/or smart trousers for treatment to be supported within it.

Figure 14C:
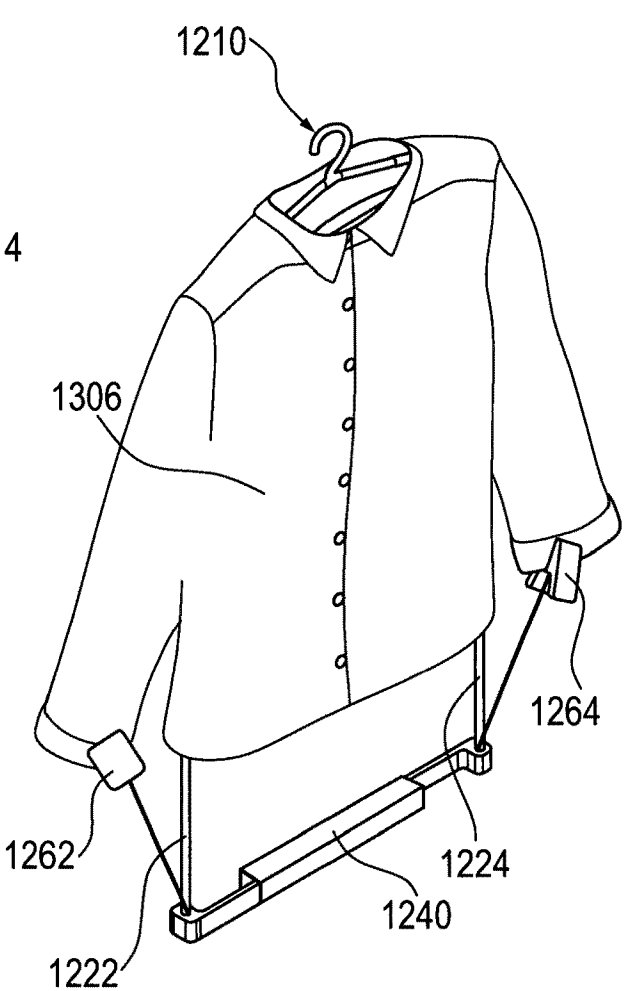
FIG. 14C shows the support system of FIG. 13A in use supporting a shirt.
Figure 14B:
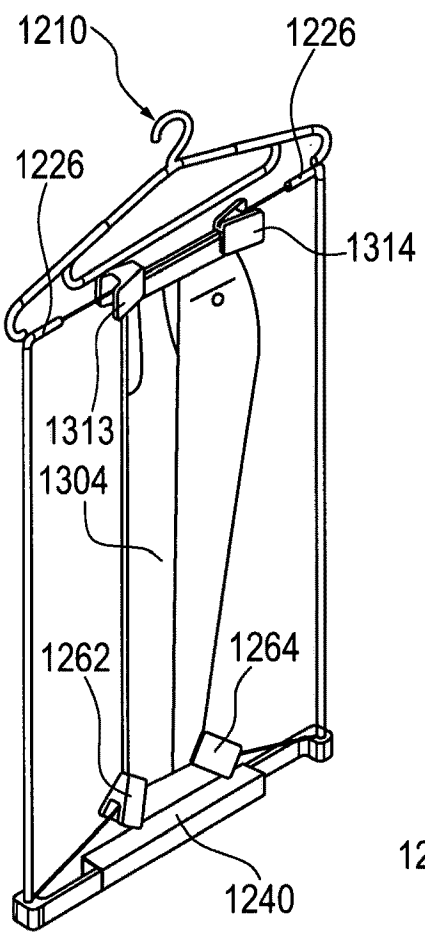
FIG. 14B shows the support system of FIG. 13A in use supporting a pair of smart trousers.
Figure 14A:
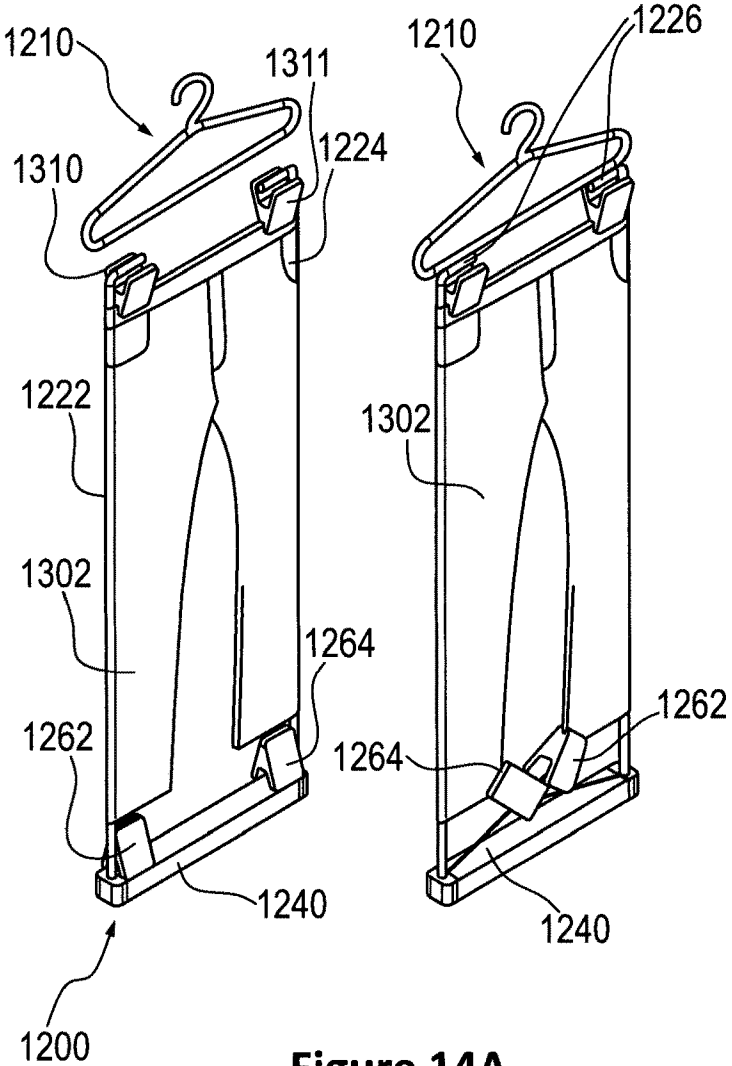
FIG. 14A shows the support system of FIG. 13A in use supporting a pair of trousers.

Such a support system is shown in FIGS. 13A-D and is shown in FIGS. 14A-C in use supporting an article. The support system will now be described in detail.

The support system 1200 shown in FIG. 13A comprises a detachable hanger 1210 and a frame 1220. The frame 1220 has a left 1222 and a right 1224 vertical pole. The detachable hanger 1210 shown in FIG. 13A is shown in a detached position.

Located on the frame 1220 are a plurality of attachment points 1226 to which the detachable hanger 1210 attaches. The attachment points 1226 are located at the top of the vertical poles and extend towards each other. The attachment points extend generally at right angles to the poles.

The frame 1220 also includes a base mechanism 1240 attached to the bottoms of the left 1222 and right 1224 poles and extending between the right 1224 and left 1222 vertical poles. The base mechanism 1240 rigidly connects the right 1224 and left 1222 vertical poles together. Further, the base mechanism 1240 is operable to adjust the distance between the left 1222 and right 1224 vertical poles. As mentioned a placket closure may be attached to this base mechanism in use.

The base mechanism 1240 comprises a rack and pinion mechanism that enables adjustment of the distance between the left 1222 and right 1224 vertical poles and ensures any adjustment of the distance between the left 1222 and the right 1224 vertical poles is symmetrical about the middle of the distance between the left and right vertical poles.

Furthermore, the base mechanism 1240 includes an attachment mechanism for attaching and securing the frame 1200 to a conveying rail of an automated ironing apparatus.

As will be appreciated, the support system 1200 acts as an alternative to the previously described hanger, differing in that the presence of the base 1240 allows the hanger to be detachable from the poles. The support system 1200 further includes a set of clips for suspending and/or applying tension to an article to be treated in the support system 1200. Two fixed clips, a left 1262 and right 1264 fixed clip, are attached to the base mechanism 1240 of the support system 1200.

The left and right fixed clips 126, 128 are attached via respective elasticated cords to respective points of the support system 1200 in proximity to the connection between the left vertical pole 1222 or right vertical pole 1224 and the base mechanism 1240, for example close to the bottom of the relevant pole. The clips are extendible via the elasticated cords.

The set of clips also includes a plurality of removeable clips that are attachable to the hanger and/or frame of the support system. Each removable clip is attachable via an attachment portion and has an elasticated cord allowing the removable clip to be extended from the attachment portion.

The detachable hanger 1210 is used to support the article for treatment. As is conventional, detachable hanger 1210 is substantially triangular being defined by a left 1212 and right 1214 arm portion that connect to a centre portion 1216 of the hanger and a base portion 1218 connecting an end of the left 1212 and right 1214 arm portions together. The hanger 1210 has a hook portion 1211 that forms the shape of a hook. The hook portion 1211 extends from the centre portion 1216 of the triangular hanger where the left and right portions of the hanger 1210 connect. The left 1212, right 1214 and base 1218 portions of the hanger are tubular. The base portion 1218 is linear whilst the left 1212 and right 1214 portions have a linear portion and a curved portion. The left 1212 and right 1214 arm portions overlap the base portion 1218. The base portion 1218 is connected to the ends of the left and right portions at the end of the curved portion. The base portion 1218 is connected by inserting the ends of the base portion into the ends of the of the curved portions of the left and right portions.

The overlap of the right 1214 and left 1212 arm portions with the base portion 1218 of the hanger 1210 allow the width of the hanger to be altered by sliding the left and right portion outwardly reducing the overlap of the left and right arm portions with the base portion and extending the width and/or height of the hanger 1210. The curved portion of the left arm of the detachable hanger attaches to the frame via an attachment point or attachment points located at the top of the left vertical pole. The curved portion of the right portion 1214 of the detachable hanger attaches to the frame via an attachment point or attachment points 1226 located at the top of the right vertical pole 1224. The attachment points 1226 may be clips such that the hanger 1210 is clipped into place on the frame.

As will be appreciated, the hanger can alternatively be a hanger including fluid conduits/venting pathways as previously described. Where a conventional hanger is used, blowers may be inserted into the garment in use to allow the previously described method to be performed.

FIG. 13B shows the hanger 1210 attached to the frame 1220 of the support system 1200 of FIG. 13A.

Once attached to the frame 1220 via the attachment points 1226 on the left 1222 and right 1224 vertical poles, the width and/or height of the hanger 1210 may be changed by actuating the rack and pinion of the base mechanism 1240—causing the left 1222 and right 1224 vertical poles of the frame 1220 to move (either apart or together) and the left 1212 and right 1214 arm portions of the hanger to move (either apart or together) by virtue of their connection via the attachment points 1226 to the left 1222 or right 1224 vertical pole.

FIG. 13C shows the support system 1200 of FIGS. 13A and 13B with a left 1272 and right 1274 removable clip attached to the left 1222 and right 1224 leg vertical poles of the frame 1220. The removable clips are attached via an attachment portion and extendible from the attachment portion via an elasticated cord.

FIG. 13D shows a photograph of an example support system 1200 similar to the support system 1200 shown in FIG. 13A-C and described above.

Attachment points 1226 for the detachable hanger 1210 extend from the left and right vertical poles of the support system shown in FIG. 13D. The attachment points are attachment clips 1226 shaped to receive and secure the left, right and/or central portion of the detachable hanger to the frame. The detachable hanger 1210 is shown secured to the frame 1220 by the attachment clips 1226.

Furthermore, the left and right vertical poles, 1222 and 1224, may be pulled apart by a user to change the distance between them and change the profile of the attached detachable hanger 1210

The support system 1200 will now be described in use supporting an article 106 for treatment in an automatic ironing apparatus.

FIG. 14A-C shows the support system 1200 supporting a pair of trousers for treatment. The trousers are suspended or held in the support system 1200 by the clipping system. The method of suspending the trousers is similar to that described above. FIG. 14A shows a method and apparatus for suspending trousers 1302 using support system 1200.

In more detail, a user removes the detachable hanger 1210 from the frame 1220. Following removal of the detachable hanger 1210 the user feeds the right trouser leg over the right vertical pole 1224 of the frame and the left trouser leg of the trousers 1302 over the left vertical pole 1222 of the frame 1220. The trouser legs are fed over the poles ankle-first and such that the vertical poles, 1222 and 1224, extend through the respective trouser legs exiting the trousers out through the waist hole of the trousers.

The user operates the rack and pinion on the base mechanism 1240 of the support system 1200 to adjust the distance between the left 1222 and right 1224 vertical poles. The user adjusts the width of the poles to ensure that right 1224 pole is positioned inside the right leg at an outer edge of the trouser leg farthest away from the centre (crotch region) of the trousers 1302 and similarly to ensure that the left vertical pole 1222 is positioned inside the left leg at an outer edge of the trouser leg farthest away from centre (crotch region) of the trousers 1302.

The right and left vertical poles thereby pull on the waist and leg regions of the trousers 1302 such that the trousers lie substantially in the plane of the right 1224 and left 1222 vertical poles and such that the trousers 1302 are held taut across the gap between the left and right poles.

The user attaches a detachable hanger 1210 to the attachment points 1226 located on the left 1222 and right 1224 vertical poles of the support system 1200.

The user suspends the trousers 1302 in the support system 1200 by attaching removable top clips 1310 and 1311 to the top of the left and right vertical poles and/or attaching top clips to the base section 1218 of the attached detachable hanger 1210. The removable top clips are attached via an attachment portion and extendible from the attachment portion via an elasticated cord.

The user inserts the waist of the trousers 1302 into the attached top clips 1310 and 1311. The top clips, 1310 and 1311, therefore hold together the front and back of the waist section of the trousers 1302 and suspend the trousers 1302 in the support system 1200 with the waist of the trouser close to the top of the vertical poles and with the bottom of the trouser legs close to the base mechanism of the support system.

As shown in FIG. 14B the user attaches the left fixed clip 1262 to the inner corner of the bottom of the right trouser leg and attaches the right fixed clip 1264 to the inner corner of the left trouser leg. The attachment of the fixed clips to the inner corners of the trouser legs ensures that the trousers are pulled taut. The fixed clips 1262 and 1264 pull on the inner corners of the right and left trouser legs in a downward and outward direction. This may ensure that the trousers 1302 and in particular the trouser legs are held taut whilst suspended by the support system 1200.

The trousers 1302 are then suspended between the right 1224 and left 1222 vertical poles in a position ready for treatment by an automatic ironing apparatus.

Once treated and presented to the user by an automatic ironing apparatus the user removes the trousers 1302 from the support system by unclipping the left 1262 and the right 1264 fixed clips and, if the top clips 1310 and 1311 are attached to the base of the detachable hanger, the user detaches the detachable hanger 1210 from the attachment points 1226—the treated trousers being attached to the detachable hangers 1210 via the top clips 1310 and 1311 and ready for storage in a user storage solution.

In the case where the top clips 1310 and 1311 are instead attached to the left 1222 and right 1224 vertical poles of the hanger the user simply unclips the top clips and removes the treated trousers 1302 from the support system 1200.

FIG. 14B shows an alternative clipping system which can be used in the support system 1200 to suspend a pair of trousers 1304 in such a way so as to treat trousers 1304 that require creases to be ironed into the front and back of the trouser legs for example suit trousers.

To suspend the trousers 1304 in the support system 1200 the user folds the trousers 1304 for treatment along the front and rear creases present in the legs of the trousers such that the left and right trouser legs of the trousers overlap one another.

The user operates the rack and pinion on the base mechanism 1240 of the support system 1200 to adjust the distance between the left and right vertical poles, ensuring that the folded trousers fit between the left 1222 and right 1224 vertical poles of the support system 1200.

The user removes the detachable hanger 1210 from the support system and inserts a removable left side clip 1312 attaching it to the left 1222 vertical pole and a right side clip 1313 attaching it to the right vertical pole 1224. The removable sides clips being attached to the vertical poles via an attachment portion and extendible from the attachment portion via an elasticated cord.

The user attaches the side clips, 1313 and 1314, to the waist of the folded trousers 1304 holding the folded sections together.

The side clips, 1311 and 1314, may be constrained so that the clips and the clipped trousers 1304 cannot move in the vertical directions.

The user attaches a detachable hanger 1210 to the attachment points 1226 located on the left 1222 and right 1224 vertical poles of the support system 1200.

A top clip (not shown) may be attached to the base portion of an attached detachable hanger, the top clip is attached to the folded trousers at the waist and prevents movement of the trousers in the vertical direction.

Once suspended in the support system by the side clips, 1313 and 1314, the user attaches the left fixed clip 1262 to the left corner of the outer ankle cuff of the suspended trousers 1304—holding together the left and right folded trouser legs.

The user attaches the right fixed clip 1264 to the right corner of the outer ankle cuff of the suspended trousers 1304 so as to hold the trousers flat in the plane of the left 1222 and right 1224 vertical poles and to tension the trousers 1304 pulling them taut and holding together the left and right folded trouser legs.

The trousers 1304 are then in a position ready for treatment by an automatic ironing apparatus. The trousers 1304 may then be treated by an automatic ironing apparatus in manner similar to that described in this application.

Once the trousers 1304 have been treated and presented to the user by an automatic ironing apparatus the user removes the trousers 1304 from the support system 1200 by unclipping the left and the right fixed clips 1262 and 1264, side clips and, if the top clips are used and attached to the base of the detachable hanger, the user detaches the detachable hanger 1210 from the attachment points—the treated trousers 1304 being attached to the detachable hangers via the top clips. The user may then place the hang the treated trousers directly in a user storage solution using the detachable hanger.

FIG. 14C shows a further example of an article for treatment supported by the support system 1200.

In this case the article is a shirt 1306. To load the shirt 1306 onto the support system 1200 the user removes the detachable hanger 1210 and loads the shirt 1306 onto the detached detachable hanger 1210.

The user then places the loaded shirt 1306 and detachable hanger 1210 over the right 1224 and left 1222 vertical poles of the support system 1200. The left 1222 and right 1224 vertical poles extending through the inside of the shirt 1306 along the sides of the shirt 1306.

Alternatively the user may attach the hanger 1210 to the frame 1306 to form the support system 1200, and then the user may load the shirt onto the support system, for example by wrapping the shirt around the hanger and the frame.

The user adjusts the distance between the left 1222 and right 1224 vertical poles using the rack and pinion mechanism on the base mechanism 1240 of the support system 1200 to ensure that the right and left vertical poles are in close proximity with the side seams of the supported shirt at the narrowest point of the shirt.

Adjustment of the width of the left 1222 and right 1224 vertical poles also adjusts the width of the detachable hanger 1210 through the movement of the left 1212 and right 1214 arm portions of the hanger 1210.

The user attaches the right fixed clip to the end (cuff) of the right sleeve of the supported shirt and the left fixed clip to the end (cuff) of the left sleeve of the shirt. The fixed clips bring together the material of the shirt 1306 sealing or partially sealing the ends of the sleeves of the shirt 1306 ready for treatment.

The fixed clips, 1262 and 1264, of the support system are used to anchor the sleeves of the shirt 1306 and seal the end of the sleeves in a manner discussed previously.

The fixed clips, 1262 and 1264, and associated elasticated cords pull the sleeves in a downward direction toward the base mechanism, creating tension in the sleeves of the shirt 1306 and pulling them taut.

The fixed clips, 1262 and 1264, securing the cuffs of the shirt may include shaped vents to allow an air blower of an automatic ironing apparatus to engage with the fixed clips to inflate the sleeves of the shirt 1306 by blowing air through the vents in the fixed clips, 1262 and 1264, during treatment.

The user then secures the front of the shirt together either by doing up the buttons of the shirt 1306 or using the placket closure device 1000 also described herein.

The shirt 1306 is now suspended between the right 1224 and left 1222 vertical poles of the support system 1200 in a position ready for treatment by an automatic ironing apparatus.

The shirt may then be treated by an automatic ironing apparatus in manner similar to that described elsewhere in this application.

Once treated and presented to the user by an automatic ironing apparatus the user removes the shirt from the support system by unclipping the fixed clips, 1262 and 1264, form the shirt, lifting up the hook portion of the hanger thereby detaching the hanger from the attachment points of the support system and removing the hanger and the treated shirt from the support system.

The user may then hang the treated shirt 1306 directly in a user storage solution using the detachable hanger 1210.

It will be appreciated that the detachable hanger may be the previously described hangar having venting pathways. Alternatively, a different hanger (without venting pathways) may be used.

Overall Concept

Figure 15B:
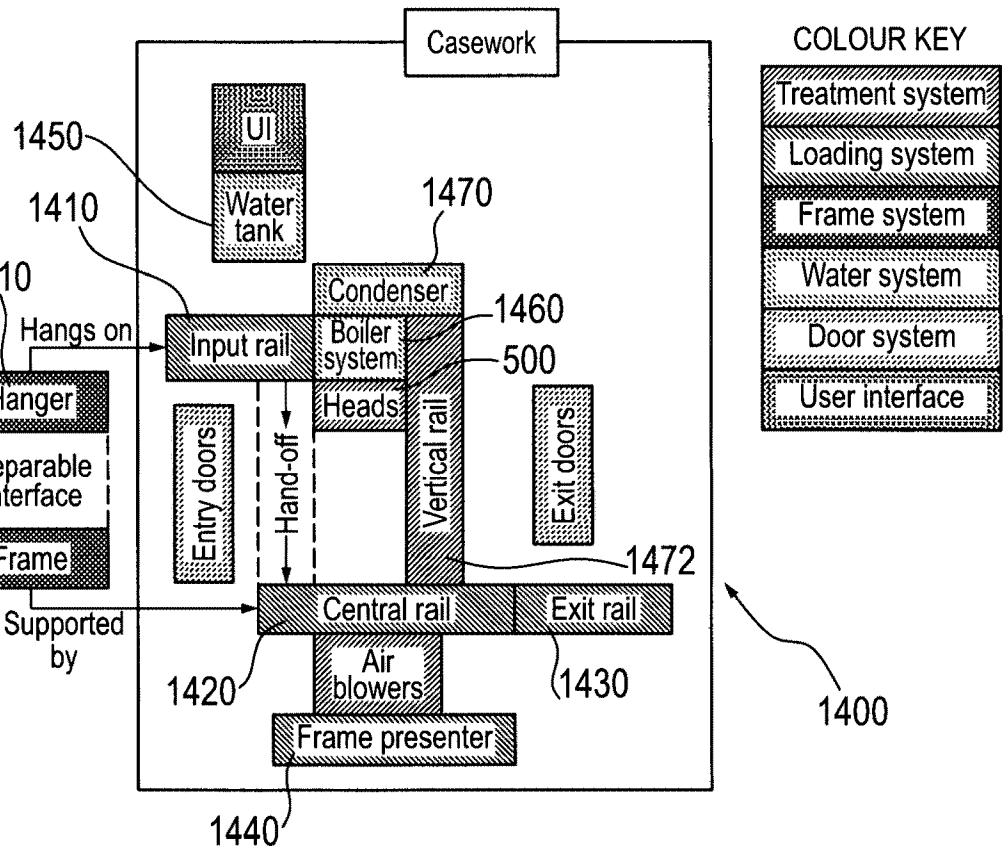
FIG. 15B shows a schematic diagram of an automatic ironing with the conveying system of FIG. 15A.
Figure 15A:
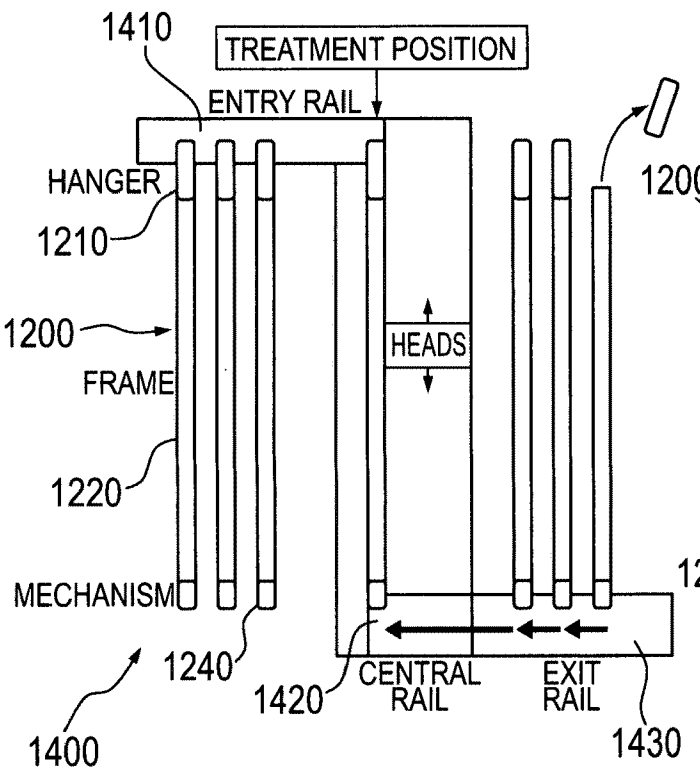
FIG. 15A shows a conveying system for an automatic ironing apparatus.

The support system 1200 described above may be used with the automatic ironing apparatus described previously and also with the automatic ironing apparatus shown in FIGS. 15A and 15B and shown in use in FIG. 16.

The automatic ironing apparatus 1400 of FIG. 15A is substantially similar to that shown in FIG. 1 and described elsewhere in this application, however the means by which the supported article is conveyed through the apparatus 1400 differs.

In particular instead of a support rail 108 that extends through the apparatus, the ironing apparatus 1400 of FIG. 15A has an entry rail 1410 for accepting and transporting a support system 1200, a central rail 1420 for securing the base 1240 of the support system 1200 and for transporting both the loaded support system 1200 and the unloaded frames 1220 of the support system 1200, and an exit rail 1430 for presenting the support system 1200 with the treated article to the user and for transporting both the loaded support system 1200 and the unloaded frames 1220 of the support system 1200.

The entry rail (also referred to as an input rail) 1410 of the ironing apparatus 1400 extends from the exterior of the treatment chamber into and across the width of the top of the treatment chamber.

The entry rail 1410 has a at least one mechanical connection to which a hanger of the type described elsewhere in this application may be attached. The entry rail 1410 also has a means of conveying supported hangers across the length of the entry rail 1410. Hangers attached to the entry rail may be moved independently of one another and sensors on the automatic ironing apparatus may be used to determine the position of the hangers. The position of the hanger may be communicated to processor of the automatic ironing apparatus, and the processor may use the positional information in the execution of the treatment process.

The central rail 1420 is located in the base of the treatment chamber of the automatic ironing apparatus 1400 and extends across the width of the bottom of the treatment chamber.

The entry rail 1410 is therefore positioned above and is aligned with the central rail 1420 in the treatment chamber. The spacing between the entry rail 1410 and the central rail 1420 in the treatment chamber being large enough to accommodate a support system 1200.

The central rail 1420 has a plurality of mechanical connections to which a base mechanism 1240 of the support system 1200 attaches providing a securing point for the support system 1200 that enables the support system 1200 to be held rigid during treatment. The central rail 1420 also includes a conveying means allowing the support system 1200 to be conveyed across the entirety of the central rail 1200. As shown in FIG. 15A, in the treatment position the support system 1200 is supported by both the entry rail and the central rail for improved support. Following treatment, the entry rail disengages with the support system such that only the central rail supports the support system 1200.

The central rail 1420 is in communication with an exit rail 1430 such that it may pass support systems 1200 secured to it via the base mechanism 1240 to the exit rail 1430. This allows the exit rail 1430 to take over transportation of the support system 1200. The exit rail 1430 extends from the base of the treatment chamber to the exterior of the treatment chamber.

The exit rail 1430 has a plurality of mechanical connections which accept a base mechanism 1430 of a support system 1200 from the central rail 1420 thereby attaching the support system 1200 to the exit rail 1430.

The exit rail 1430 further includes conveying means allowing the support system 1200, specifically the base mechanism 1240, to be accepted from the central rail 1420, and conveyed across the entirety of the exit rail 1430. Since the exit rail 1430 supports a support system 1200 entirely from underneath, a user may conveniently unclip the supported garment and remove the detachable hanger (on which the garment remains mounted) for storage.

A presentation rail (or 'frame presenter') 1440, shown in FIG. 15B in mechanical communication with the central and/or exit rail conveys empty frames 1220 stored within the apparatus 1400 to the exterior of the apparatus for collection and loading by the user.

FIG. 15B also shows (schematically) several other aspects of the automatic ironing apparatus 1400 which have not been previously described—in particular, a water tank 1450 (alternatively/additionally, the appliance 1400 may be connected to a mains water supply), a boiler system 1460 for generating steam, a rail 1472 on which the steaming head 500 travels, and a condenser 1470.

The automatic ironing apparatus 1400 is shown in use in FIGS. 16A-F and will now be described in detail with reference to the schematic diagrams shown in FIG. 15A and FIG. 15B.

Figures 16A, 16B, 16C, 16D, 16E, 16F:
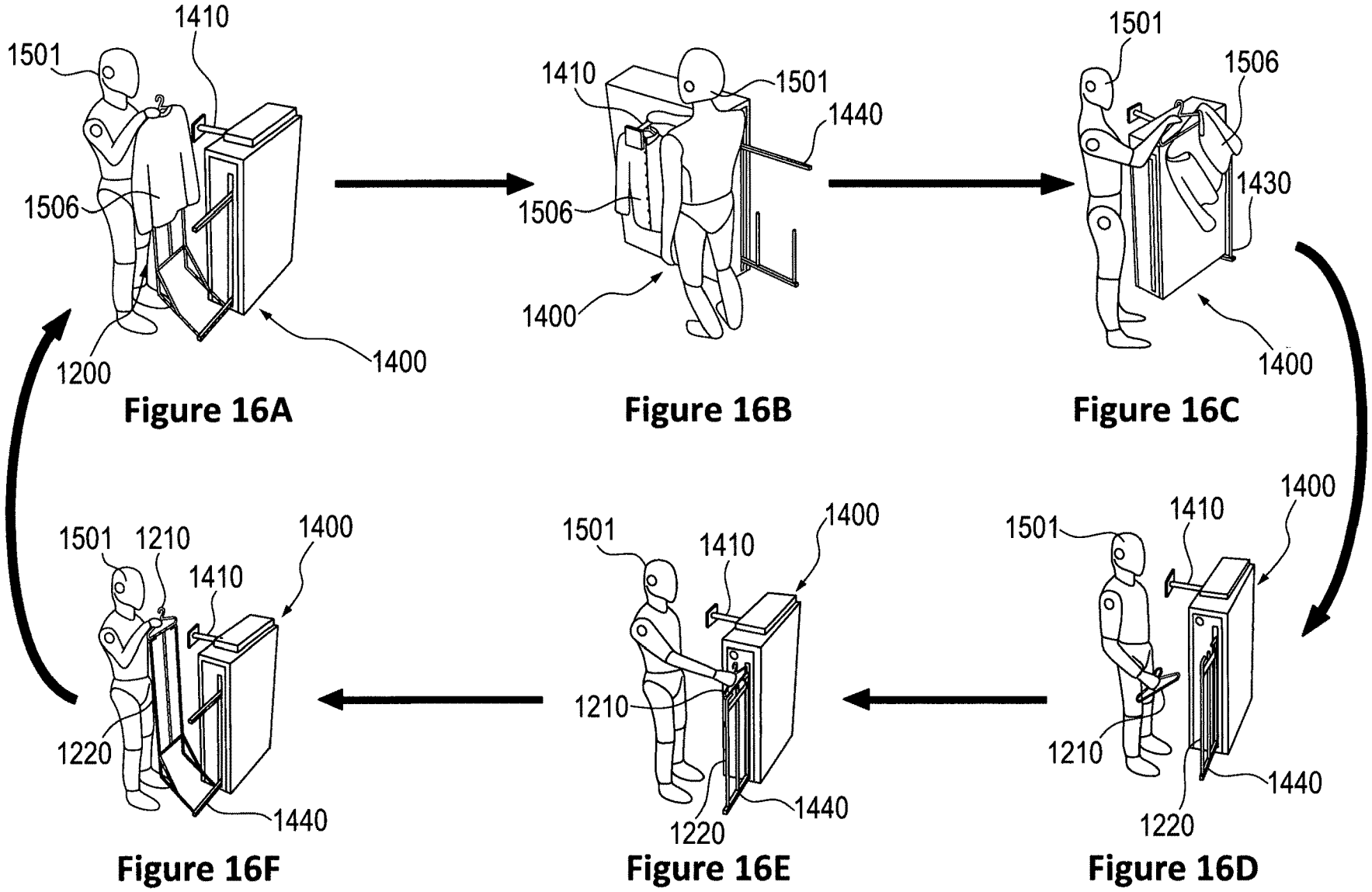
FIG. 16A-F show the automatic ironing apparatus of FIG. 15B in use.

As shown in FIG. 16A, a user 1501 loads an article 1506 into a support system 1200 in the manner described in detail above, the support system 1200 comprising a separable hanger 1210 and frame 1220.

The user 1501 then secures the loaded support system 1200 onto the entry\input rail 1410 of the automatic ironing apparatus 1400 as shown in FIG. 16B. The hook portion of the hanger 1200 engages with the entry rail 1410 to secure the support system 1200 to the automatic ironing apparatus 1400. The support system 1200 hangs from the entry rail 1410 from the hook portion of the detachable hanger 1210, as previously described.

The user secures, in this manner, the support system 1200 or a number of support systems 1200 each loaded with an article for treatment to the entry rail 1410 of the automatic ironing apparatus 1400.

Once the loaded support systems 1200 have been secured to the entry rail 1410 the user 1501 uses a user interface connected to the processor of the automatic ironing apparatus 1400 to initiate a treatment. The processor communicates with the components of the automatic ironing apparatus 1400 to execute the treatment process. In this example, on activation by the user 1501 of a treatment process the entry doors of the automatic ironing apparatus 1400 open and the entry rail 1410 of the automatic ironing apparatus 1400 conveys a support system 1200 and associated supported article into the treatment chamber of the automatic ironing apparatus 1400 through the open entry doors.

On entry to the treatment chamber and/or before treatment of the article 1506 begins, the entry doors close and the base mechanism 1240 of the support system 1400 connects to the central rail of the automatic ironing apparatus 1400 securing the support system 1200 to the central rail 1420.

The support system 1200 is therefore secured in the treatment chamber by both the entry rail 1410—by the hook portion of the hanger 1210—and also secured to the central rail 1420 via the base mechanism 1240 of the support system 1200, thereby holding the support system rigid for treatment. This process is shown in FIG. 15A, which shows the movement of the support system 1200 through the automatic ironing apparatus 1400.

The entry rail 1410 and the central rail 1420, controlled by the processor of the automatic ironing apparatus 1400, move the support system 1200 and supported article into different treatment positions in the treatment chamber. The supported article is treated by steamer heads and air blowers in the treatment system in a manner similar or identical to those methods described elsewhere this application.

Once the supported article has been treated the support system 1200 is released by the entry rail 1410. The support system 1200 and the treated article remain secured to the central rail 1420 by the base mechanism 1240 of the support system. The central rail 1420 conveys the support system 1200 to an exit rail 1430 that extends outside of the treatment chamber of the automatic ironing apparatus.

The exit rail 1430 accepts the base mechanism 1240 of the support system 1200 from the central rail 1420, the exit doors of the treatment chamber open, and the exit rail 1420 conveys the support system 1200 through the open exit doors along the exit rail 1420 to the exterior of the device where the treated article can be removed by from the support system 1200 by the user 1501.

A next article for treatment may then be moved, on instruction from the processor, through the automatic ironing apparatus 1400 for treatment, repeating the process described above until all articles for treatment loaded and secured onto the entry rail 1410 have been treated.

The treated articles awaiting collection by the user 1501 from the exit rail 1430 of the automatic ironing apparatus. FIG. 16C shows a user collecting a treated article 1506 from the exit rail 1430 of the automatic ironing apparatus 1400.

Advantageously, the support system 1200 described here allows the user to remove the detachable hanger 1210 with the treated article attached to the detachable hanger. Thus, allowing the user to immediately, on detaching the hanger 1210 and treated article from the support system, hang-up/store the treated article for example in a wardrobe.

The frame 1220 and base mechanism 1240 of the support system 1200 that remain attached to the exit rail 1430 after the user detaches the detachable hanger 1210 and treated article 1506 are conveyed back into the interior of the automatic ironing apparatus 1400 by the exit rail 1430 for storage.

On initialisation of the automatic ironing machine 1400, the automatic ironing machine 1400 may move a frame 1200 from storage to a presentation rail 1440 on the exterior of the automatic ironing apparatus 1400, presenting the empty frame 1220 to the user 1501. FIG. 16D shows the automatic ironing apparatus presenting, a frame 1220 retrieved from storage to the user via the presentation rail 1440, the user 1506 having a detachable hanger 1210 ready to attach to the frame 1220.

FIGS. 16E and 16F show the user 1501 removing the presented frame 1220 from the presentation rail 1440 by attaching a detachable hanger 1210 to the frame 1220 and lifting the frame up and off of the presentation rail 1440, the presentation rail pivoting up and towards the user. The user 1501 having then a support system 1200 ready for an untreated article to be loaded onto it.

This allows the above process to be repeated for further articles that may require treatment by the automatic ironing apparatus 1400. For example, by repeating the steps shown in FIGS. 16A-F and described above.

The above examples are to be understood as illustrative examples. Further examples are envisaged. It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the invention, which is defined in the accompanying claims.

The invention claimed is:

1. An automated ironing apparatus, comprising:

a flexible steaming head for applying steam to a supported article;

said flexible steaming head including a device for varying a shape of said flexible steaming head in at least two dimensions; and said flexible steaming head having a force sensor arranged to detect a tension in the supported article.

2. The automated ironing apparatus according to claim 1, wherein one of said at least two dimensions allows configuring the flexible steaming head into a triangular shape.

3. The automated ironing apparatus according to claim 1, wherein a profile of said flexible steaming head is adjustable to conform to a width of the supported article.

4. The automated ironing apparatus according to claim 3, wherein said flexible steaming head is adjustable to change a depth profile of said flexible steaming head.

5. The automated ironing apparatus according to claim 4, wherein the depth-profile is adjustable to configure said flexible steaming head into a triangular shape.

6. The automated ironing apparatus according to claim 1, wherein said flexible steaming head comprises a plurality of rigid steaming heads including a left steaming head, a right steaming head, and a central steaming head, and said plurality of steaming heads are adjustable to change at least one of a profile of said flexible steaming head or a depth-profile of said flexible steaming head.

7. The automated ironing apparatus according to claim 6, wherein the depth profile is adjustable by pivoting one or both of said left steaming head or said right steaming head.

8. The automated ironing apparatus according to claim 6, wherein said flexible steaming head comprises a device for positioning said rigid steaming heads so as to extend at least one of said profile or said depth-profile of said flexible steaming head.

9. The automated ironing apparatus according to claim 8, wherein said rigid steaming heads have a non-pivoting end and a pivoting end, and said device for positioning said rigid steaming heads to extend said depth-profile comprise one or more pistons connected to said rigid steaming heads at said non-pivoting end and/or a geared motor attached at said pivoting end of said rigid steaming heads.

10. The automated ironing apparatus according to claim 3, wherein at least one of said profile or said depth profile of said flexible steaming head is determined by the tension detected in the supported article.

11. The automated ironing apparatus according to claim 1, comprising a member configured to adjust a part of the supported article, being a garment into which gas is introduced, and wherein said member is said flexible steaming head.

12. A method of smoothing a garment, the method comprising:

providing an automated ironing apparatus having a flexible steaming head for applying steam to the garment, the flexible steaming head having a variable shape that is variable in at least two dimensions, and the flexible steaming head having a force sensor arranged to detect a tension in the garment;

closing at least one opening in the garment by engaging the flexible steaming head with a surface of the garment and thereby to restrict gas flow through the at least one opening; and introducing gas inside the garment thereby to smooth the garment.

13. The method according to claim 12, which further comprises inflating the garment by introducing gas inside the garment.

14. The method according to claim 12, which further comprises moving the flexible steaming head thereby to adjust a volume of the garment into which gas is introduced.

15. The method according to claim 12, which further comprises moving the steaming head while introducing gas into the garment to inflate the garment, optionally over a wide area in the garment, thereby to finish the smoothing.

16. The method according to claim 12, which comprises applying steam via the steaming head to reduce airflow further by effecting an improved seal.

17. The method according to claim 12, which comprises introducing gas inside the garment via a plurality of different flow paths, wherein different flow paths direct gas to different parts of the garment.

18. The method according to claim 17, which comprises providing different flow paths all via the same at least one opening.

19. The method according to claim 12, which comprises closing all openings in the garment other than the at least one opening used for an introduction of gas.

20. The method according to claim 12, which comprises introducing air and steam inside the garment.

21. The method according to claim 12, which comprises introducing air and steam at different times as part of a smoothing process.

* * * * *